US006627375B1

(12) United States Patent
Yasuda

(10) Patent No.: US 6,627,375 B1
(45) Date of Patent: Sep. 30, 2003

(54) SILVER HALIDE PHOTOGRAPHIC MATERIAL

(75) Inventor: Shoji Yasuda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 74 days.

(21) Appl. No.: 10/025,999

(22) Filed: Dec. 21, 2001

(30) Foreign Application Priority Data

Dec. 25, 2000 (JP) ..... P.2000-392938
Jun. 25, 2001 (JP) ..... P.2001-191151

(51) Int. Cl.[7] ..... G03C 1/06

(52) U.S. Cl. ..... 430/264; 430/502; 430/505; 430/523; 430/598; 430/599; 430/583; 430/600; 430/603; 430/607; 430/611; 430/613

(58) Field of Search ..... 430/264, 502, 430/505, 523, 598, 583, 599, 600, 603, 607, 611, 613

(56) References Cited

U.S. PATENT DOCUMENTS

| | | | | |
|---|---|---|---|---|
| 4,994,365 A | | 2/1991 | Looker et al. | |
| 6,054,260 A | | 4/2000 | Adin et al. | |
| 6,143,462 A | * | 11/2000 | Goddard et al. | 430/264 |
| 6,228,566 B1 | * | 5/2001 | Goddard et al. | 430/265 |
| 6,468,710 B1 | * | 10/2002 | Yasuda | 430/264 |

FOREIGN PATENT DOCUMENTS

| | | |
|---|---|---|
| EP | 0 196 626 A2 | 10/1986 |
| EP | 0 473 342 A1 | 3/1992 |
| EP | 0 786 690 A2 | 7/1997 |
| EP | 0 786 692 A1 | 7/1997 |
| EP | 0 893 731 A1 | 1/1999 |
| EP | 0 893 732 A1 | 1/1999 |
| EP | 1 008 902 A1 | 6/2000 |

OTHER PUBLICATIONS

XP–000849338, N. Obi et al., Production of Superhigh Contrast by Dyes, The Imaging Science Journal, vol. 47, (1999), pp. 43–48.
European Search Report dated Feb. 6, 2003.

* cited by examiner

*Primary Examiner*—Geraldine Letscher
(74) *Attorney, Agent, or Firm*—Sughrue Mion, PLLC

(57) ABSTRACT

A silver halide photographic material is disclosed, comprising a support having provided thereon at least a silver halide emulsion layer, which contains at least one compound represented by the following formula (I), and has a characteristic curve of gamma value being 5.0 or more in optical density of from 0.3 to 3.0 on the characteristic curve shown on the orthogonal axis of coordinates having equal unit length expressed by logarithmic exposure amount (x axis) and optical density (y axis):

$$(X)_l—(L)_m—(A—B)_n \qquad (I)$$

wherein X represents a silver halide-adsorptive group having at least one of N, S, P, Se and Te atom, or a light absorptive group; L represents a divalent linking group having at least one of C, N, S and O atom; A represents an electron donative group; B represents a releasing group or a hydrogen atom, which forms radical A. by releasing or deproton after oxidation; l and m each represents an integer of from 0 to 3; and n represents 1 or 2.

5 Claims, 1 Drawing Sheet

SILVER HALIDE PHOTOGRAPHIC MATERIAL

FIELD OF THE INVENTION

The present invention relates to a silver halide photographic material, in particular, a super-high contrast negative photographic material suitable for a silver halide photographic material for use in photomechanical process.

BACKGROUND OF THE INVENTION

In photomechanical process of the field of graphic arts, a continuous tone photographic image is converted to a so-called halftone dot image expressing the nuances of light and dark of the image by the sizes of dot areas and combined with a photographed image of characters and line images, to thereby make a printing plate precursor. A silver halide photographic material for use for such a purpose is required to have super-high contrast photographic characteristics of distinct discriminability of an image area and a non-image area to well reproduce the characters, line images and halftone dot image.

As the system to respond to the desire for super-high contrast photographic characteristics, a so-called lith developing system is known, which comprises the step of processing a silver halide photographic material comprising a silver chlorobromide with a hydroquinone developing solution of an extremely low effective concentration of a sulfite ion, to thereby form a high contrast image. However, since the sulfite ion concentration in the developing solution is low according to this method, the developing solution is exceedingly unstable to air oxidation and a great amount of a replenisher must be replenished for maintaining liquid activity stable.

As the image-forming systems solving the problem of instability of image formation by the lith developing system, and capable of obtaining super-high contrast photographic characteristics by processing a photographic material with a developing solution having a good storage stability, for example, U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836 and 5,650,746 are exemplified. These are systems of processing a surface latent image type silver halide photographic material containing a hydrazine derivative with a developing solution containing hydroquinone/metol or hydroquinone/phenidone as a developing agent containing 0.15 mol/liter or more of a sulfurous acid preservative and having pH of from 11.0 to 12.3 to thereby form a super-high contrast negative image having a $\gamma$ value of more than 10. According to these systems, super-high contrast and high sensitive photographic characteristics can be obtained and a sulfite of high concentration can be added to a developing solution, accordingly the stability to air oxidation of the developing solution is extraordinarily improved as compared with conventional lith developing solutions.

For sufficiently exhibiting a super-high contrast image due to a hydrazine derivative, it has been necessary to perform processing with a developing solution having a pH value of 11.5 or higher. Although a sulfurous acid preservative of high concentration has made it possible to heighten the stability of a developing solution, it is necessary to use a developing solution having a high pH value as described above to obtain a super-high contrast photographic image. A developing solution is liable to be air-oxidized and unstable even when a preservative is used, therefore various means have been contrived to realize a super-high contrast image with a lower pH value aiming at further improvement of stability.

For example, methods of using highly active hydrazine derivatives and nucleating accelerators for obtaining a super-high contrast image with a developing solution having pH of lower than 11.0 are disclosed in U.S. Pat. No. 4,269,929 (corresponding to JP-A-61-267759 (the term "JP-A" as used herein means an "unexamined published Japanese patent application")), U.S. Pat. No. 4,737,452 (corresponding to JP-A-60-179734), U.S. Pat. Nos. 5,104,769, 4,798,780, JP-A-1-179939, JP-A-1-179940, U.S. Pat. Nos. 4,998,604, 4,994,365 and JP-A-8-272023.

Also, a high contrast material containing a dimeric hydrazine derivative is disclosed in U.S. Pat. No. 6,228,566.

Since silver halide photographic materials for use in such an image-forming system contain highly active compounds, they are accompanied by various problems, such as the problems of storage stability, e.g., sensitivity fluctuates and fog increases during storage, and the aging stability of a coating solution at production is poor and the sensitivity fluctuation of the photographic material produced is large. Many of the causes are attributable to the fact that the sensitivity of emulsions is high, therefore further techniques of high sensitization have been desired.

SUMMARY OF THE INVENTION

An object of the present invention is to provide a high contrast and high sensitive silver halide photographic material.

The above object of the present invention has been achieved by the following means.

(1) A silver halide photographic material comprising a support having provided thereon at least a silver halide emulsion layer, which contains at least one compound represented by the following formula (I), and has a characteristic curve of gamma value being 5.0 or more in optical density of from 0.3 to 3.0 on the characteristic curve shown on the orthogonal axis of coordinates having equal unit length expressed by logarithmic exposure amount (x axis) and optical density (y axis):

$$(X)_l—(L)_m—(A—B)_n \qquad (I)$$

wherein X represents a silver halide-adsorptive group having at least one of N, S, P, Se and Te atom, or a light absorptive group; L represents a divalent linking group having at least one of C, N, S and O atom; A represents an electron donative group; B represents a releasing group or a hydrogen atom, which forms radical A. by releasing or deproton after oxidation; l and m each represents an integer of from 0 to 3; and n represents 1 or 2.

The gamma value is preferably from 5.0 to 100, particularly preferably from 5.0 to 30.

(2) The silver halide photographic material as described in the above item (1) which contains a hydrazine compound.

(3) The silver halide photographic material as described in the above item (1) or (2), wherein the pH of the film surface of the emulsion layer side is 6.0 or less.

The film surface pH is preferably from 4.5 to 6.0, because when the film surface pH is less than 4.5, the progress of film hardening of the emulsion layer is liable to be delayed.

(4) The silver halide photographic material as described in the above item (1), (2) or (3), wherein the hydrazine compound is a dimer comprising monomers containing both an acylhydrazide moiety and a nicotinamide moiety linked by a linking group.

(5) The silver halide photographic material as described in the above item (4), wherein the dimer comprising monomers containing both an acylhydrazide moiety and a nicotinamide moiety linked by a linking group is represented by the following formula (1) or (2):

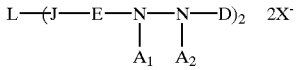

(1)

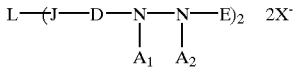

(2)

wherein each monomer linked by linking group L may be the same or different; J represents a nicotinamide residue; E represents a substituted aryl group or a heterocyclic ring; one of $A_1$ and $A_2$ represents a hydrogen atom and the other represents a hydrogen atom, an acyl group or an alkyl- or aryl-sulfonyl group, any of which may be substituted; D represents a blocking group; L represents a divalent linking group; and $X^-$ represents an anionic counter ion.

DESCRIPTION OF REFERENCE CHARACTERS

Figure 1:
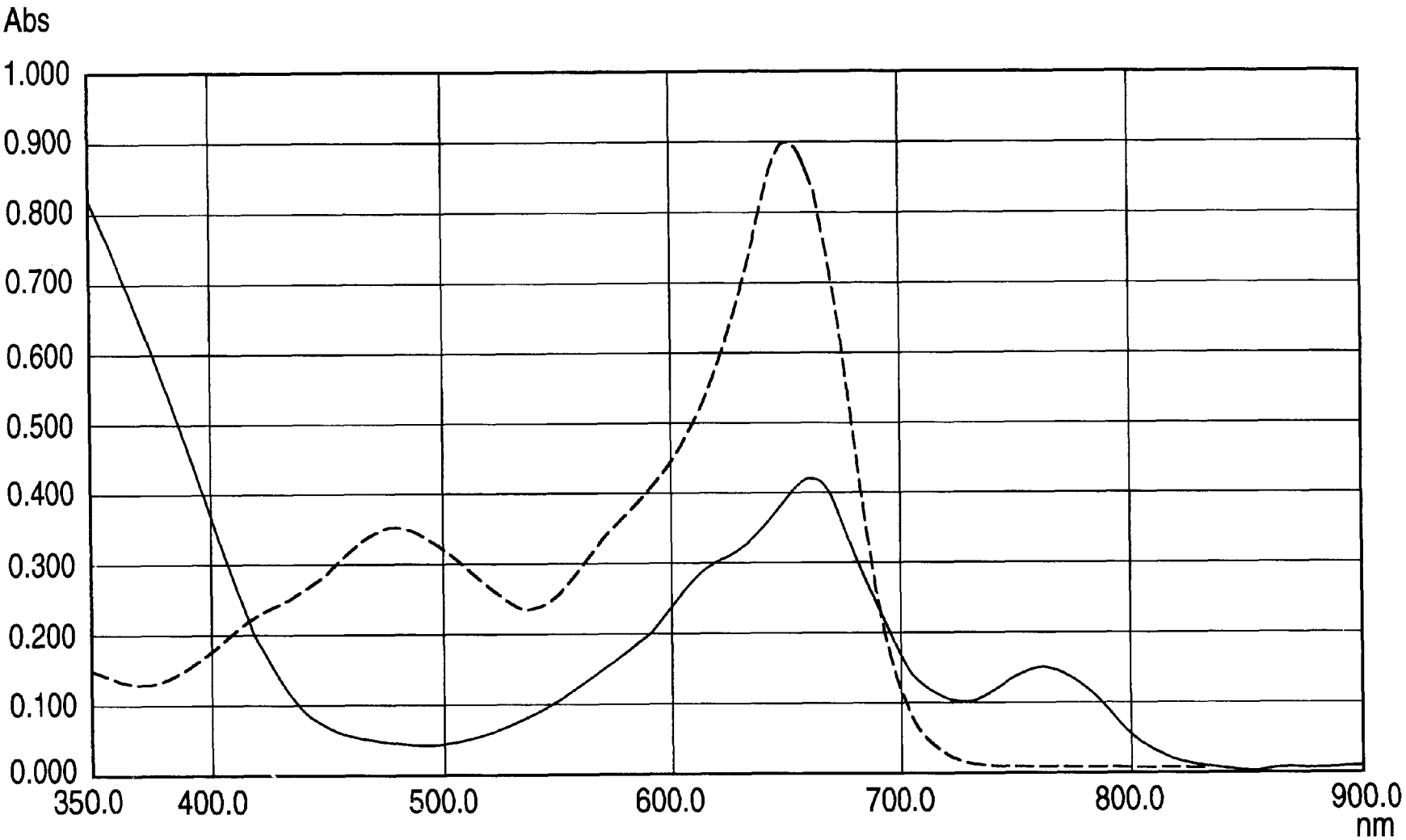
FIG. 1 shown the absorption spectra of the emulsion layer side and the backing layer side of the photographic material used in the Examples of the present invention.

The axis of ordinate shows absorbance (with intervals of 0.1); the axis of abscissa shows the wavelength of from 350 nm to 900 nm; the solid line shows the absorption spectrum of the emulsion layer side; and the broken line shows the absorption spectrum of the backing layer side.

DETAILED DESCRIPTION OF THE INVENTION

Gamma is defined in the present invention as follows. When a straight line is drawn between two points of optical density 0.3 and 3.0 on the characteristic curve shown on the orthogonal axis of coordinates having equal unit length expressed by optical density (y axis) and common logarithmic exposure amount (x axis), gamma is the incline of the curve, i.e., represented by tan θ with the angle formed by the straight line and the x axis as θ.

The specific processing method having the characteristic curve prescribed in the present invention is as follows:

A developing solution: ND-1 manufactured by Fuji Photo Film Co., Ltd.

A fixing solution: NF-1 manufactured by Fuji Photo Film Co., Ltd.

An automatic processor: FG-680AG manufactured by Fuji Photo Film Co., Ltd.

Developing condition: 35° C. 30 seconds.

There are a variety of methods for obtaining photographic materials having the characteristic curve prescribed in the present invention. The specific example is shown below.

One example is to add a heavy metal capable of realizing high contrast, e.g., metals belonging to group VIII of the Periodic Table, to a silver halide emulsion. It is particularly preferred to contain rhodium compounds, iridium compounds and ruthenium compounds.

A further method is to contain, as a nucleating agent, at least one compound of a hydrazine derivative, an amine compound and a phosphonium compound on the side on which an emulsion layer is provided.

In the first place, the compounds represented by formula (I) are described below.

The compounds represented by formula (I) for use in the present invention may be used at any stage of emulsion preparation, e.g., a grain forming stage, a desalting stage, during chemical sensitization or before coating. They may be divided and added separately during these stages in a plurality of times. The compounds according to the present invention are preferably added by being dissolved in water, water-soluble solvents, e.g., methanol and ethanol, or mixed solvents of them. When these compounds are dissolved in water, if the solubility of the compounds is increased with high pH or low pH, they may be dissolved with raising or lowering the pH and then added.

The compounds represented by formula (I) according to the present invention are preferably added to an emulsion layer, but they may be added to a protective layer or an intermediate layer with an emulsion layer and diffused at coating time. The compounds according to the present invention may be added at any time before and after the addition of sensitizing dyes, and they are added to a silver halide emulsion layer preferably in an amount of from $1\times10^{-9}$ to $5\times10^{-2}$ mol, more preferably from $1\times10^{-8}$ to $2\times10^{-3}$ mol, per mol of the silver halide.

The compounds represented by formula (I) for use in the present invention are described in detail below.

In formula (I), the silver halide-adsorptive group represented by X has at least one of N, S, P, Se and Te atom, preferably has silver ion ligand structure. As the silver ion ligand structure, the following can be exemplified:

$$—G_1—Z_1—R_1 \qquad \text{(X-1)}$$

wherein $G_1$ represents a divalent linking group, e.g., a substituted or unsubstituted alkylene group, alkenylene group, alkynylene group, arylene group, $SO_2$ group or divalent heterocyclic group; $Z_1$ represents an S, Se or Te atom; and $R_1$ represents a hydrogen atom, or a sodium ion, a potassium ion, a lithium ion or an ammonium ion as the counter ion which is necessary when $R_1$ is dissociated from $Z_1$.

(X-2a)

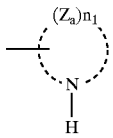

(X-2b)

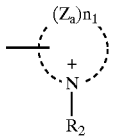

Formulae (X-2a) and (X-2b) are cyclized, and the form is a 5- to 7-membered heterocyclic ring or unsaturated ring; $Z_a$ represents an O, N, S, Se or Te atom; $n_1$ represents an integer of from 0 to 3; and $R_2$ represents a hydrogen atom, an alkyl group, an alkenyl group, an alkynyl group or an aryl group.

$$—R_3—(Z_2)n_2—R_4 \qquad \text{(X-3)}$$

wherein $Z_2$ represents an S, Se or Te atom; $n_2$ represents an integer of from 1 to 3; $R_3$ represents a divalent linking group, e.g., an alkylene group, an alkenylene group, an alkynylene group, an arylene group, or a divalent heterocyclic group; and $R_4$ represents an alkyl group, an aryl group or a heterocyclic group.

(X-4)

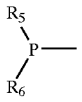

wherein $R_5$ and $R_6$ each represents an alkyl group, an alkenyl group, an arylene group or a heterocyclic group.

(X-5a)

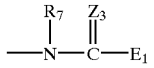

(X-5b)

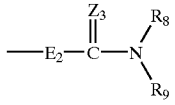

wherein $Z_3$ represents an S, Se or Te atom; $E_1$ represents a hydrogen atom, $NH_2$, $NHR_{10}$, $N(R_{10})_2$, $NHN(R_{10})_2$, $OR_{10}$ or $SR_{10}$; $E_2$ represents a divalent linking group, e.g., NH, $NR_{10}$, $NHNR_{10}$, O or S; $R_7$, $R_8$ and $R_9$ each represents a hydrogen atom, an alkyl group, an alkenyl group, an aryl group or a heterocyclic group, and $R_8$ and $R_9$ may be bonded to each other to form a ring; and $R_{10}$ represents a hydrogen atom, an alkyl group, an alkenyl group, an aryl group or a heterocyclic group.

(X-6a)

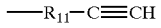

(X-6b)

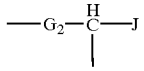

wherein $R_{11}$ represents a divalent linking group, e.g., an alkylene group, an alkenylene group, an alkynylene group, an arylene group, or a divalent heterocyclic group; $G_2$ and J each represents $COOR_{12}$, $SO_2R_{12}$, $COR_{12}$, $SOR_{12}$, CN, CHO or $NO_2$; and $R_{12}$ represents an alkyl group, an alkenyl group or an aryl group.

Formula (X-1) is described in detail below. As the linking group represented by $G_1$ in formula (X-1), a substituted or unsubstituted, straight chain or branched alkylene group having from 1 to 20 carbon atoms (e.g., methylene, ethylene, trimethylene, propylene, tetramethylene, hexamethylene, 3-oxapentylene, 2-hydroxytrimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butenylene), an alkynylene group having from 2 to 10 carbon atoms (e.g., ethyne), and a substituted or unsubstituted arylene group having from 6 to 20 carbon atoms (e.g., unsubstituted p-phenylene, unsubstituted 2,5-naphthylene) can be exemplified.

In formula (X-1), as the $SO_2$ group represented by $G_1$, an —$SO_2$— group bonded to a substituted or unsubstituted, straight chain or branched alkylene group having from 1 to 10 carbon atoms, a substituted or unsubstituted cyclic alkylene group having from 3 to 6 carbon atoms, and an alkenylene group having from 2 to 10 carbon atoms can be exemplified besides an —$SO_2$— group.

As the divalent heterocyclic group represented by $G_1$, an unsubstituted divalent heterocyclic group, a divalent heterocyclic group where the alkylene group, alkenylene group and arylene group are substituted and further the heterocyclic group is substituted, and a benzo-condensed or naphtho-condensed divalent heterocyclic group (e.g., 2,3-tetrazole-diyl, 1,3-triazole-diyl, 1,2-imidazole-diyl, 3,5-oxadiazole-diyl, 2,4-thiazole-diyl, 1,5-benzimidazole-diyl, 2,5-benzothiazole-diyl, 2,5-benzoxazole-diyl, 2,5-pyrimidine-diyl, 3-phenyl-2,5-tetrazole-diyl, 2,5-pyridine-diyl, 2,4-furan-diyl, 1,3-piperidine-diyl, 2,4-morpholine-diyl) can be exemplified.

In formula (X-1), $G_1$ may have substituents as far as possible. The examples of the substituents are shown below. These substituents are referred to as substituents Y.

The examples of substituents Y include a halogen atom (e.g., fluorine, chlorine, bromine, iodine), an alkyl group (e.g., methyl, ethyl, isopropyl, n-propyl, t-butyl), an alkenyl group (e.g., allyl, 2-butenyl), an alkynyl group (e.g., propargyl), an aralkyl group (e.g., benzyl), an aryl group (e.g., phenyl, naphthyl, 4-methylphenyl), a heterocyclic group (e.g., pyridyl, furyl, imidazolyl, piperidinyl, morpholyl), an alkoxyl group (e.g., methoxy, ethoxy, butoxy, 2-ethylhexyloxy, ethoxyethoxy, methoxyethoxy), an aryloxy group (e.g., phenoxy, 2-naphthyloxy), an amino group (e.g., unsubstituted amino, dimethylamino, diethylamino, dipropylamino, dibutylamino, ethylamino, aniline), an acylamino group (e.g., acetylamino, benzoylamino), a ureido group (e.g., unsubstituted ureido, N-methylureido) a urethane group (e.g., methoxycarbonylamino, phenoxycarbonylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl), a carbamoyl group (e.g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoric acid amido group (e.g., N,N-diethylphosphoric acid amido), a cyano group, a sulfo group, a thiosulfonic acid group, a sulfinic acid group, a carboxyl group, a hydroxyl group, a phosphono group, a nitro group, an ammonio group, a phosphonio group, a hydrazino group and a thiazolino group. When there are two or more substituents, they may be the same or different, and substituents may further have a substituent.

The preferred examples of formula (X-1) are shown below.

As the preferred formula (X-1), $G_1$ represents a substituted or unsubstituted arylene group having from 6 to 10 carbon atoms, an unsubstituted heterocyclic group, a heterocyclic group bonded to an alkylene group or an arylene group, or a benzo-condensed or naphtho-condensed heterocyclic group which forms a 5- to 7-membered ring; $Z_1$ represents an S or Se atom; and $R_1$ represents a hydrogen atom, a sodium ion or a potassium ion.

More preferably, $G_1$ represents a substituted or unsubstituted arylene group having from 6 to 8 carbon atoms, a heterocyclic group bonded to an arylene group, or a benzo-condensed heterocyclic group which forms a 5- or 6-membered ring, most preferably $G_1$ represents a heterocyclic group bonded to an arylene group, or a benzo-condensed heterocyclic group which forms a 5- or 6-membered ring. $Z_1$ more preferably represents an S atom, and $R_1$ more preferably represents a hydrogen atom or a sodium ion.

Formulae (X-2a) and (X-2b) are described in detail below.

As the alkyl, alkenyl and alkynyl groups represented by $R_2$, a substituted or unsubstituted, straight chain or branched alkyl group having from 1 to 10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, n-butoxypropyl, methoxymethyl), a substituted or unsubstituted cyclic alkyl group having from 3 to 6 carbon atoms (e.g., cyclopropyl, cyclopentyl, cyclohexyl), an alkenyl group having from 2 to 10 carbon atoms (e.g., allyl, 2-butenyl, 3-pentenyl), an alkynyl group having from 2 to 10 carbon atoms (e.g., propargyl, 3-pentynyl), and an aralkyl group having from 6 to 12 carbon atoms (e.g., benzyl) can be exemplified. As the aryl group represented by $R_2$, a substituted or unsubstituted aryl group having from 6 to 12 carbon atoms (e.g., unsubstituted phenol, 4-methylphenol) can be exemplified.

As the substituents for $R_2$, substituents Y described above can be exemplified.

The preferred examples of formulae (X-2a) and (X-2b) are described below.

Preferably, $R_2$ represents a hydrogen atom, a substituted or unsubstituted alkyl group having from 1 to 6 carbon atoms, or a substituted or unsubstituted aryl group having from 6 to 10 carbon atoms, $Z_a$ represents an O, N or S atom, and $n_1$ represents from 1 to 3.

More preferably, $R_2$ represents a hydrogen atom or an alkyl group having from 1 to 4 carbon atoms, $Z_a$ represents an N or S atom, and $n_1$ represents from 2 or 3.

Formula (X-3) is described in detail below.

As the linking group represented by $R_3$, a substituted or unsubstituted, straight chain or branched alkylene group having from 1 to 20 carbon atoms (e.g., methylene, ethylene, trimethylene, isopropylene, tetramethylene, hexamethylene, 3-oxapentylene, 2-hydroxytrimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butenylene), an alkynylene group having from 2 to 10 carbon atoms (e.g., ethyne), and a substituted or unsubstituted arylene group having from 6 to 20 carbon atoms (e.g., unsubstituted p-phenylene, unsubstituted 2,5-naphthylene) can be exemplified. As the divalent heterocyclic group, an unsubstituted divalent heterocyclic group, a divalent heterocyclic group where the alkylene group, alkenylene group and arylene group are substituted and further the heterocyclic group is substituted (e.g., 2,5-pyridine-diyl, 3-phenyl-2,5-pyridine-diyl, 1,3-piperidine-diyl, 2,4-morpholine-diyl) can be exemplified.

As the alkyl group represented by $R_4$ in formula (X-3), a substituted or unsubstituted, straight chain or branched alkyl group having from 1 to 10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutylaminoethyl, n-butoxymethyl, methoxymethyl), and a substituted or unsubstituted cyclic alkyl group having from 3 to 6 carbon atoms (e.g., cyclopropyl, cyclopentyl, cyclohexyl) can be exemplified. As the aryl group represented by $R_4$, a substituted or unsubstituted aryl group having from 6 to 12 carbon atoms (e.g., unsubstituted phenyl, 2-methylphenyl) can be exemplified.

As the heterocyclic group represented by $R_4$, an unsubstituted heterocyclic group, and a heterocyclic group where the alkyl group, alkenyl group and aryl group are substituted and further the heterocyclic group is substituted (e.g., pyridyl, 3-phenylpyridyl, piperidyl, morpholyl) can be exemplified.

As the substituents for $R_4$, substituents Y described above can be exemplified.

The preferred examples of formula (X-3) are described below.

Preferably, $R_3$ represents a substituted or unsubstituted alkylene group having from 1 to 6 carbon atoms, or a substituted or unsubstituted arylene group having from 6 to 10 carbon atoms, $R_4$ represents a substituted or unsubstituted alkyl group having from 1 to 6 carbon atoms, or a substituted or unsubstituted aryl group having from 6 to 10 carbon atoms, $Z_2$ represents an S or Se atom, and $n_2$ represents 1 or 2.

More preferably, $R_3$ represents an alkylene group having from 1 to 4 carbon atoms, $R_4$ represents an alkyl group having from 1 to 4 carbon atoms, $Z_2$ represents an S atom, and $n_2$ represents 1.

Formula (X-4) is described in detail below.

In formula (X-4), as the alkyl and alkenyl groups represented by $R_5$ and $R_6$, a substituted or unsubstituted, straight chain or branched alkyl group having from 1 to 10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxymethyl, n-butoxypropyl, methoxymethyl), a substituted or unsubstituted cyclic alkyl group having from 3 to 6 carbon atoms (e.g., cyclopropyl, cyclopentyl, cyclohexyl), and an alkenyl group having from 2 to 10 carbon atoms (e.g., allyl, 2-butenyl, 3-pentenyl) can be exemplified. As the aryl group represented by $R_5$ and $R_6$, a substituted or unsubstituted aryl group having from 6 to 12 carbon atoms (e.g., unsubstituted phenyl, 4-methylphenyl) can be exemplified. As the heterocyclic group, an unsubstituted heterocyclic group, and a heterocyclic group where the alkylene group, alkenylene group and arylene group are substituted and further the heterocyclic group is substituted (e.g., pyridyl, 3-phenylpyridyl, furyl, piperidyl, morpholyl) can be exemplified.

As the substituents for $R_5$ and $R_6$, substituents Y described above can be exemplified.

The preferred examples of formula (X-4) are described below.

Preferably, $R_5$ and $R_6$ each represents a substituted or unsubstituted alkyl group having from 1 to 6 carbon atoms, or a substituted or unsubstituted aryl group having from 6 to 10 carbon atoms.

More preferably, $R_5$ and $R_6$ each represents an aryl group having from 6 to 8 carbon atoms.

Formulae (X-5a) and (X-5b) are described in detail below.

As -the group represented by $E_1$, $NH_2$, $NHCH_3$, $NHC_2H_5$, NHPh, $N(CH_3)_2$, $N(Ph)_2$, $NHNHC_3H_7$, NHNHPh, $OC_4H_9$, OPh and $SCH_3$ can be exemplified. As the group represented by $E_2$, NH, $NCH_3$, $NC_2H_5$, NPh, $NHNC_3H_7$ and NHNPh can be exemplified.

In formulae (X-5a) and (X-5b), as the alkyl and alkenyl groups represented by $R_7$, $R_8$ and $R_9$, a substituted or unsubstituted, straight chain or branched alkyl group having from 1 to 10 carbon atoms (e.g., methyl, ethyl, isopropyl, n-propyl, n-butyl, t-butyl, 2-pentyl, n-hexyl, n-octyl, t-octyl, 2-ethylhexyl, hydroxymethyl, 2-hydroxyethyl, 1-hydroxyethyl, diethylaminoethyl, dibutylaminoethyl, n-butoxymethyl, n-butoxypropyl, methoxymethyl), a substituted or unsubstituted cyclic alkyl group having from 3 to 6 carbon atoms (e.g., cyclopropyl, cyclopentyl, cyclohexyl), and an alkenyl group having from 2 to 10 carbon atoms (e.g., allyl, 2-butenyl, 3-pentenyl) can be exemplified. As the aryl group represented by $R_7$, R 8 and $R_9$, a substituted or unsubstituted aryl group having from 6 to 12 carbon atoms (e.g., unsubstituted phenyl, 4-methylphenyl) can be exemplified. As the heterocyclic group, an unsubstituted heterocyclic group, or a heterocyclic group where the alkylene group, alkenylene group and arylene group are substituted and further the heterocyclic group is substituted (e.g., pyridyl, 3-phenylpyridyl, furyl, piperidyl, morpholyl) can be exemplified.

As the substituents for $R_7$, $R_8$ and $R_9$, substituents Y described above can be exemplified.

The preferred examples of formulae (X-5a) and (X-5b) are described below.

Preferably, $E_1$ represents an alkyl-substituted or unsubstituted amino group or an alkoxyl group, $E_2$ represents an alkyl-substituted or unsubstituted amino linking group, $R_7$, $R_8$ and $R_9$ each represents a substituted or unsubstituted alkyl group having from 1 to 6 carbon atoms, or a substituted or unsubstituted arylene group having from 6 to 10 carbon atoms, and $Z_3$ represents an S or Se atom.

More preferably, $E_1$ represents an alkyl-substituted or unsubstituted amino group, $E_2$ represents an alkyl-substituted or unsubstituted amino linking group, $R_7$, $R_8$ and $R_9$ each represents a substituted or unsubstituted alkyl group having from 1 to 4 carbon atoms, and $Z_3$ represents an S atom.

Formulae (X-6a) and (X-6b) are described in detail below.

As the groups represented by $G_2$ and J in formula (X-6b), $COOCH_3$, $COOC_3H_7$, $COOC_6H_{13}$, COOPh, $SO_2CH_3$, $SO_2C_4H_9$, $COC_2H_5$, COPh, $SOCH_3$, SOPh, CN, CHO and $NO_2$ can be exemplified.

In formula (X-6a), as the linking group represented by $R_{11}$, a substituted or unsubstituted, straight chain or branched alkylene group having from 1 to 20 carbon atoms (e.g., methylene, ethylene, trimethylene, propylene, tetramethylene, hexamethylene, 3-oxapentylene, 2-hydroxy-trimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butenylene), an alkynylene group having from 2 to 10 carbon atoms (e.g., ethyne), and a substituted or unsubstituted arylene group having from 6 to 20 carbon atoms (e.g., unsubstituted p-phenylene, unsubstituted 2,5-naphthylene) can be exemplified.

As the divalent heterocyclic group represented by $R_{11}$ in formula (X-6a), an unsubstituted divalent heterocyclic group, a divalent heterocyclic group where the alkylene group, alkenylene group and arylene group are substituted and further the heterocyclic group is substituted (e.g., 2,5-pyridine-diyl, 3-phenyl-2,5-pyridine-diyl, 2,4-furan-diyl, 1,3-piperidine-diyl, 2,4-morpholine-diyl) can be exemplified.

As the substituents for $R_{11}$, substituents Y described above can be exemplified.

The preferred examples of formulae (X-6a) and (X-6b) are described below.

Preferably, $G_2$ and J represent carboxylic esters having from 2 to 6 carbon atoms and carbonyls, and $R_1$l represents a substituted or unsubstituted alkylene group having from 1 to 6 carbon atoms or a substituted or unsubstituted arylene group having from 6 to 10 carbon atoms.

More preferably, $G_2$ and J represent carboxylic esters having from 2 to 4 carbon atoms, and $R_{11}$ represents a substituted or unsubstituted alkylene group having from 1 to 4 carbon atoms or a substituted or unsubstituted arylene group having from 6 to 8 carbon atoms.

The preferred grade of the above formulae of the silver halide-adsorptive group represented by X is the order of (X-1)>(X-2a)>(X-2b)>(X-3)>(X-5a)>(X-5b)>(X-4)>(X-6a)>(X-6b).

In the next place, the light absorptive group represented by X in formula (I) is described in detail below.

The light absorptive group represented by X in formula (I) is represented by the following formula (X-7):

(X-7)

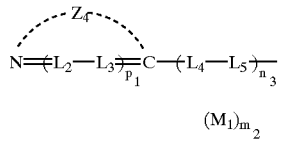

wherein $Z_4$ represents an atomic group necessary to form a 5- or 6-membered nitrogen-containing heterocyclic ring; $L_2$, $L_3$, $L_4$ and $L_5$ each represents a methine group; $p_1$ represents 0 or 1; $n_3$ represents an integer of from 0 to 3; $M_1$ represents a counter ion for equilibrating the electric charge; and $m_2$ represents an integer of from 0 to 10 necessary to neutralize the electric charge of the molecule.

The examples of the 5- or 6-membered nitrogen-containing heterocyclic rings formed by $Z_4$ in formula (X-7) include a thiazolidine nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b] quinoxaline nucleus, an oxadiazole nucleus, a thiadiazole nucleus, a tetrazole nucleus, and a pyrimidine nucleus.

As the substituents for the 5- or 6-membered nitrogen-containing heterocyclic rings formed by $Z_4$, substituents Y described above can be exemplified.

In formula (X-7), $L_2$, $L_3$, $L_4$ and $L_5$ each represents a methine group. The methine groups represented by $L_2$, $L_3$, $L_4$ and $L_5$ may have a substituent, and the examples of the substituents include a substituted or unsubstituted alkyl group having from 1 to 15 carbon atoms (e.g., methyl, ethyl, 2-carboxyethyl), a substituted or unsubstituted aryl group having from 6 to 20 carbon atoms (e.g., phenyl, o-carboxyphenyl), a substituted or unsubstituted heterocyclic group having from 3 to 20 carbon atoms (e.g., N,N-diethylbarbituric acid), a halogen atom (e.g., chlorine, bromine, fluorine, iodine), an alkoxyl group having from 1 to 15 carbon atoms (e.g., methoxy, ethoxy), an alkylthio group having from 1 to 15 carbon atoms (e.g., methylthio, ethylthio), an arylthio group having from 6 to 20 carbon atoms (e.g., phenylthio), and an amino group having from 0 to 15 carbon atoms (e.g., N,N-diphenylamino, N-methyl-N-phenylamino, N-methylpiperazine). Each of these methine groups may form a ring together with other methine groups, or they can form a ring with other moieties.

$M_1$ is included in the formula to show the presence of a cation or an anion when a counter ion is necessary to neutralize the ionic charge of a light absorptive group. The representative examples of cations include inorganic cations such as a hydrogen ion ($H^+$), and an alkali metal ion (e.g., a sodium ion, a potassium ion, a lithium ion), and organic cations such as an ammonium ion (e.g., an ammonium ion, a tetraalkylammonium ion, a pyridinium ion, an ethylpyridinium ion). Anions may also be either inorganic anions or organic anions, and the examples include a halogen anion (e.g., a fluorine ion, a chlorine ion, an iodine ion), a substituted arylsulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. Further, as counter ions, ionic polymers and light absorptive groups having a counter charge can also be used.

In the present invention, a sulfo group is described as $SO_3^-$ and a carboxyl group as $CO_2^-$ but they can be described as $SO_3H$ and $CO_2H$ respectively when they have hydrogen ions as the counter ions.

In formula (X-7), $m_2$ represents a number necessary to equilibrate the electric charge of the molecule, and $m_2$ represents 0 when a salt is formed in the molecule.

The preferred examples of formula (X-7) are described below.

Preferably, $Z_4$ represents a benzoxazole nucleus, a benzothiazole nucleus, a benzimidazole nucleus or a quinoline nucleus, $L_2$, $L_3$, $L_4$ and $L_5$ each represents an unsubstituted methine group, $p_1$ represents 0, and $n_3$ represents 1 or 2.

More preferably, $Z_4$ represents a benzoxazole nucleus or a benzothiazole nucleus, and $n_3$ represents 1. Particularly preferably, $Z_4$ represents a benzothiazole nucleus.

In formula (I), 1 preferably represents 0 or 1, more preferably 1.

The specific examples of X groups for use in the present invention are shown below, but the compounds which are used in the present invention is not limited thereto.

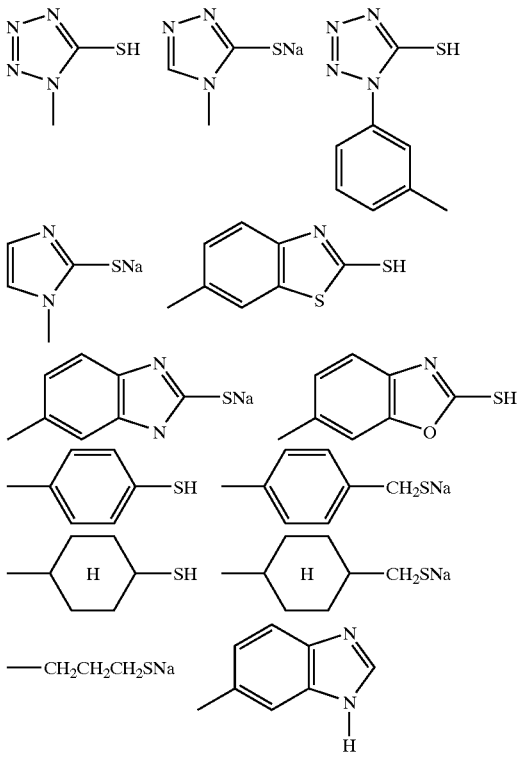

-continued

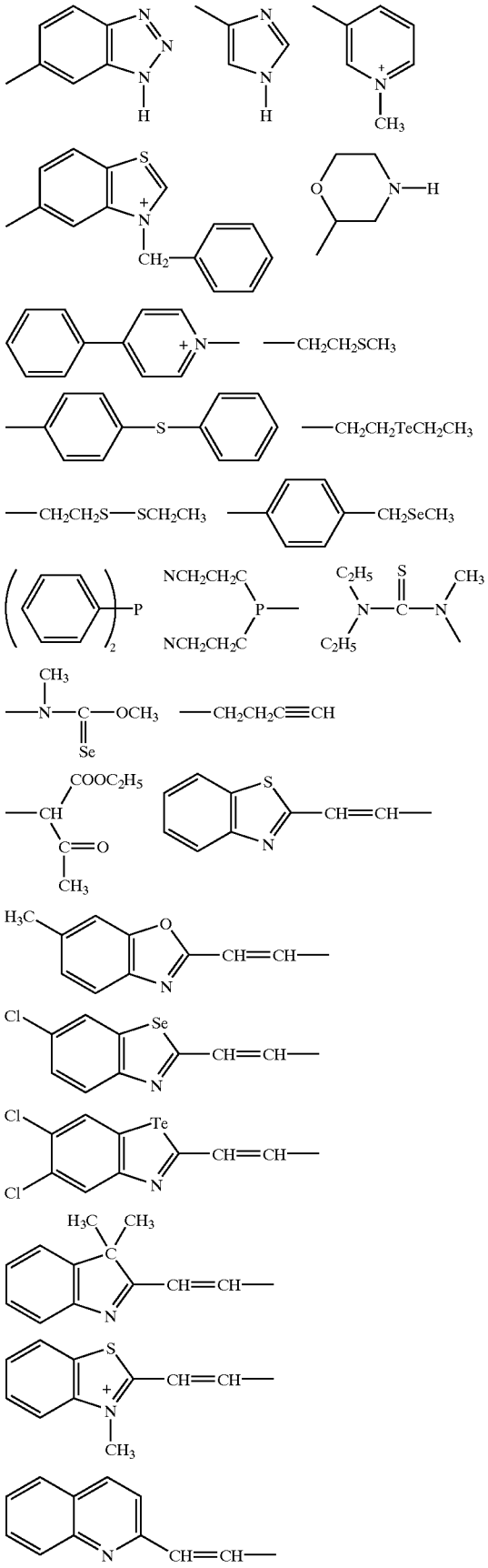

-continued

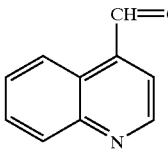

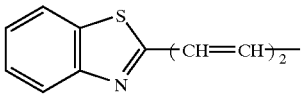

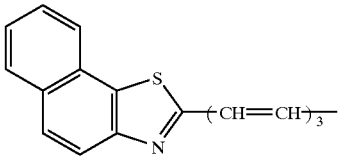

In formula (I), the linking group represented by L is described in detail below.

As the linking group represented by L in formula (I), a substituted or unsubstituted, straight chain or branched alkylene group having from 1 to 20 carbon atoms (e.g., methylene, ethylene, trimethylene, propylene, tetramethylene, hexamethylene, 3-oxapentylene, 2-hydroxytrimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butenylene), an alkynylene group having from 2 to 10 carbon atoms (e.g., ethyne), a substituted or unsubstituted arylene group having from 6 to 20 carbon atoms (e.g., unsubstituted p-phenylene, unsubstituted 2,5-naphthylene), a heterocyclic linking group (e.g., 2,6-pyridine-diyl), a carbonyl group, a thiocarbonyl group, an imido group, a sulfonyl group, a sulfonic acid group, an ester group, a thioester group, an amido group, an ether group, a thioether group, an amino group, a ureido group, a thioureido group, and a thiosulfonyl group can be exemplified. These linking groups may be linked with each other to form a new linking group.

As the substituents for L, substituents Y described above can be exemplified.

As preferred linking group L, an unsabstituted alkylene group having from 1 to 10 carbon atoms and an alkylene group having from 1 to 10 carbon atoms linking an amino group, an amido group, a thioether group, a ureido group or a sulfonyl group, more preferably an unsabstituted alkylene group having from 1 to 6 carbon atoms and an alkylene group having from 1 to 6 carbon atoms linking an amino group, an amido group or a thioether group can be exemplified.

In formula (I), m preferably represents 0 or 1, more preferably 1.

Electron donative group A is described in detail below.

A-B moiety captures the positive holes of a silver halide and a dye to thereby generate electrons, subsequently radical A. is formed as a result of a bond cleavage reaction, and further, radical A. undergoes oxidation to generate electrons. All the electrons generated are impregnated into the silver halide and contribute to increase of sensitization. The reaction process is shown on the following scheme.

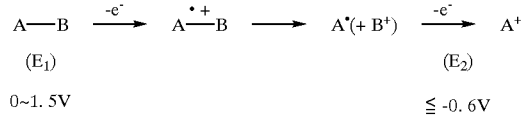

Since A is an electron donative group, it is preferred that, what a structure it may be, the substituent on an aromatic group is selected so that A is in the state of excess of electrons. For example, when an aromatic ring is not in excess of electrons, it is preferred to introduce electron donative groups, on the contrary in the state of remarkable excess of electrons such as anthracene, introduce an electron attractive group to control the oxidation potential.

Group A preferably has any of the following formulae (A-1), (A-2) and (A-3):

(A-1)

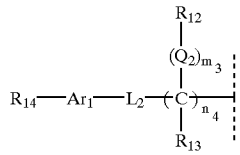

(A-2)

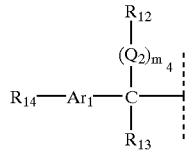

(A-3)

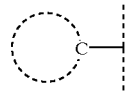

In formulae (A-1) and (A-2), $R_{12}$ and $R_{13}$ each represents a hydrogen atom, a substituted or unsubstituted alkyl, aryl, alkylene or arylene group; $R_{14}$ represents an alkyl group, COOH, halogen, $N(R_{15})_2$, $(OH)_n$, $(OR_{15})_n$ $(SR_{15})_n$, $OR_{15}$, $SR_{15}$, CHO, $COR_{15}$, $COOR_{15}$, $CONHR_{15}$, $CON(R_{15})_2$, $SO_3R_{15}$, $SO_2NHR_{15}$, $SO_2NR_{15}$, $SO_2R_{15}$, $SOR_{15}$ or $CSR_{15}$; $Ar_1$ represents an aryl group or a heterocyclic group, $R_{12}$ and $R_{13}$, and $R_{12}$ and $Ar_1$ may be bonded to form a ring; $Q_2$ represents O, S, Se or Te; $m_3$ and $m_4$ each represents 0 or 1; $n_4$ represents from 1 to 3; $L_2$ represents N—R, N—Ar, O, S or Se; the ring forms represent from 5- to 7-membered heterocyclic rings or unsaturated rings; and $R_{15}$ represents a hydrogen atom, an alkyl group or an aryl group. The ring form of formula (A-3) represents a substituted or unsubstituted 5- to 7-membered unsaturated ring or a heterocyclic ring.

Formulae (A-1), (A-2) and (A-3) are described in detail below.

In formulae (A-1) and (A-2), as the alkyl groups represented by $R_{12}$ and $R_{13}$, a substituted or unsubstituted, straight chain or branched alkyl group having from 1 to 10 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, diethylaminoethyl, dibutylaminoethyl, n-butoxymethyl, methoxymethyl), and a substituted or unsubstituted cyclic alkyl group having from 3 to 6 carbon atoms (e.g., cyclopropyl, cyclopentyl, cyclohexyl) can be exemplified. As the aryl groups represented by $R_{12}$ and $R_{13}$, a substituted or unsubstituted aryl group having from 6 to 12 carbon atoms (e.g., unsubstituted phenyl, 2-methylphenyl) can be exemplified.

As the alkylene groups represented by $R_{12}$ and $R_{13}$, a substituted or unsubstituted, straight chain or branched alkylene group having from 1 to 10 carbon atoms (e.g., methylene, ethylene, trimethylene, tetramethylene, methoxyethylene) can be exemplified, and as the arylene groups, a substituted or unsubstituted arylene group having from 6 to 12 carbon atoms (e.g., unsubstituted phenylene, 2-methylphenylene, naphthylene) can be exemplified.

In formulae (A-1) and (A-2), as the groups represented by $R_{14}$, an alkyl group (e.g., methyl, ethyl, isopropyl, n-propyl, n-butyl, 2-pentyl, n-hexyl, n-octyl, 2-ethylhexyl, 2-hydroxyethyl, n-butoxymethyl), a COOH group, a halogen atom (e.g., fluorine, chlorine, bromine), OH, $N(CH_3)_2$, $NPh_2$, $OCH_3$, OPh, $SCH_3$, SPh, CHO, $COCH_3$, COPh, $COOC_4H_9$, $COOCH_3$, $CONHC_2H_5$, $CON(CH_3)_2$, $SO_3CH_3$, $SO_3C_3H_7$, $SO_2NHCH_3$, $SO_2N(CH_3)_2$, $SO_2C_2H_5$, $SOCH_3$, CSPh and $CSCH_3$ can be exemplified.

As $Ar_1$ in formulae (A-1) and (A-2), a substituted or unsubstituted aryl group having from 6 to 12 carbon atoms (e.g., phenyl, 2-methylphenyl, naphthyl), and a substituted or unsubstituted heterocyclic group (e.g., pyridyl, 3-phenylpyridyl, piperidyl, morpholyl) can be exemplified.

As $L_2$ in formulae (A-1) and (A-2), NH, $NCH_3$, $NC_4H_9$, $NC_3H_7$(i), NPh, NPh—$CH_3$, O, S, Se and Te can be exemplified.

As the ring form of formula (A-3), an unsaturated 5- to 7-membered ring, a heterocyclic ring (e.g., furyl, piperidyl, morpholyl) can be exemplified.

As the substituents for $R_{12}$, $R_{13}$, $R_{14}$, $Ar_1$ and $L_2$ in formulae (A-1) and (A-2), and the substituent on the ring in formula (A-3), substituents Y described above can be exemplified.

The preferred examples of formulae (A-1), (A-2) and (A-3) are described below.

In formulae (A-1) and (A-2), preferably $R_{12}$ and $R_{13}$ each represents a substituted or unsubstituted alkyl group and alkylene group having from 1 to 6 carbon atoms, or a substituted or unsubstituted aryl group having from 6 to 10 carbon atoms, $R_{14}$ represents a substituted or unsubstituted alkyl group having from 1 to 6 carbon atoms, an amino group mono- or di-substituted with an alkyl group having from 1 to 4 carbon atoms, a carboxylic acid, a halogen, or a carboxylic acid ester having from 1 to 4 carbon atoms, Ar1 represents a substituted or unsubstituted aryl group having from 6 to 10 carbon atoms, $Q_2$ represents O, S or Se, $m_3$ and $m_4$ each represents 0 or 1, $n_4$ represents from 1 to 3, and $L_2$ is an amino group substituted with an alkyl group having from 0 to 3 carbon atoms.

The preferred ring form of formula (A-3) is a 5- to 7-membered heterocyclic ring.

In formulae (A-1) and (A-2), more preferably R $1_2$ and $R_{13}$ each represents a substituted or unsubstituted alkyl group and alkylene group having from 1 to 4 carbon atoms, $R_{14}$ represents an unsubstituted alkyl group having from 1 to 4 carbon atoms, or an alkyl group having from 1 to 4 carbon atoms mono- or di-substituted with an amino group, $Ar_1$ represents a substituted or unsubstituted aryl group having from 6 to 10 carbon atoms, $Q_2$ represents O or S, $m_3$ and $m_4$ each represents 0, $n_4$ represents 1, and $L_2$ is an amino group substituted with an alkyl group having from 0 to 3 carbon atoms.

The more preferred ring form of formula (A-3) is a 5- or 6-membered heterocyclic ring.

Group A is bonded to group X at $Ar_1$ and $R_{12}$ or $R_{13}$.

The specific examples of groups A for use in the present invention are shown below, but the compounds which are used in the present invention are not limited thereto.

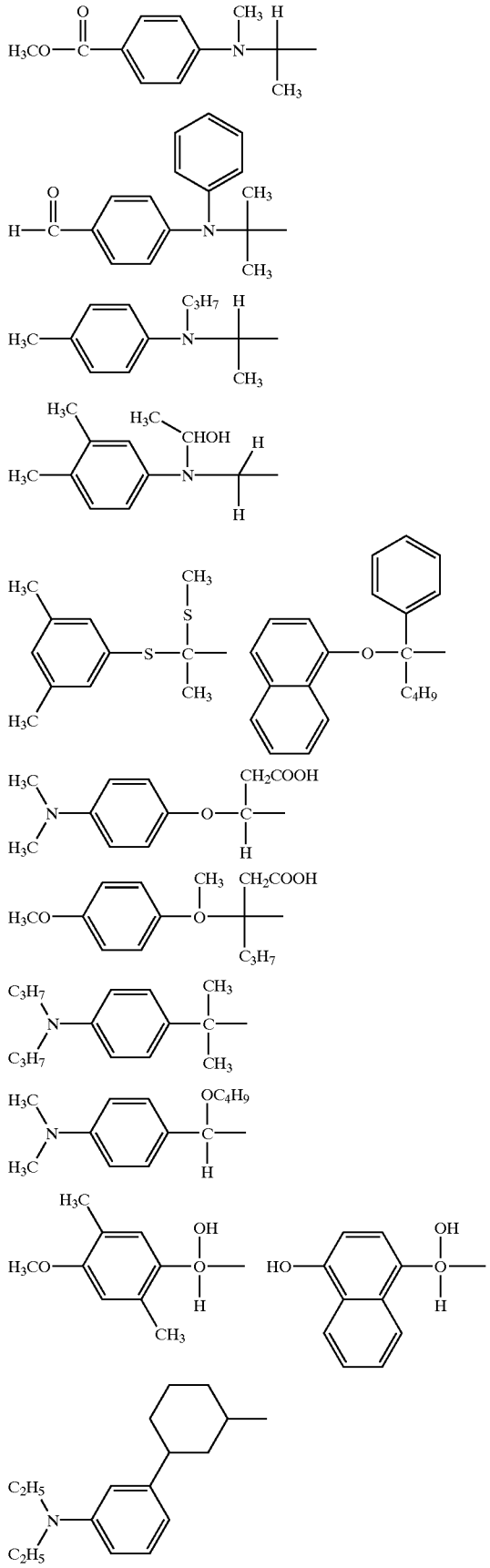

-continued

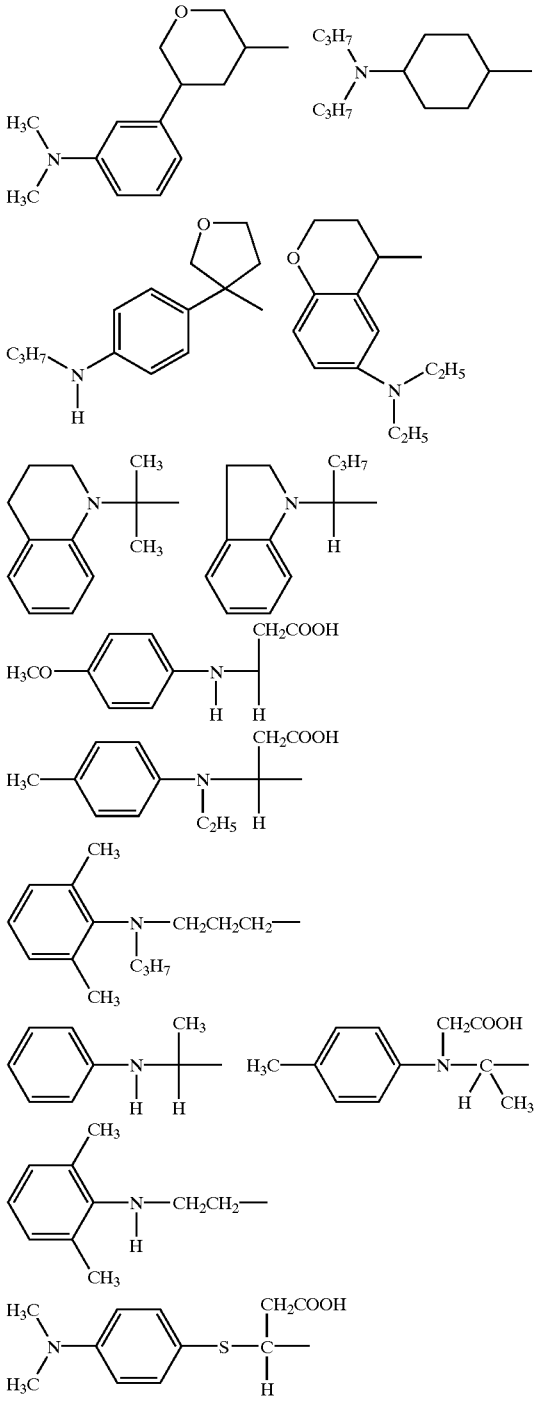

Group B is described in detail below.

When group B is a hydrogen atom, radical A. is formed by deproton after oxidation by the inner salt group.

Group B preferably has a hydrogen atom and any of the following formulae (B-1), (B-2) and (B-3):

(B-1)

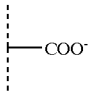

-continued (B-2)

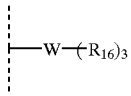

(B-3)

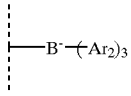

wherein W represents Si, Sn or Ge; $R_{16}$ represents an alkyl group; and $Ar_2$ represents an aryl group.

Formulae (B-2) and (B-3) may be bonded to an adsorptive group X.

Formulae (B-1), (B-2) and (B-3) are described in detail below.

As the alkyl group represented by $R_{16}$, a substituted or unsubstituted, straight chain or branched alkyl group having from 1 to 6 carbon atoms (e.g., methyl, ethyl, isopropyl, n-propyl, n-butyl, t-butyl, 2-pentyl, n-hexyl, n-octyl, t-octyl, 2-ethylhexyl, 2-hydroxyethyl, 1-hydroxyethyl, n-butoxymethyl, methoxymethyl), and a substituted or unsubstituted aryl group having from 6 to 12 carbon atoms (e.g., phenyl, 2-methylphenyl) can be exemplified.

As the substituents for $R_{16}$ and $Ar_2$ in formulae (B-2) and (B-3), substituents Y described above can be exemplified.

The preferred examples of formulae (B-1), (B-2) and (B-3) are described below.

In formulae (B-2) and (B-3), preferably $R_{16}$ represents a substituted or unsubstituted alkyl group having from 1 to 4 carbon atoms, Ar 2 represents a substituted or unsubstituted aryl group having from 6 to 10 carbon atoms, and W represents Si or Sn.

In formulae (B-2) and (B-3), more preferably $R_{16}$ represents a substituted or unsubstituted alkyl group having from 1 to 3 carbon atoms, $Ar_2$ represents a substituted or unsubstituted aryl group having from 6 to 8 carbon atoms, and W represents Si.

In formulae (B-1), (B-2) and (B-3), $COO^-$ in (B-1) and $Si—(R_{16})_3$ in (B-2) are most preferred.

In formula (I), n preferably represents 1.

The examples of A-B groups for use in the present invention are shown below, but the present invention is not limited thereto.

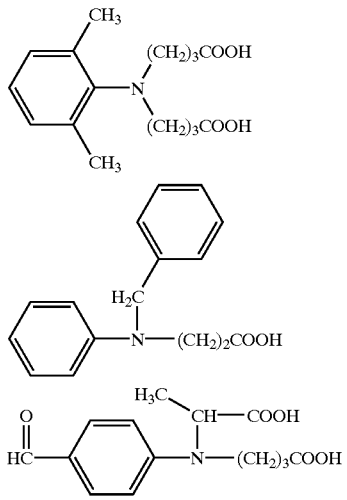

-continued

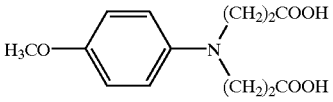

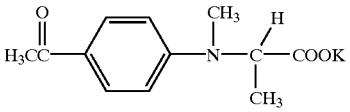

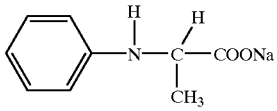

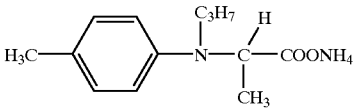

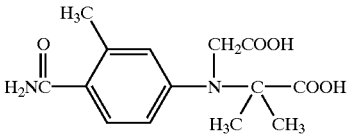

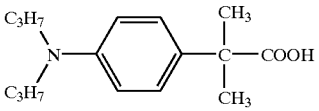

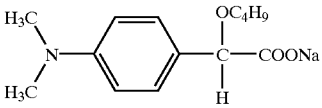

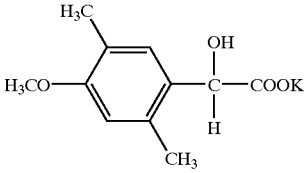

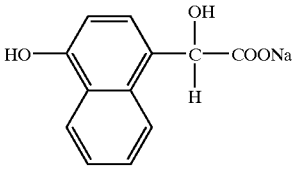

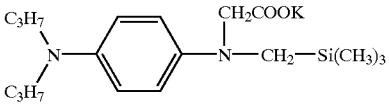

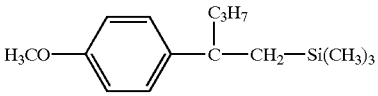

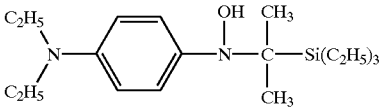

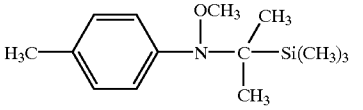

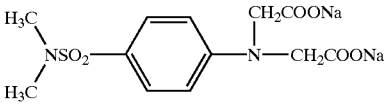

-continued

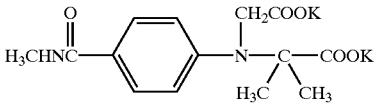

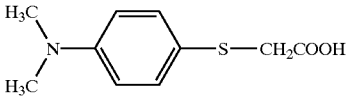

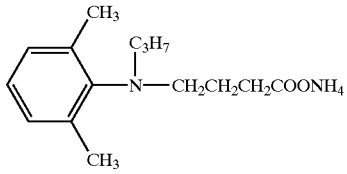

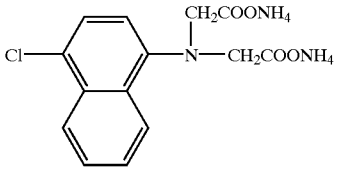

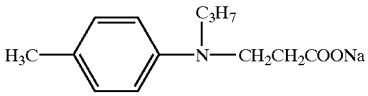

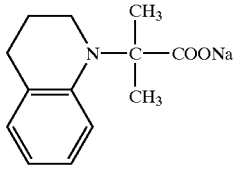

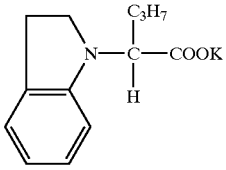

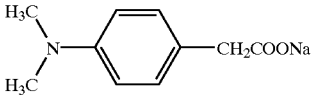

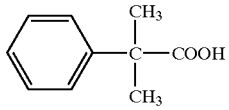

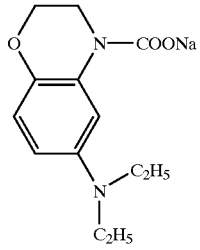

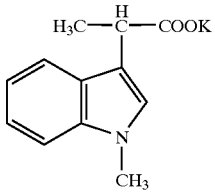

The counter ions necessary to balance the electric charge of the above A-B compounds include a sodium ion, a potassium ion, a triethylammonium ion, a diisopropylammonium ion, a tetrabutylammonium ion and a tetramethylguanidinium ion.

The oxidation potential of A-B compounds is preferably from 0 to 1.5 V, more preferably from 0 to 1.0 V, and still more preferably from 0.3 to 1.0 V.

The oxidation potential of radical A. ($E_2$) generated by a bond cleavage reaction is preferably from −0.6 to −2.5 V, more preferably from −0.9 to −2 V, and still more preferably from −0.9 to −1.6 V.

Oxidation potential can be measured as described below.

$E_1$ value can be measured by a cyclic voltammetry method. Electron donor A is dissolved in a solution comprising 80%/20% (by volume) of acetonitrile/water containing 0.1 M lithium perchlorate. A vitreous carbon disc is used as a working electrode, a platinum wire as a counter electrode, and a saturation calomel electrode (SCE) as a reference electrode. Measurement is performed at 25° C. and at 0.1 V/second of a potential sweep velocity scanning velocity. Oxidation potential v.s. SCE is taken at the peak potential of cyclic voltammetry wave. $E_1$ values of these A-B compounds are disclosed in EP-A-93731.

Measurement of the oxidation potential of radicals is performed by the transiently electrochemical and pulse radiation decomposition method. The measuring method is reported in *J. Am. Chem. Soc.*, 1988, 110, .132, *ibid.*, 1974, 96, .1287, *ibid.*, 1974, 96, .1295.

The specific examples of the compounds represented by formula (I) are shown below, but the compounds for use in the present invention are not limited thereto.

(I-1)

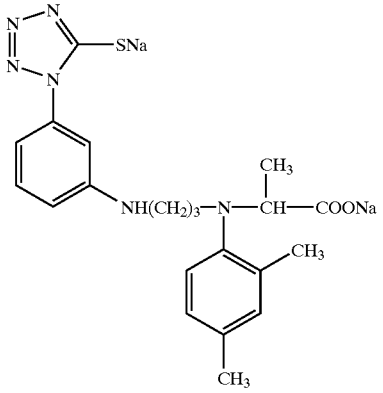

(I-2)

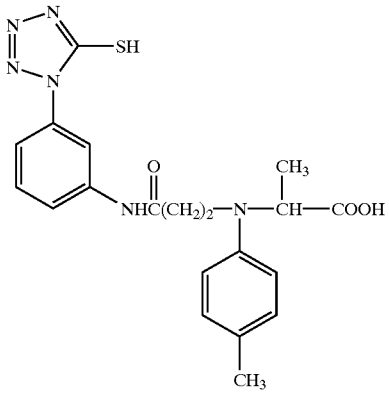

(I-3)

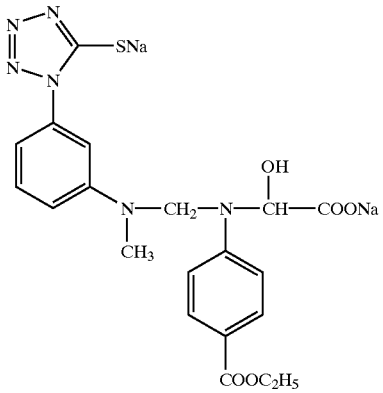

-continued (I-4)

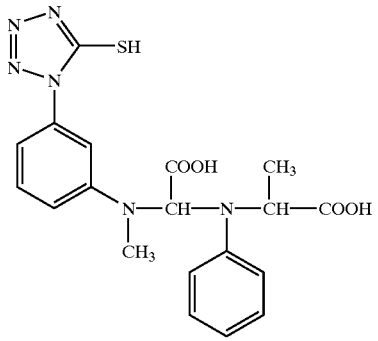

(I-5)

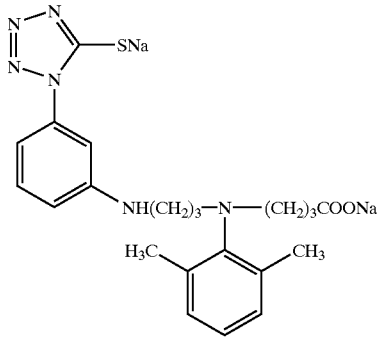

(I-6)

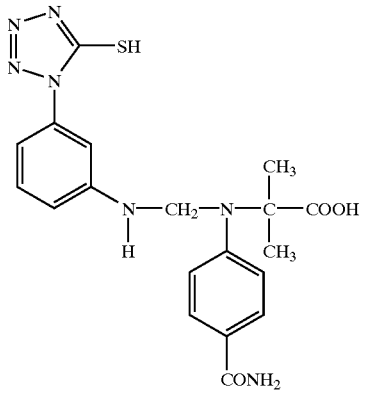

(I-7)

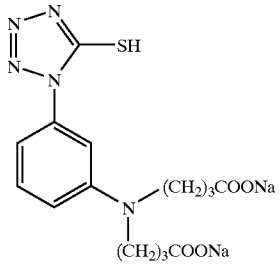

(I-8)

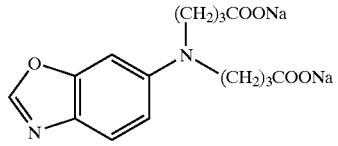

-continued
(I-9)
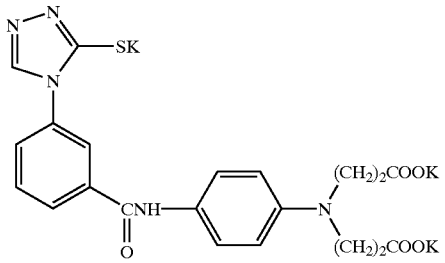
(I-10)
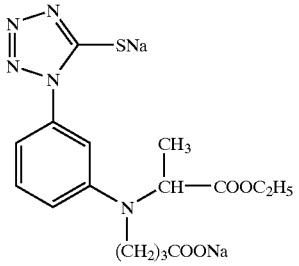
(I-11)
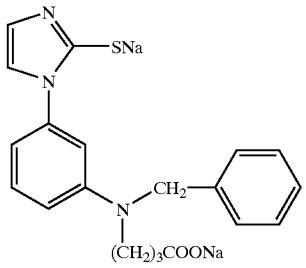
(I-12)
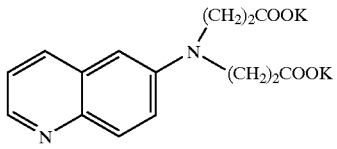
(I-13)
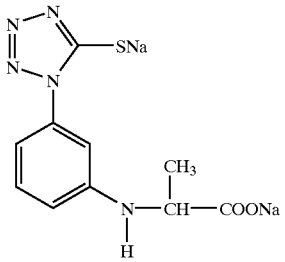
(I-14)
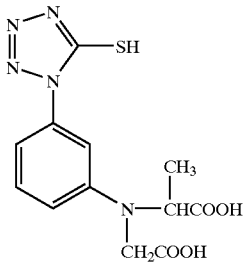
-continued
(I-15)
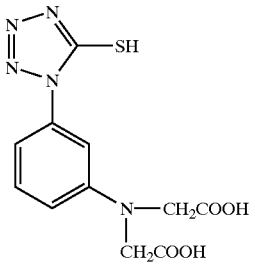
(I-16)
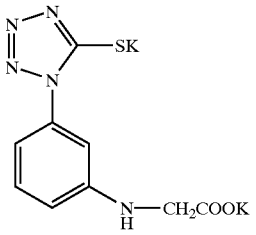
(I-17)
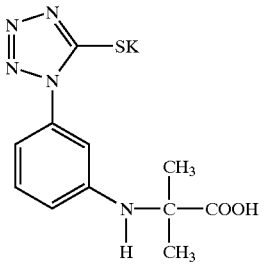
(I-18)
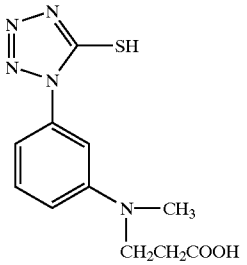
(I-19)
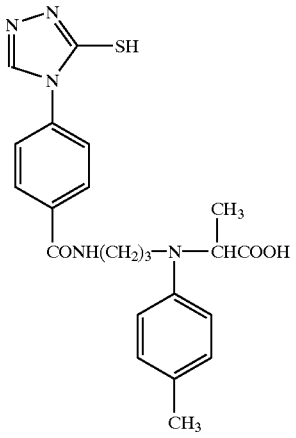

-continued
(I-20)
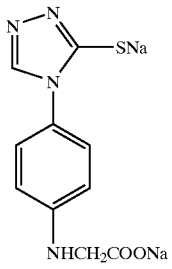
(I-21)
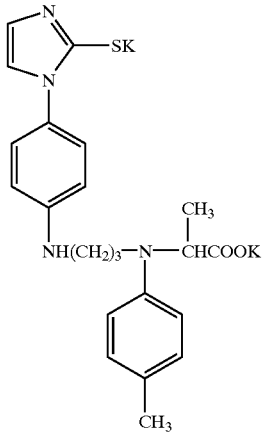
(I-22)
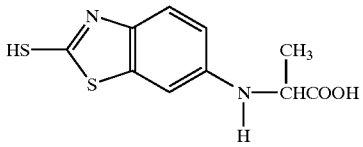
(I-23)
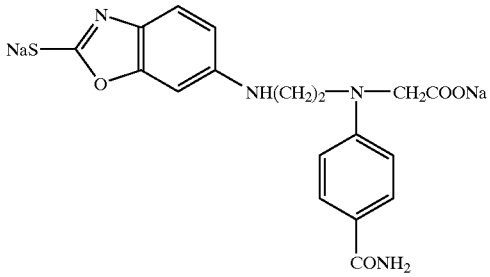
(I-24)
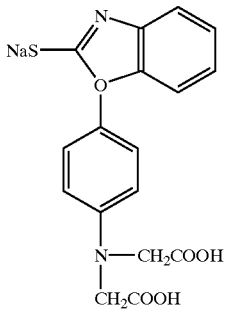
-continued
(I-25)
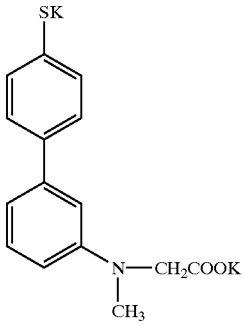
(I-26)
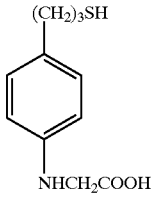
(I-27)
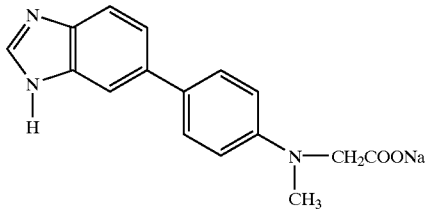
(I-28)
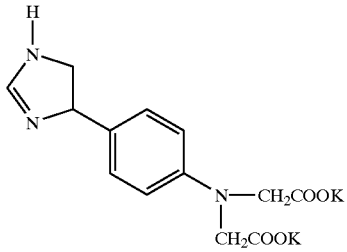
(I-29)
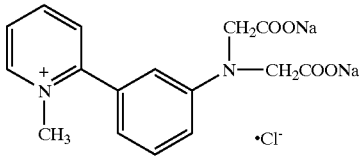
(I-30)
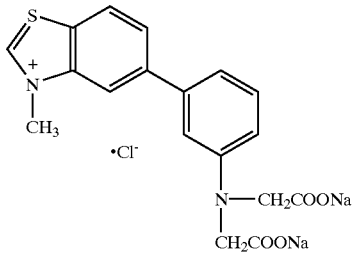
(I-31)
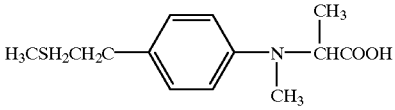

-continued
(I-32)
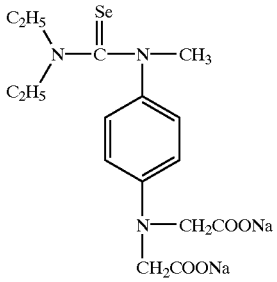
(I-33)
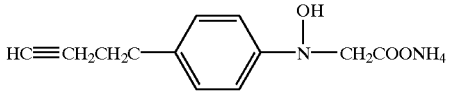
(I-34)
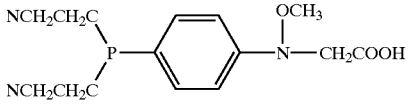
(I-35)
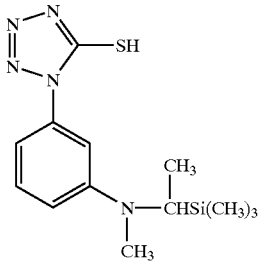
(I-36)
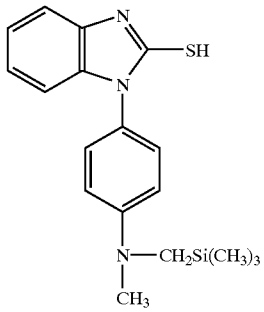
(I-37)
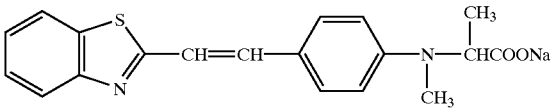
(I-38)
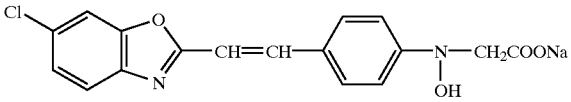
(I-39)
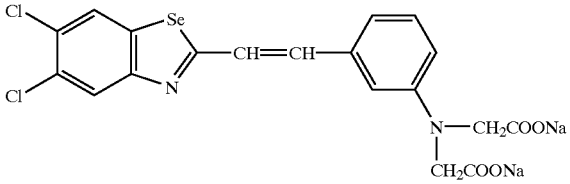
-continued
(I-40)
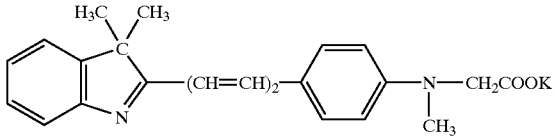
(I-41)
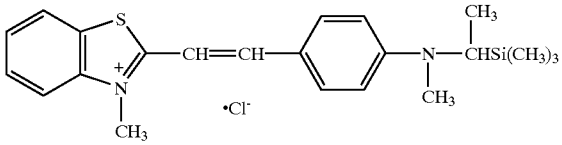
(1-42)
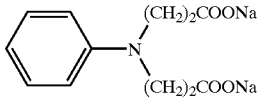
(1-43)
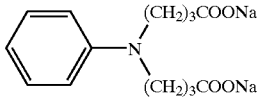
(1-44)
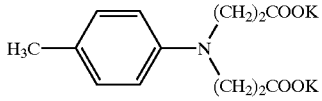
(1-45)
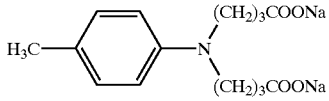
(1-46)
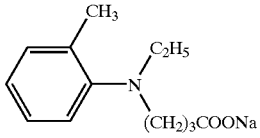
(1-47)
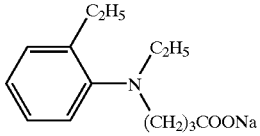
(1-48)
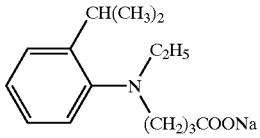
(1-49)
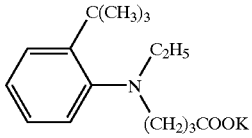
(1-50)
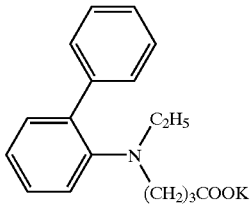

-continued
(1-51)
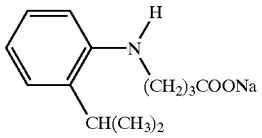
(1-52)
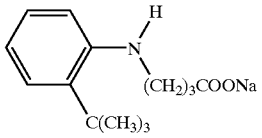
(1-53)
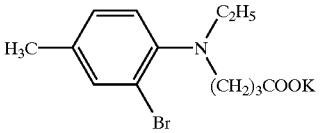
(1-54)
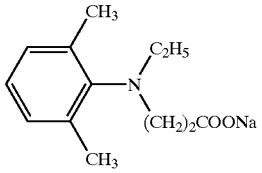
(1-55)
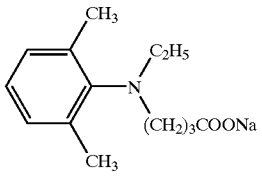
(1-56)
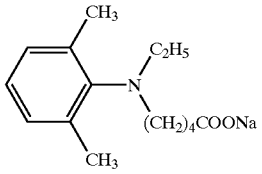
(1-57)
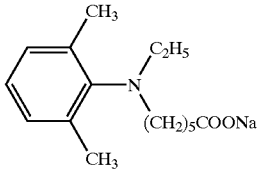
(1-58)
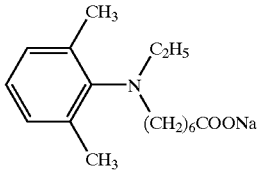
(1-59)
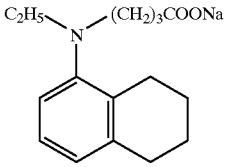
-continued
(1-60)
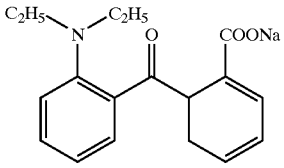
(1-61)
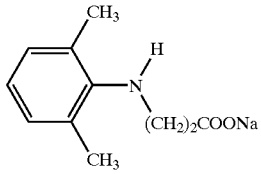
(1-62)
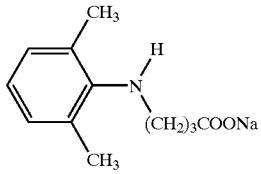
(1-63)
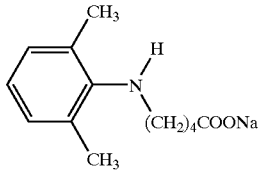
(1-64)
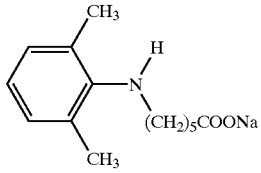
(1-65)
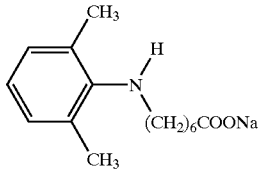
(1-66)
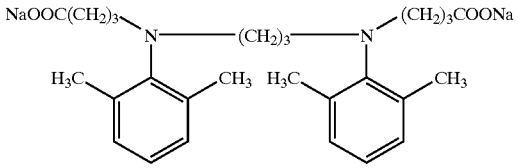
(1-67)
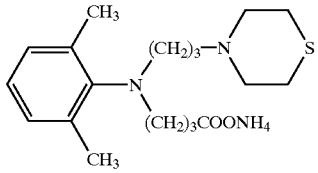

-continued
(1-68)
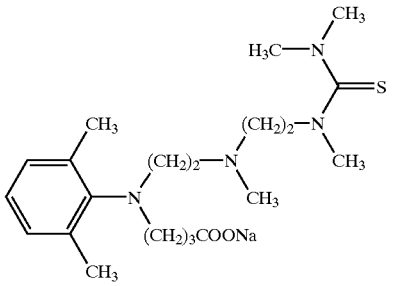
(1-69)
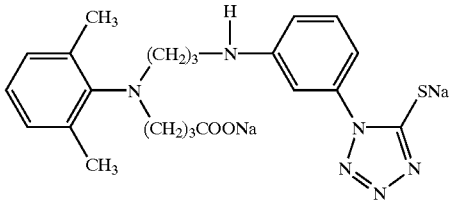
(1-70)
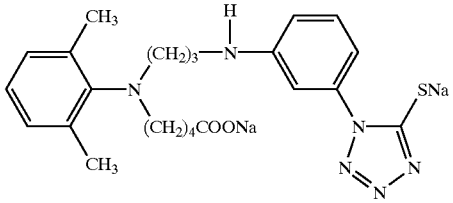
(1-71)
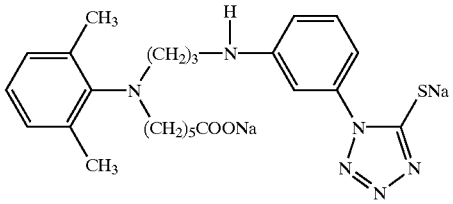
(1-72)
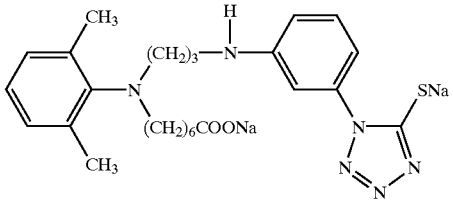
(1-73)
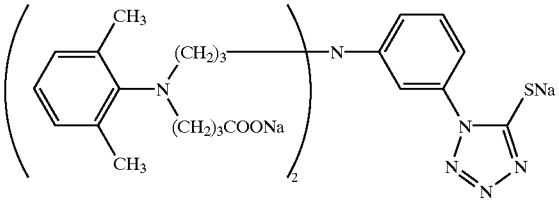
(1-74)
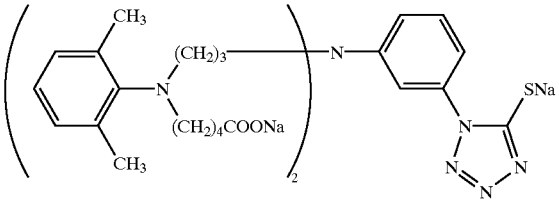
-continued
(I-75)
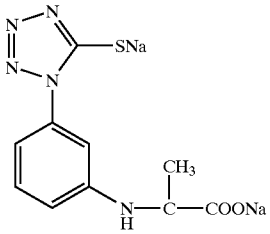
(I-76)
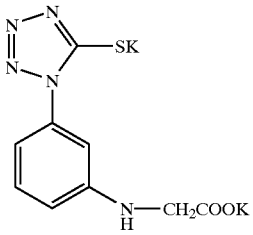
(I-77)
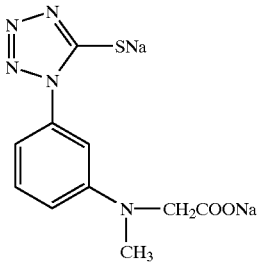
(I-78)
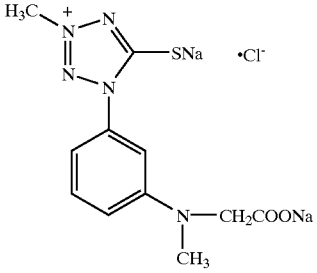
(I-79)
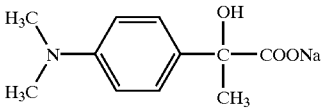
(I-80)
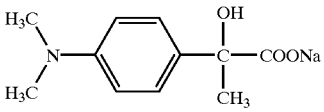
(I-81)
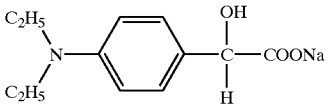
(I-82)
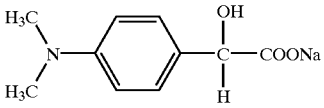

-continued
(I-83)
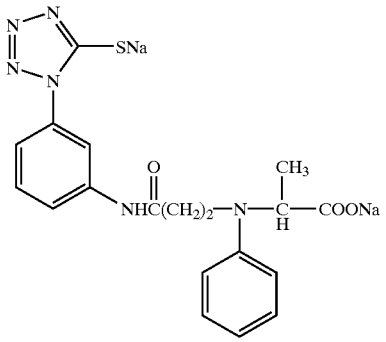
(I-84)
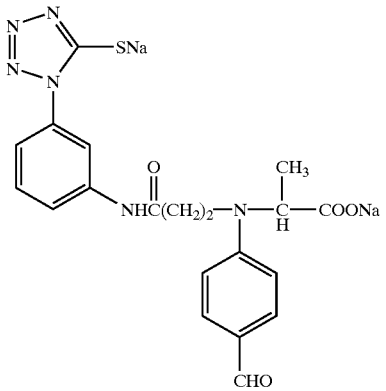
(I-85)
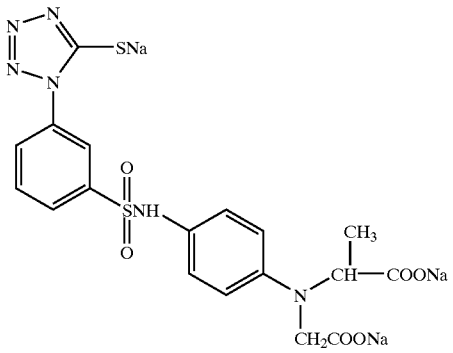
(I-86)
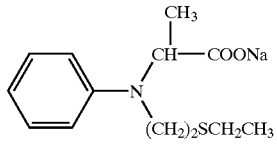
(I-87)
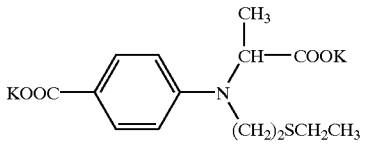
(I-88)
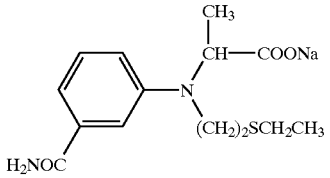
-continued
(I-89)
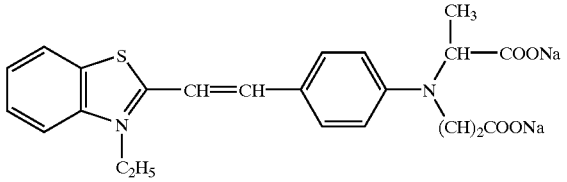
(I-90)
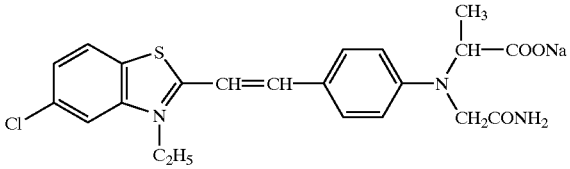
(I-91)
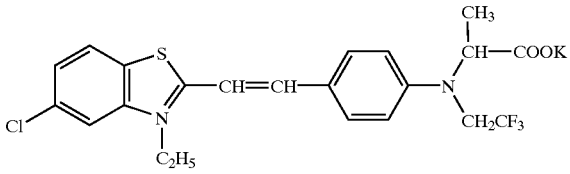
(1-92)
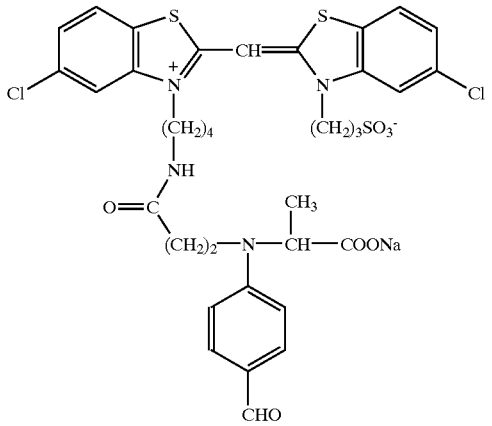
(1-93)
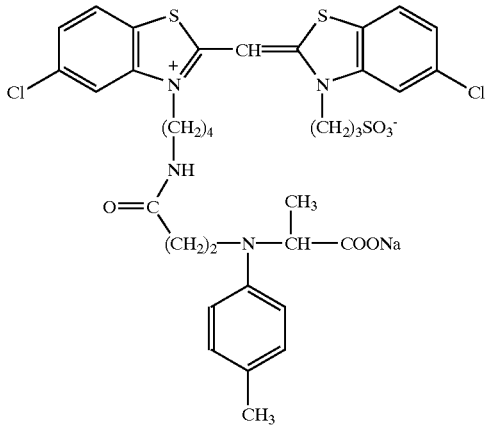

-continued (1-94)

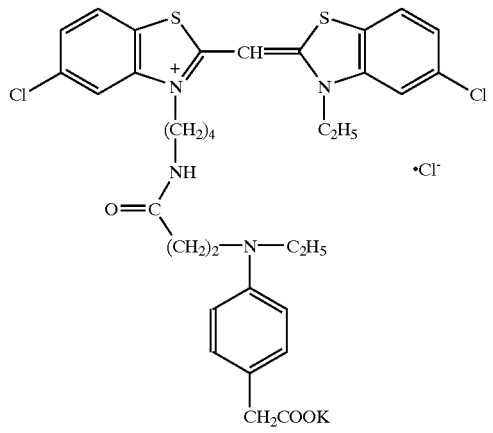

The compounds represented by formula (I) can be easily synthesized according to the methods disclosed in U.S. Pat. No. 5,747,235, EP-A-786692, EP-A-893731, EP-A-893732 and WO 99/05570, and the equivalent methods.

It is preferred that the photographic material of the present invention contains at least one hydrazine derivative represented by the following formula (D) as a nucleating agent:

(D)

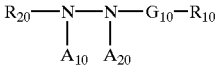

wherein $R_{20}$ represents an aliphatic, an aromatic group or a heterocyclic group; $R_{10}$ represents a hydrogen atom or a block group; $G_{10}$ represents a —CO— group, a —COCO— group, a —C(=S)— group, an —$SO_2$— group, an —SO— group, a —PO($R_{30}$)— group ($R_{30}$ has the same meaning as defined in $R_{10}$ and may be different from $R_{10}$) or an iminomethylene group; and $A_{10}$ and $A_{20}$ each represents a hydrogen atom, or either of them represents a hydrogen atom and the other represents a substituted or unsubstituted alkylsulfonyl group, or a substituted or unsubstituted arylsulfonyl group, or a substituted or unsubstituted acyl group.

The aliphatic group represented by $R_{20}$ in formula (D) is preferably a substituted or unsubstituted, straight chain, branched or cyclic alkyl group having from 1 to 30 carbon atoms, an alkenyl group or an alkynyl group.

The aromatic group represented by $R_{20}$ in formula (D) is a monocyclic or condensed aryl group, e.g., a benzene ring or a naphthalene ring can be exemplified. The heterocyclic group represented by $R_{20}$ is a monocyclic or condensed, saturated or unsaturated, aromatic or non-aromatic heterocyclic group, e.g., a pyridine ring, a pyrimidine ring, an imidazole ring, a pyrazole ring, a quinoline ring, an isoquinoline ring, a benzimidazole ring, a thiazole ring, a benzothiazole ring, a piperidine ring and a triazine ring can be exemplified.

$R_{20}$ is preferably an aryl group, particularly preferably a phenyl group.

The substituents represented by $R_{20}$may be substituted, and the representative substituents include a halogen atom (e.g., fluorine, chlorine, bromine, iodine), an alkyl group (including an aralkyl group, a cycloalkyl group and an active methine group), an alkenyl group, an alkynyl group, an aryl group, a heterocyclic group, a heterocyclic group containing a quaternized nitrogen atom (e.g., pyridinio), an acyl group, an alkoxycarbonyl group, an aryloxycarbonyl group, a carbamoyl group, a carboxyl group or a salt of it, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxyl group, an alkoxyl group (containing a group containing an ethylene oxy group or a propylene oxy group as a repeating unit), an aryloxy group, a heterocyclic oxy group, an acyloxy group, an alkoxycarbonyloxy group, aryloxycarbonyloxy group, a carbamoyloxy group, a sulfonyloxy group, an amino group, an alkylamino group, an arylamino group, a heterocyclic amino group, an N-substituted nitrogen-containing heterocyclic group, an acylamino group, a sulfonamido group, a ureido group, a thioureido group, an isothioureido group, an imido group, an alkoxycarbonylamino group, an aryloxycarbonylamino group, a sulfamoylamino group, a semicarbazido group, a thiosemicarbazido group, a hydrazino group, a quaternary ammonio group, an oxamoylamino group, an alkylsulfonylureido group, an arylsulfonylureido group, an acylureido group, an N-acylsulfamoylamino group, a nitro group, a mercapto group, an alkylthio group, arylthio group, heterocyclic thio group, an alkylsulfonyl group, an arylsulfonyl group, an alkylsulfinyl group, an arylsulfinyl group, a sulfo group or a salt of it, a sulfamoyl group, an N-acylsulfamoyl group, a sulfonylsulfamoyl group or a salt of it, and a group having a phosphoric acid amido or phosphoric ester structure.

These substituents may further be substituted with these substituents.

The preferred substituents which $R_{20}$ may have include a alkyl group having from 1 to 30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, a hydroxyl group, an alkoxyl group, an aryloxy group, an acyloxy group, an acyl group, an alkoxycarbonyl group, an aryloxycarbonyl group, a carbamoyl group, a carboxyl group (including the salt of it), an alkylthio group, an arylthio group, a heterocyclic thio group, a sulfo group (including the salt of it), a sulfamoyl group, a halogen atom, a cyano group and a nitro group.

In formula (D), $R_{10}$ represented a hydrogen atom or a block group. The block group specifically denotes an alkyl group, an alkenyl group, an alkynyl group, an aryl group, a heterocyclic group, an alkoxyl group, an aryloxy group, an amino group and a hydrazino group.

The preferred examples of the alkyl groups represented by $R_{10}$ include alkyl groups having from 1 to 10 carbon atoms (e.g., methyl, trifluoromethyl, difluoromethyl, 2-carboxytetrafluoroethyl, pyridiniomethyl, difluoromethoxymethyl, difluorocarboxymethyl, 3-hydroxypropyl, methanesulfonamidomethyl, benzenesulfonamidomethyl, hydroxymethyl, methoxymethyl, methylthiomethyl, phenylsulfonylmethyl, and o-hydroxybenzyl). The preferred examples of the alkenyl groups represented by $R_{10}$ include alkenyl groups having from 1 to 10 carbon atoms (e.g., vinyl, 2,2-dicyanovinyl, and 2-ethoxycarbonylvinyl, 2-trifluoro-2-methoxycarbonylvinyl). The preferred examples of the alkynyl groups represented by $R_{10}$ include alkynyl groups having from 1 to 10 carbon atoms (e.g., ethynyl and 2-methoxycarbonylethynyl). The preferred examples of the aryl groups represented by $R_{10}$ include monocyclic or condensed ring aryl groups, and aryl groups containing a benzene ring are most preferred (e.g., phenyl, 3,5-dichlorophenyl, 2-methanesulfonamidophenyl, 2-carbamoylphenyl, 4-cyanophenyl and 2-hydroxymethylphenyl).

The preferred examples of the heterocyclic groups represented by $R_{10}$ include 5- or 6-membered, saturated or unsaturated, monocyclic or condensed heterocyclic groups containing at least one nitrogen, oxygen or sulfur atom, which may be heterocyclic groups containing a quaternized nitrogen atom (e.g., morpholino, N-substituted piperidino, piperazino, imidazolyl, indazolyl (e.g., 4-nitroindazolyl), pyrazolyl, triazolyl, benzimidazolyl, tetrazolyl, pyridyl, pyridinio (e.g., N-methyl-3-pyridinio), quinolinio, and quinolyl). Amorpholino group, apiperidino group, apyridyl group and a pyridinio group are particularly preferred.

As the preferred alkoxyl groups represented by $R_{10}$, alkoxyl groups having from 1 to 8 carbon atoms (methoxy, 2-hydroxyethoxy and benzyloxy) can be exemplified. As the preferred aryloxy group, a phenoxy group is preferred. As the amino groups represented by $R_{10}$, an unsubstituted amino group, an alkylamino group having from 1 to 10 carbon atoms, an arylamino group, and a saturated or unsaturated heterocyclic amino group (a nitrogen-containing heterocyclic group containing a quaternized nitrogen atom) are preferred. As the examples of the amino groups, a 2,2,6,6-tetramethyl-piperidin-4-ylamino group, a propylamino group, a 2-hydroxy-ethylamino group, ananilino group, ano-hydroxyanilino group, a 5-benzotriazolylamino group, and an N-benzyl-3-pyridinioamino group can be exemplified. As the hydrazino group, a substituted or unsubstituted hydrazino group, and a substituted or unsubstituted phenylhydrazino group (e.g., 4-benzenesulfonamidophenylhydrazino) are particularly preferred.

The groups represented by $R_{10}$ may be substituted, and groups exemplified as substituents for $R_{20}$ are applied to $R_{10}$ as preferred substituents.

In formula (D), $R_{10}$ may be a group such that the —$G_{10}$—$R_{10}$ moiety is cleaved from the remainder of the molecule and a cyclization reaction occurs to form a ring structure in which the atoms of the —$G_{10}$—$R_{10}$ moiety is contained, and such example is disclosed in JP-A-63-29751.

An adsorptive group which is adsorbed onto silver halide grains may be incorporated in the hydrazine derivative represented by formula (D) The examples of such adsorptive groups include an alkylthio group, an arylthio group, a thiourea group, a thioamido group, a mercapto heterocyclic group, and a triazole group as disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorptive group onto silver halide grains may be precursors and such precursors are disclosed in JP-A-2-285344.

$R_{10}$ or $R_{20}$ in formula (D) may contain a ballast group or a polymer which are normally used in immobile photographic additives such as couplers. The ballast group in the present invention is a straight chain or branched group having 6 or more carbon atoms, such as an alkyl group (or an alkylene group), an alkoxyl group (or an alkyleneoxy group), an alkylamino group (or an alkyleneamino group), an alkylthio group, or a group having any of these groups as a partial structure, more preferably a straight chain or branched group having from 7 to 24 carbon atoms, such as an alkyl group (or an alkylene group), an alkoxyl group (or an alkyleneoxy group) an alkylamino group (or an alkyleneamino group), an alkylthio group, or a group having any of these groups as a partial structure. Further, those disclosed, e.g., in JP-A-1-100530 can be exemplified as such a polymer.

$R_{20}$ or $R_{10}$ in formula (D) may contain a plurality of hydrazino groups as substituents, and the compound represented by formula (D) at this time stands for a polymer (i.e., multimer) of hydrazino groups, specifically the compounds disclosed in JP-A-64-86134, JP-A-4-16938, JP-A-5-197091, WO 95/32452, WO-95/32453, JP-A-9-179229, JP-A-9-235264, JP-A-9-235266, JP-A-9-235267 can be exemplified.

$R_{20}$ or $R_{10}$ in formula (D) may contain a cationic group (specifically, a group containing a quaternary ammonio group, a group containing a quaternized phosphorus atom, or a nitrogen-containing heterocyclic group containing a quaternized nitrogen atom), a group containing a repeating unit of an ethyleneoxy group or a propyleneoxy group, an alkylthio group, an arylthio group or a heterocyclic thio group, or a dissociable group (a group having a proton of low acidity which is dissociable with an alkaline developing solution, or a partial structure, or the salt of it, specifically, e.g., a carboxyl group/a —COOH group, a sulfo group/an —$SO_3H$ group, a phosphonic acid group/a —$PO_3H$ group, a phosphoric acid group/a —$OPO_3H$ group, a hydroxyl group/an —OH group, a mercapto group/an —SH group, an —$SO_2NH_2$ group, an N-substituted sulfonamido group/an —$SO_2NH$— group, a —$CONHSO_2$— group, a —$CONHSO_2NH$— group, an —$NHCONHSO_2$— group, an —$SO_2NHSO_2$— group, a —CONHCO— group, an active methylene group, an —NH— group contained in a nitrogen-containing heterocyclic group, and the salts of them). The examples of the compounds containing these groups are disclosed in JP-A-7-234471, JP-A-5-333466, JP-A-6-19032, JP-A-6-19031, JP-A-5-45761, U.S. Pat. Nos. 4,994,365, 4,988,604, JP-A-7-259240, JP-A-7-5610, JP-A-7-244348, German Patent 4,006,032 and JP-A-11-7093.

In formula (D), $A_{10}$ and $A_{20}$ each represents a hydrogen atom, an alkyl- or arylsulfonyl group having 20 or less carbon atoms (preferably a phenylsulfonyl group or a substituted phenylsulfonyl group having the total of the Hammett's substituent constant of −0.5 or more), or an acyl group having 20 or less carbon atoms (preferably a benzoyl group or a substituted benzoyl group having the total of the Hammett's substituent constant of −0.5 or more, or a straight chain, branched or cyclic, substituted or unsubstituted aliphatic acyl group (substituents include, e.g., a halogen atom, an ether group, a sulfonamido group, a carbonamido group, a hydroxyl group, a carboxyl group, a sulfo group)). $A_{10}$ and $A_{20}$ most preferably represent a hydrogen atom.

The hydrazine derivatives particularly preferably used in the present invention are described below.

$R_{20}$ particularly preferably represents a substituted phenyl group. As the substituents of $R_{20}$, a sulfonamido group, an acylamino group, a ureido group, a carbamoyl group, a thioureido group, an isothioureido group, a sulfamoylamino group, and an N-acylsulfamoylamino group are particularly preferred, and a sulfonamido group and a ureido group are more preferred and a sulfonamido group is most preferred.

The particularly preferred hydrazine derivative represented by formula (D) is a hydrazine derivative in which $R_{20}$ or $R_{10}$ is directly or indirectly substituted with at least one group of a ballast group, an adsorptive group onto the surface of silver halide grains, a group containing a quaternary ammonio group, a nitrogen-containing heterocyclic group containing a quaternized nitrogen atom, a group containing a repeating unit of an ethyleneoxy group, an alkyl-, aryl- or heterocyclic thio group, a dissociable group which is dissociable with an alkaline developing solution, or a hydrazino group capable of forming a polymer (a group represented by —NHNH—$G_{10}$—$R_{10}$), more preferably $R_{20}$ is directly or indirectly substituted with any one of the above groups, and most preferably $R_{20}$ represents a phenyl group substituted with a benzenesulfonamido group, and any one of the above groups is directly or indirectly substituted on the benzene ring of the benzenesulfonamido group.

When $G_{10}$ represents a —CO— group, the preferred groups of the groups represented by $R_{10}$ are a hydrogen atom, an alkyl group, an alkenyl group, an alkynyl group, an aryl group and a heterocyclic group, and a hydrogen atom, an alkyl group, and a substituted aryl group (as the substituent, an electron attractive group or an o-hydroxymethyl group is particularly preferred) are more preferred, and a hydrogen atom and an alkyl group are most preferred.

When $G_{10}$ represents a —COCO— group, $R_{10}$ preferably represents an alkoxyl group, an aryloxy group, or an amino group, in particular a substituted amino group, specifically an alkylamino group, an arylamino group or a saturated or unsaturated heterocyclic amino group.

Further, when $G_{10}$ represents an $—SO_2—$ group, $R_{10}$ preferably represents an alkyl group, an aryl group or a substituted amino group.

$G_{10}$ in formula (D) preferably represents a —CO— group or a —COCO— group, and especially preferably a —CO— group.

The specific examples of the compounds represented by formula (D) are shown below, but the present invention is not limited thereto.

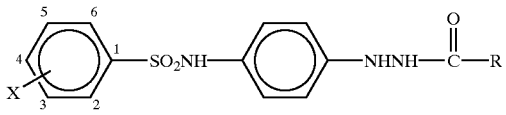

| | X = | R = —H | —$C_2F_4$—COOH (or —$C_2F_4$—$COO^{\ominus}K^{\oplus}$) | 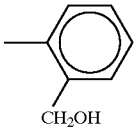 | 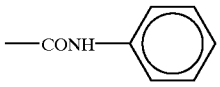 |
|---|---|---|---|---|---|
| D-1 | 3-$NHCOC_9H_{19}$(n) | 1a | 1b | 1c | 1d |
| D-2 | 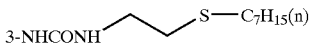 | 2a | 2b | 2c | 2d |
| D-3 | 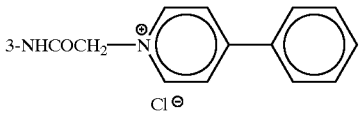 | 3a | 3b | 3c | 3d |
| D-4 | 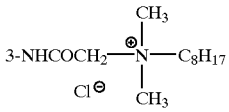 | 4a | 4b | 4c | 4d |
| D-5 | 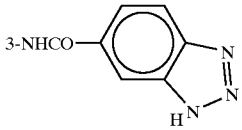 | 5a | 5b | 5c | 5d |
| D-6 | 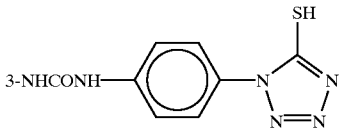 | 6a | 6b | 6c | 6d |
| D-7 | 2,4-$(CH_3)_2$-3-$SC_2H_4$-$(OC_2H_4)_4$—$OC_8H_{17}$ | 7a | 7b | 7c | 7d |

-continued
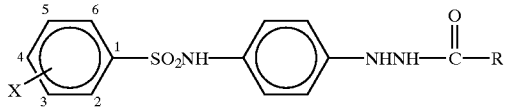
| | X = | R = —H | —$CF_2H$ | —$CH_2$—N⊕(Cl⊖) | —CONH— NH |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |
| D-10 | 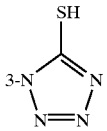 | 10a | 10e | 10f | 10g |
| D-11 | 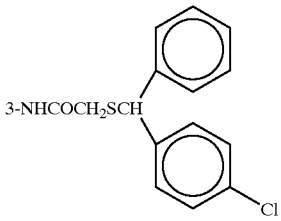 | 11a | 11e | 11f | 11g |
| D-12 | 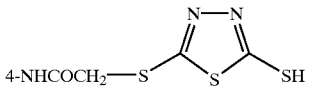 | 12a | 12e | 12f | 12g |
| D-13 | 3-$NHCOCH(CH_2COOH)C_8H_{17}$ | 13a | 13e | 13f | 13g |
| D-14 | 3,5-$(CONHCH_2CH(C_2H_5)C_4H_9)_2$ | 14a | 14e | 14f | 14g |
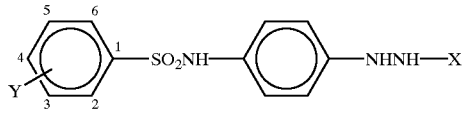
| | Y = | X = —CHO | —$COCF_3$ | —$SO_2CH_3$ | —P(=O)$(OC_2H_5)_2$ |
|---|---|---|---|---|---|
| D-15 | 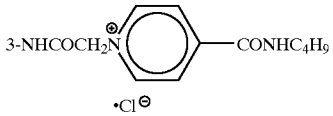 | 15a | 15h | 15i | 15j |

-continued

| | | | | | |
|---|---|---|---|---|---|
| D-16 | 4-NHCO(CH$_2$)$_2$N$^{\oplus}$—C$_6$H$_{13}$ Cl$^{\ominus}$ | 16a | 16h | 16i | 16j |
| D-17 | 3-SO$_2$NH—(CH$_2$)$_3$—O—(CH$_2$)$_3$—OC$_4$H$_9$ | 17a | 17h | 17i | 17j |
| D-18 | 3,4-(COOCH(CH$_3$)COOC$_4$H$_9$)$_2$ | 18a | 18h | 18i | 18j |
| D-19 | 3-NHCO—(CH$_2$)$_4$—(1,2-dithiolane) | 19a | 19h | 19i | 19j |
| D-20 | 3-NHSO$_2$NH—C$_8$H$_{17}$ | 20a | 20h | 20i | 20j |
| D-21 | 2-Cl-5—(1,3,4-thiadiazol-2-SH) | 21a | 21h | 21i | 21j |

| | | R = | | | |
|---|---|---|---|---|---|
| | | —H | —CF$_2$H | —CH$_2$—(2,4-Cl$_2$-6-OH-C$_6$H$_2$) | —CONHC$_3$H$_7$ |
| D-22 | (benzotriazol-5-yl)—SO$_2$NH—C$_6$H$_4$—NHNH—C(=O)—R | 22a | 22e | 22k | 22l |
| D-23 | C$_4$H$_9$CH(C$_2$H$_5$)CH$_2$NHCONH—(2,4-OH-C$_6$H$_2$)—S—(tetrazol-1-yl)—C$_6$H$_4$—SO$_2$NH—C$_6$H$_4$—NHNH—C(=O)—R | 23a | 23e | 23k | 23l |
| D-24 | (1,3-CH$_3$-2,4-O-6-Cl-pyrimidinyl)—S—(tetrazol-1-yl)—C$_6$H$_4$—SO$_2$NH—C$_6$H$_4$—NHNH—C(=O)—R | 24a | 24e | 24k | 24l |

-continued
| | | | | | |
|---|---|---|---|---|---|
| D-25 | 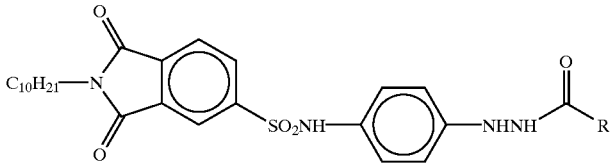 | 25a | 25e | 25k | 25l |
| D-26 | 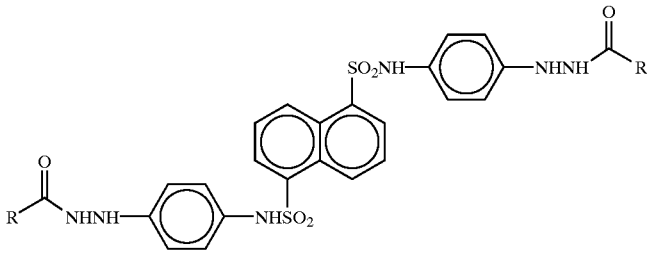 | 26a | 26e | 26k | 26l |
| D-27 | 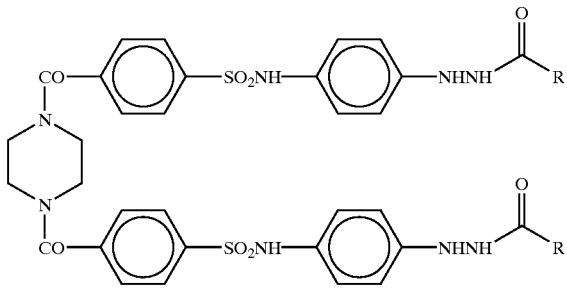 | 27a | 27e | 27k | 27l |
| D-28 | 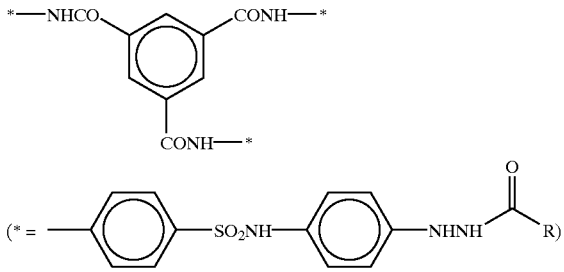 | 28a | 28e | 28k | 28l |
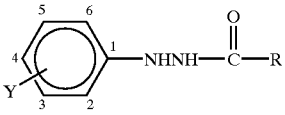
| | R = | | | |
|---|---|---|---|---|
| Y = | —H | —$CH_2OCH_3$ | 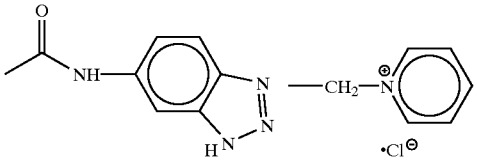 | |
| D-29 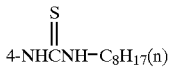 | 29a | 29m | 29n | 29f |
| D-30 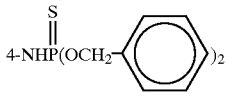 | 30a | 30m | 30n | 30f |

-continued
| | | | | | |
|---|---|---|---|---|---|
| D-31 | 4-NHCONH—$(CH_2)_9O$— 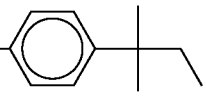 | 31a | 31m | 31n | 31f |
| D-32 | 4-OH<br>3-$NHCONHCH_2CH(C_2H_5)C_4H_9$ | 32a | 32m | 32n | 32f |
| D-33 | 4-$NHSO_2(CH_2)_2NHCO$— 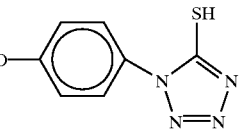 | 33a | 33m | 33n | 33f |
| D-34 | 4-$OCH_2$— 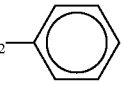 | 34a | 34m | 34n | 34f |
| D-35 | 4-NHCONHN—$(CH_2$— 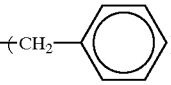 $)_2$ | 35a | 35m | 35n | 35f |
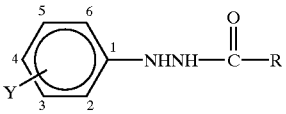
| | Y = | R = —H | —$C_3F_6$—COOH | —$CONHCH_3$ | 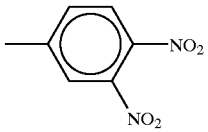 |
|---|---|---|---|---|---|
| D-36 | 2-$NHSO_2CH_3$—<br>4-$NHCONH(CH_2)_9S$— 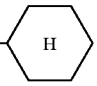 | 36a | 36o | 36p | 36q |
| D-37 | 2-$OCH_3$—<br>4-$NHSO_2C_{12}H_{25}$ | 37a | 37o | 37p | 37q |
| D-38 | 3-$NHCOC_{11}H_{23}$—<br>4-$NHSO_2CF_3$ | 38a | 38o | 38p | 38q |
| D-39 | 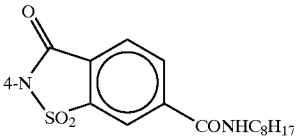 | 39a | 39o | 39p | 39q |
| D-40 | 4-$OCO(CH_2)_2COOC_6H_{13}$ | 40a | 40o | 40p | 40q |
| D-41 | 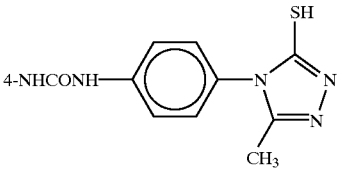 | 41a | 41o | 41p | 41q |
| D-42 | 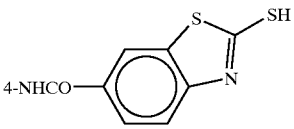 | 42a | 42o | 42p | 42q |

-continued
D-43
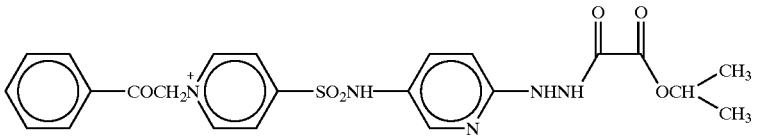
D-44
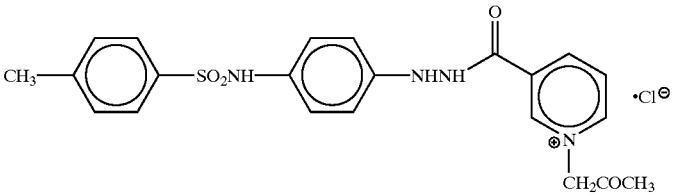
D-45
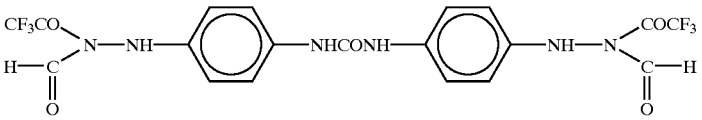
D-46
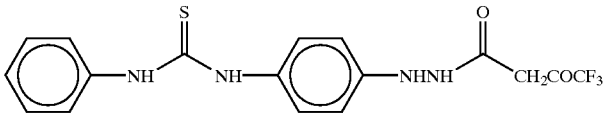
D-47
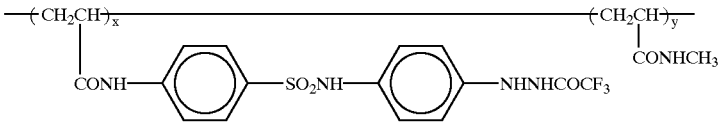
x/y = 3/97 mol. wt. = about 100,000
D-48
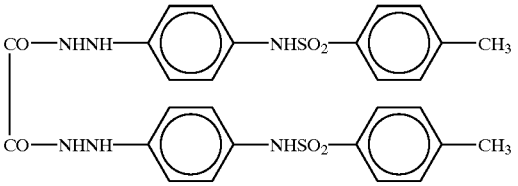
D-49
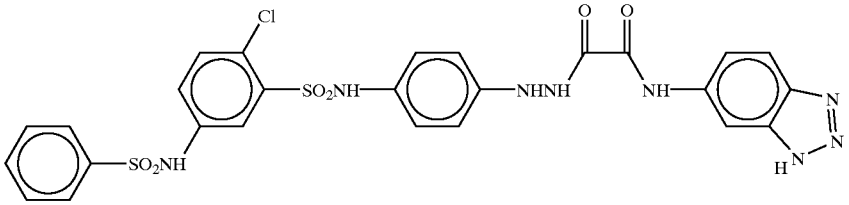
No.
D-50
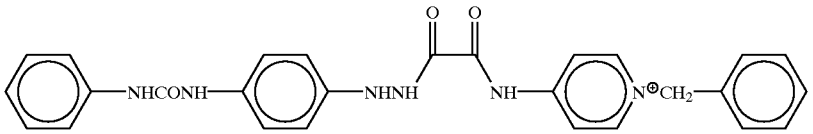
D-51
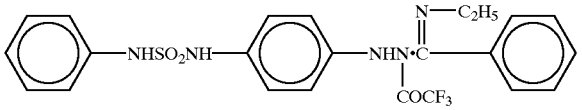

-continued
D-52
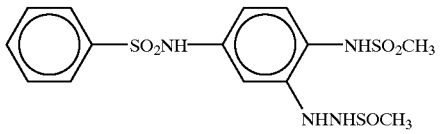
D-53
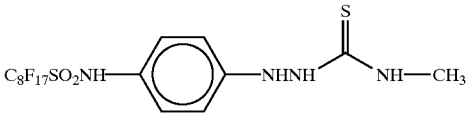
D-54
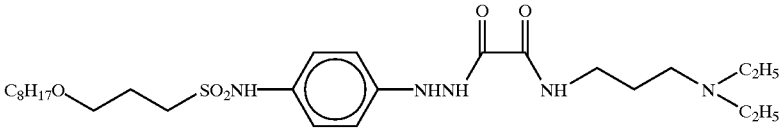
D-55
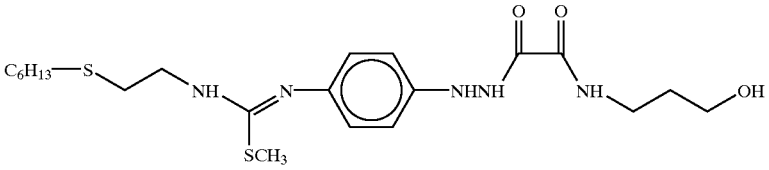
D-56
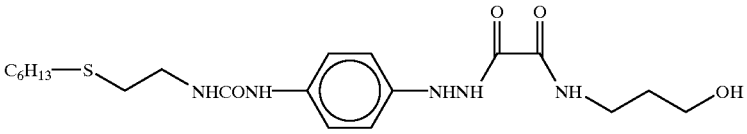
D-57
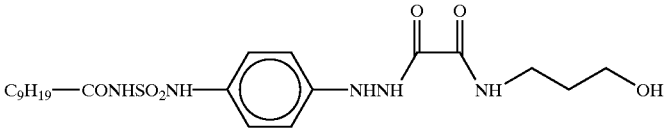
D-58
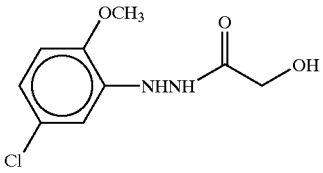
D-59
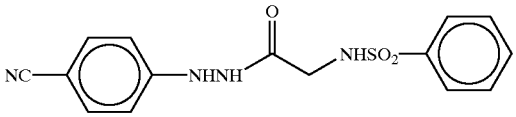
D-60
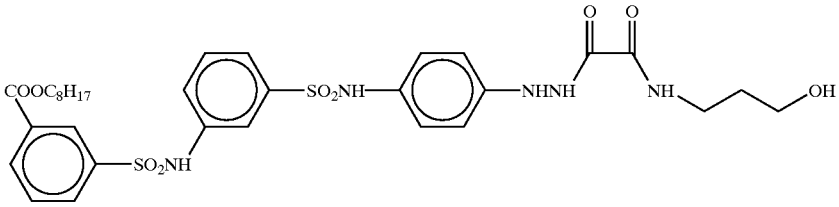
D-61
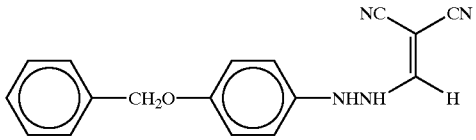

-continued

D-62

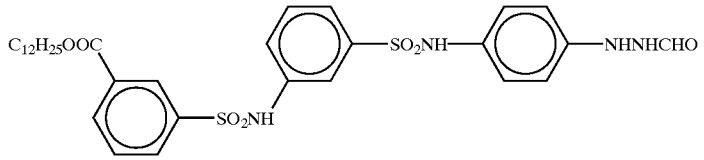

D-63

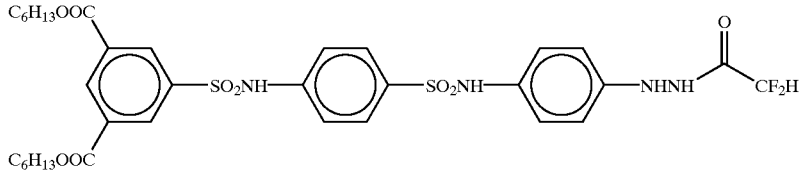

D-64

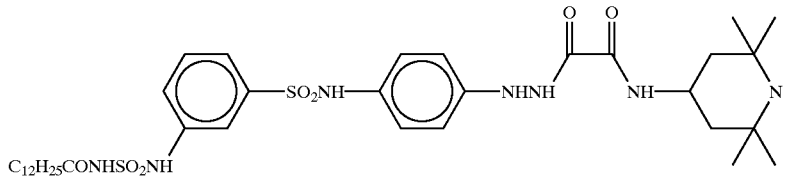

D-65

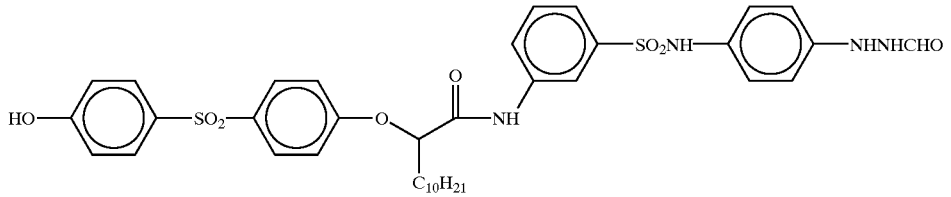

D-66

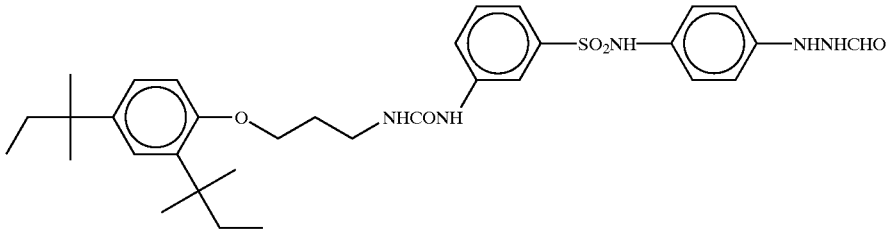

D-67

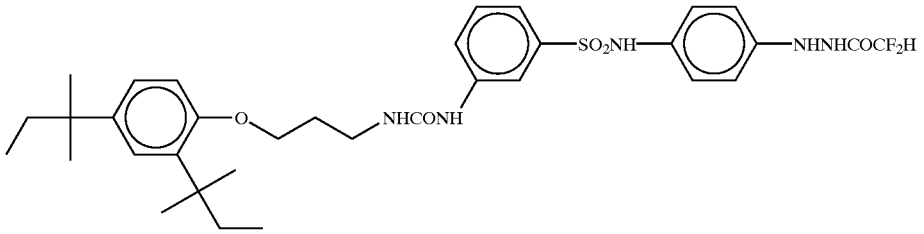

Besides the above-shown hydrazine derivatives, the hydrazine derivatives shown below can also preferably be used in the present invention. Further, the hydrazine derivatives for use in the present invention can be synthesized according to various methods disclosed in the following patents.

The following compounds can be preferably used in the present invention, e.g. , the compounds disclosed on pages 3 and 4 in JP-B-6-77138 (the term "JP-B" as used herein means an "examined Japanese patent publication"); the compound represented by formula (I), specifically Compounds 1 to 38 disclosed on pages 8 to 18 in JP-B-6-93082;

the compounds represented by formulae (4), (5) and (6), specifically Compounds 4-1 to 4-10 disclosed on pages 25 and 26, Compounds 5-1 to 5-42 on pages 28 to 36, and Compounds 6-1 to 6-7 on pages 39 and 40 in JP-A-6-230497; the compounds represented by formula (1) and (2), specifically Compounds 1-1) to 1-17) and 2-1) disclosed on pages 5 to 7 in JP-A-6-289520; the compounds disclosed on pages 6 to 19 in JP-A-6-313936; the compounds disclosed on pages 3 to 5 in JP-A-6-313951; the compound represented by formula (I), specifically Compounds I-1 to I-38 disclosed on pages 5 to 10 in JP-A-7-5610; the compound represented by formula (II), specifically Compounds II-1 to II-102 disclosed on pages 10 to 27 in JP-A-7-77783; the compounds represented by formulae (H) and (Ha), specifically Compounds H-1 to H-44 disclosed on pages 8 to 15 in JP-A-7-104426; the compounds having an anionic group in the vicinity of a hydrazine group, or a nonionic group forming an intramolecular hydrogen bond with the hydrogen atom of the hydrazine represented by formulae (A), (B), (C), (D), (E) and (F), specifically Compounds N-1 to N-30 disclosed in JP-A-9-22082; the compound represented by formula (1), specifically Compounds D-1 to D-55 disclosed in JP-A-9-22082; in addition to the above compounds, the hydrazine derivatives disclosed in the following patents are also preferably used in the present invention, e.g., WO 95-32452, WO 95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044; JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381, and JP-A-10-175946.

The hydrazine compound for use in the present invention which is a dimer comprising monomers containing both an acylhydrazide moiety and a nicotinamide moiety linked by a linking group is described below. The hydrazine compound is used as a nucleating agent (a contrast-increasing agent), and specifically represented by the following formula (1) or (2):

(1)

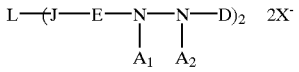

(2)

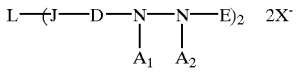

wherein each monomer linked by linking group L may be the same or different; J represents a nicotinamide residue; E represents a substituted aryl group or a heterocyclic ring; one of $A_1$ and $A_2$ represents a hydrogen atom and the other represents a hydrogen atom, an acyl group or an alkyl- or aryl-sulfonyl group, any of which may be substituted; D represents a blocking group; L represents a divalent linking group; and $X^-$ represents an anionic counter ion.

The hydrazine compound is more preferably represented by the following formula (3), (4) or (5), most preferably represented by formula (3).

(3)

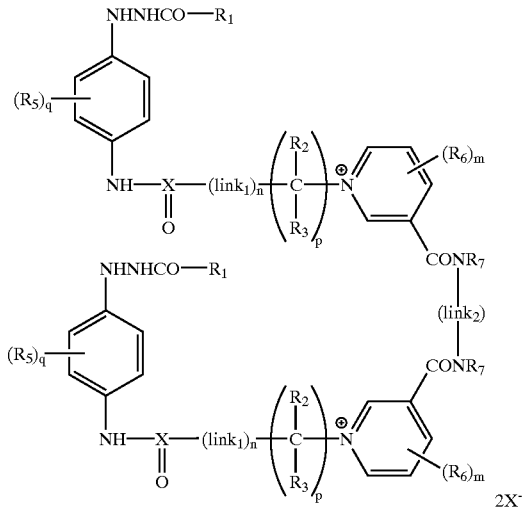

(4)

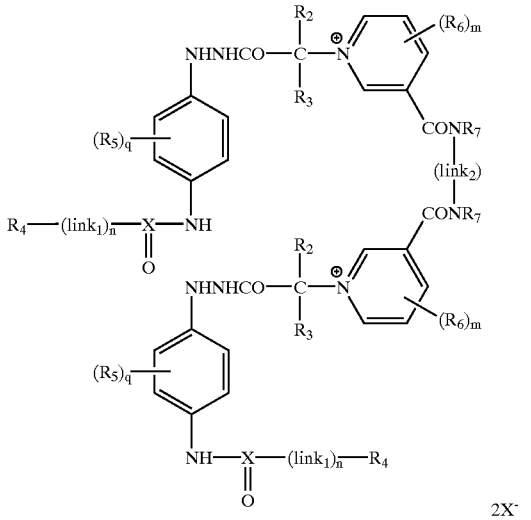

(5)

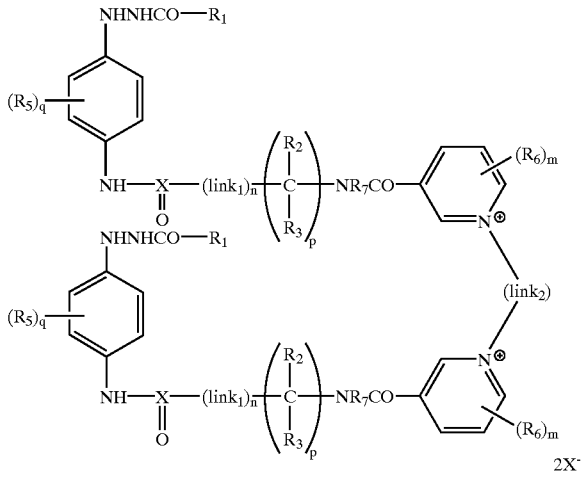

In these compounds, each $R_1CO$ comprises a blocking group and in particular each $R_1$ may be the same or different, and is selected from a hydrogen atom, and a substituted or unsubstituted alkyl, aryl, alkoxy- or aryloxy-carbonyl, and alkyl- or aryl-aminocarbonyl group, or each $R_1$ is a substituted or unsubstituted heterocyclic ring having a 5- or 6-membered ring containing at least one nitrogen, oxygen or sulfur atom, or each $R_1$ contains the heterocyclic ring, wherein the ring may be linked either directly to the carbonyl group or via an alkyl, alkoxyl, carbonyl, aminocarbonyl or alkylaminocarbonyl group, wherein the ring may be condensed to a benzene ring; each $R_2$, $R_3$ and $R_7$ may be the same or different, and selected from hydrogen and a substituted or unsubstituted alkyl or aryl group, and p is 0 or 1; each $R_4$, $R_5$ and $R_6$ are the same or different, and may be selected individually or together from hydrogen, halogen, hydroxyl, cyano, and a substituted or unsubstituted alkyl, aryl, heterocyclic, alkoxyl, acyloxy, aryloxy, carbonamido, sulfonamido, ureido, thioureido, semicarbazido, thiosemicarbazido, urethane, tertiary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium atom or tellurium atom, and a group having a tertiary sulfonium structure; each q and m may be the same or different, and q represents an integer of from 0 to 4, and m represents an integer of from 0 to 3; each X may be the same or different, and is selected from C, S═O and C—NH; each ($link_1$) may be the same or different, and is selected from a substituted or unsubstituted alkylene, polyalkylene, aryl, or arylaminocarbonyl group and a heterocyclic group; each n represents 0 or 1; each ($link_2$) is a linking group selected from a substituted or unsubstituted polyalkylene, polyalkylene oxide, polyalkylene containing one or more hetero atoms selected from nitrogen, oxygen and sulfur separated from each other by alkylene groups, and a substituted or unsubstituted polyalkylene in which the alkylene groups are separated by a substituted or unsubstituted aryl or heterocyclic ring; and $X^-$ represents an anionic counter ion.

The term "alkyl" used in the specification refers to a substituted or unsubstituted straight or branched chain alkyl group (including alkenyl) having from 1 to 20 carbon atoms and includes cycloalkyl having from 3 to 8 carbon atoms. The term "aryl" includes aralkyl (and includes specific condensed aryl) within the scope. The term "heterocyclic ring" specifically includes condensed heterocyclic ring within the scope. The term "polyalkylene" is defined as the group $(CH_2)_n$ (wherein n represents an integer of from 2 to 50). The term "blocking group" refers to a group suitable for protecting the (hydrazine) group but which can be easily released when necessary.

$R_1$ represents a hydrogen atom; or a group selected from a substituted or unsubstituted alkyl (e.g., methyl, trifluoromethyl, 1,3-methylsulfonamidopropyl, methylsulfonylmethyl, phenylsulfonylmethyl, carboxytetrafluoroethyl), a substituted or unsubstituted aryl (e.g., phenyl, 3,5-dichlorophenyl, o-methanesulfonamidophenyl, 4-methanesulfonylphenyl, 2-(2'-hydroxyethyl)phenyl, 2-hydroxy-4-methylphenyl, o-hydroxybenzyl), a carbonyl-containing group (e.g., alkylaminocarbonyl, alkoxycarbonyl, aryloxycarbonyl, hydroxyalkylaminocarbonyl); or contains an imidazolyl, pyrazolyl, triazolyl, tetrazolyl, pyridyl, pyridinium, piperidinyl, morpholino, quinolinium or quinolinyl group; or $R_1$ may contain a group which splits off a photographically useful fragment, e.g., a phenylmercaptotetrazole or 5- or 6-nitroindazole group. The examples of some of these compounds are disclosed in U.S. Pat. No. 5,328,801. $R_2$ and $R_3$ preferably represent a hydrogen atom or an alkyl group with p being preferably 1; $R_4$, $R_5$ and R 6 preferably represent a hydrogen atom, or an alkyl or alkoxyl group with q being preferably 0 or 1 and m being preferably 0; $R_7$ preferably represents hydrogen, or an alkyl group arbitrarily substituted with, e.g., a dialkylamino group.

When X represents S═O, it is preferred n represents 1 and that ($link_1$) comprises an arylamino group or an arylaminocarbonyl group, preferably a phenylaminocarbonyl group, which may be substituted in the ring, e.g., with one or more alkyl, carbonyl groups or halogen atoms. When X represents C or C—NH, it is preferred that n represents 0 such that no ($link_1$) group is present.

($link_2$) group preferably comprises a polyalkylene group containing alkylene groups, preferably generally 4 or 6 methylene groups (which may be separated by one or more O or S atoms). For example, ($link_2$) may be $(CH_2)_4$, $(CH_2)_6$, $(CH_2)_2S(CH_2)_2$ or $(CH_2)_2O(CH_2)_2O(CH_2)_2$. Alternatively, ($link_2$) may be a polyalkylene oxide chain extending from an even number of methylene groups such as $(CH_2CH_2O)_{14}CH_2CH_2$ or may contain, e.g. , a $CH_2C_6H_4CH_2$ group.

The anionic counter ion may be selected from those well-known in the art, and may generally be selected from $Cl^-$, $Br^-$, $I^-$, $CF_3COO^-$, $CH_3SO_3^-$ and $TsO^-$.

Unless otherwise indicated, the substituents which are usable on the molecules in the specification of the present invention include any groups, whether substituted or unsubstituted, so long as they do not hinder the characteristics necessary for photographic utility. The substituents include the form further substituted with any group or groups as mentioned in the specification.

Preferably, the substituent may be halogen, or may be bonded to the remainder of the molecule via an atom of carbon, silicon, oxygen, nitrogen, phosphorus or sulfur. The substituent maybe, e.g., halogen (e.g., chlorine, bromine or fluorine), nitro, hydroxyl, cyano, carboxyl, or groups which may be further substituted, e.g., alkyl including straight or branched chain alkyl (e.g., methyl, trifluoromethyl, ethyl, t-butyl, 3-(2,4-di-t-pentylphenoxy)propyl and tetradecyl), alkenyl (e.g., ethylene, 2-butene), alkoxyl (e.g., methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy), aryl (e.g., phenyl, 4-t-butylphenyl, 2,4,6-trimethylphenyl, naphthyl), aryloxy (e.g., phenoxy, 2-methylphenoxy, α- or β-naphthyloxy, and 4-tolyloxy), carbonamido (e.g., acetamido, benzamido, butyramido, tetradecanamido, α-(2,4-di-t-pentylphenoxy)acetamido, α-(2,4-di-t-pentylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5-tetradecylpyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido), sulfonamido (e.g., methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido), sulfamoyl (e.g., N-methylsulfamoyl, N-ethylsulfamoyl, N,N-dipropylsulfamoyl, N-hexadecylsulfamoyl, N,N-dimethylsulfamoyl, N-[3-(dodecyloxy)propyl]sulfamoyl, N-[4-(2,4-di-t-pentylphenoxybutyl]sulfamoyl, N-methyl-N-tetradecylsulfamoyl, and N-dodecylsulfamoyl), carbamoyl (e.g., N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl), acyl (e.g., acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl), sulfonyl (e.g., methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl), sulfonyloxy (e.g., dodecylsulfonyloxy and hexadecylsulfonyloxy), sulfinyl (e.g., methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl), thio (e.g., ethylthio, octylthio, benzylthio, tetradecylthio, 2-(2,4-di-t-pentylphenoxy) ethylthio, phenylthio, 2-butoxy-5-t-octylphenylthio, and p-tolylthio), acyloxy (e.g., acetyloxy, benzoyloxy, octadecanoyloxy, p-dodecylamidobenzoyloxy, N-phenylcarbamoyloxy, N-ethylcarbamoyloxy, and cyclohexylcarbonyloxy), amine (e.g., phenylanilino, 2-chloroanilino, diethylamine, and dodecylamine), imido (e.g., 1-(N-phenylimido)ethyl, N-succinimido or 3-benzylhydantoinyl), phosphate (e.g., dimethylphosphate and ethylbutylphosphate), phosphite (e.g., diethylphosphite and dihexylphosphite), a heterocyclic group, a heterocyclic oxy group, or a heterocyclic thio group (each of which may be substituted, may contain a 3- to 7-membered heterocyclic ring composed of carbon atoms and at least one hetero atom selected from the group consisting of oxygen, nitrogen and sulfur) (e.g., 2-furyl, 2-thienyl, 2-benzimidazolyloxy, or 2-benzothiazolyl), quaternary ammonium (e.g., triethylammonium), and silyloxy (e.g., trimethylsilyloxy). If desired, these substituents themselves maybe further substituted with the above-described substituents one or more times. The particular substituents used may be selected by those skilled in the art so as to attain the desired photographic properties for a specific application and can include, e.g., hydrophobic groups, solubilizing groups, blocking groups, releasing or releasable groups and groups which adsorb onto silver halide. Generally, the above groups and the substituents of them may include those having up to 48 carbon atoms, typically from 1 to 36 carbon atoms, usually less than 24 carbon atoms, but greater numbers can be used depending upon the particular substituents selected.

The specific examples of the nucleating agents according to the present invention are shown below but the present invention is not limited thereto.

(H-1)

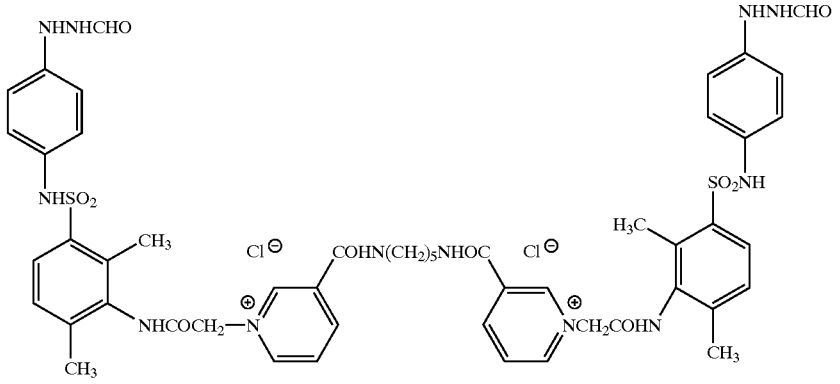

(H-2)

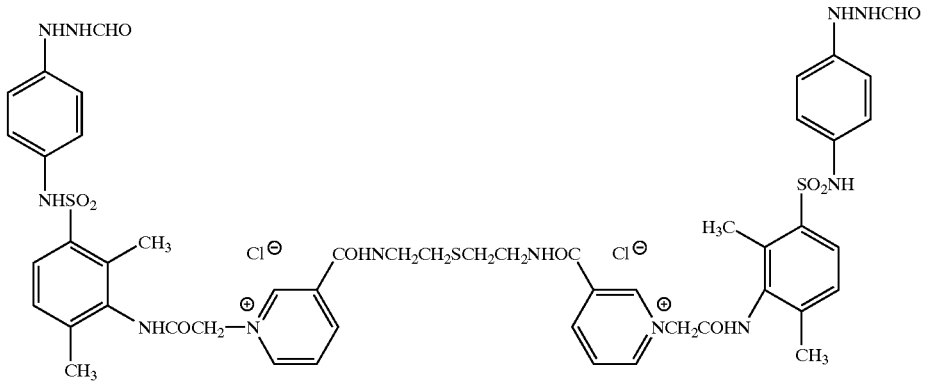

-continued
(H-3)
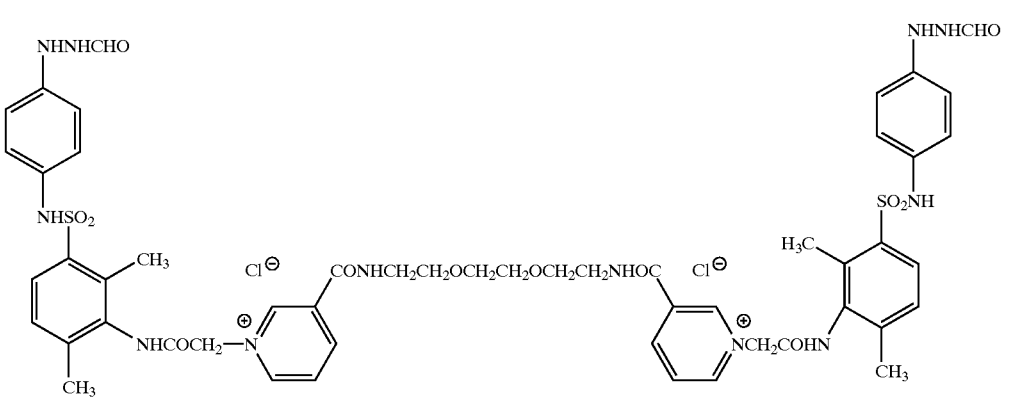
(H-4)
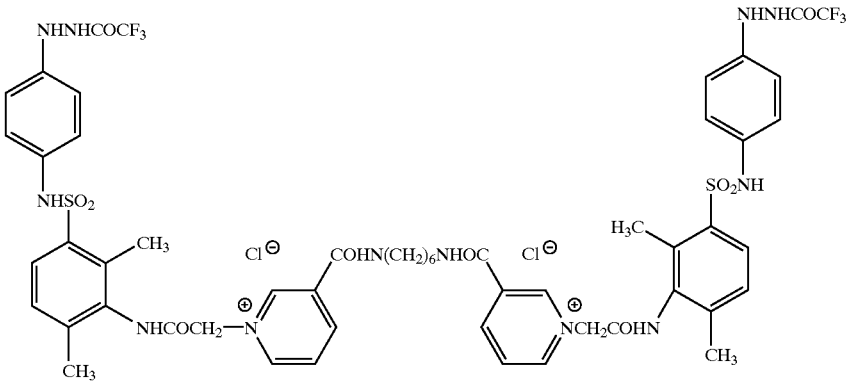
(H-5)
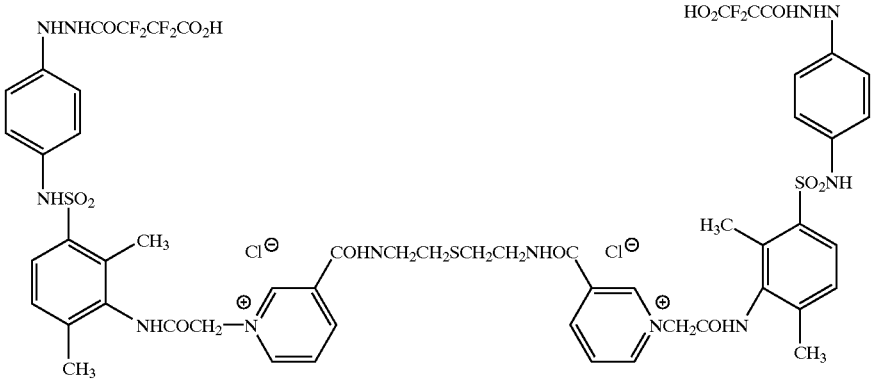
(H-6)
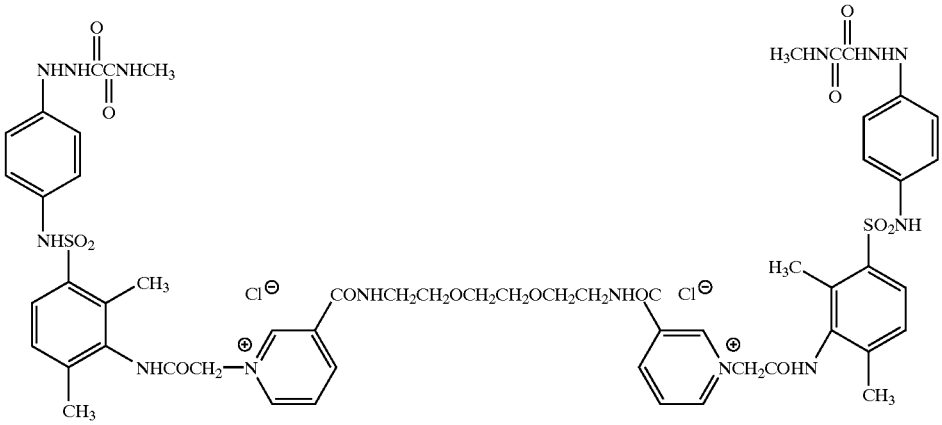

-continued
(H-7)
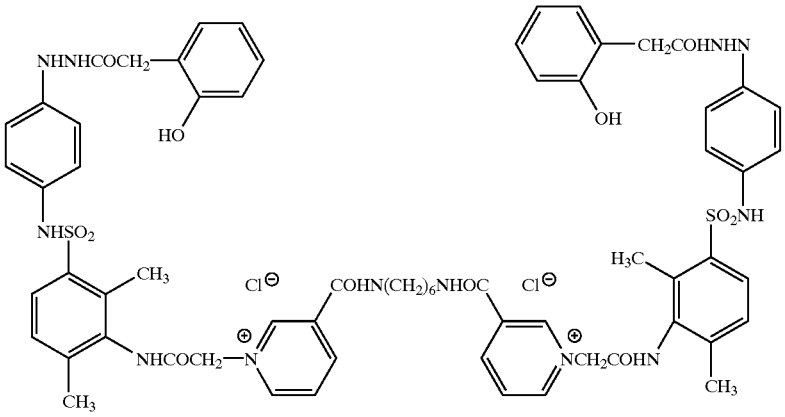
(H-8)
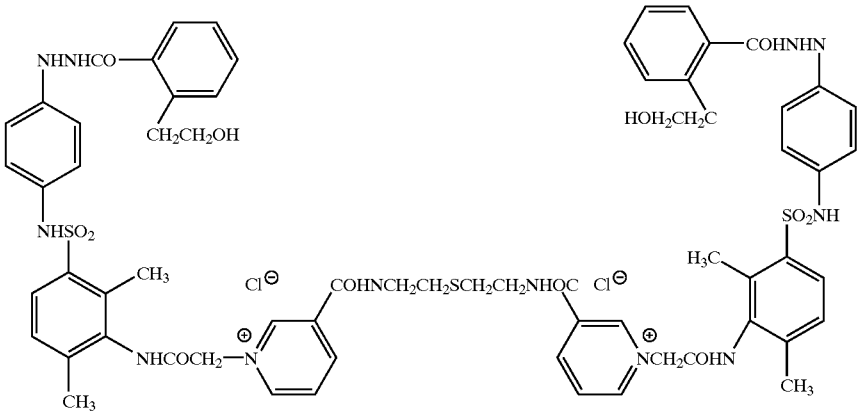
(H-9)
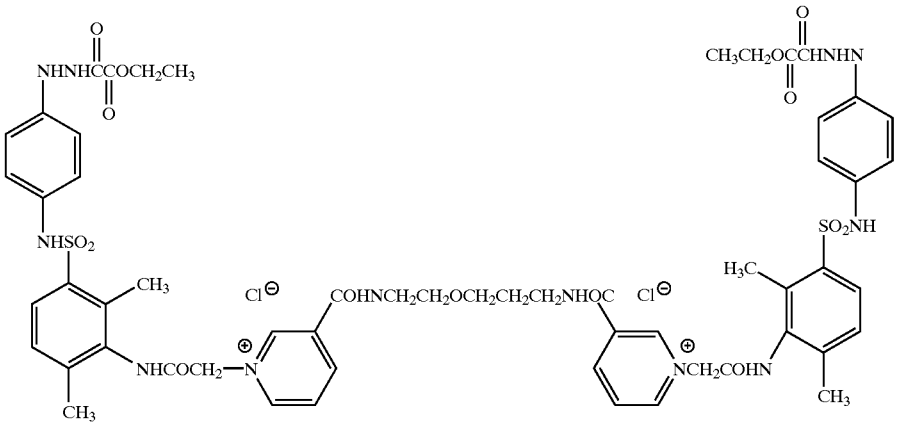
(H-10)
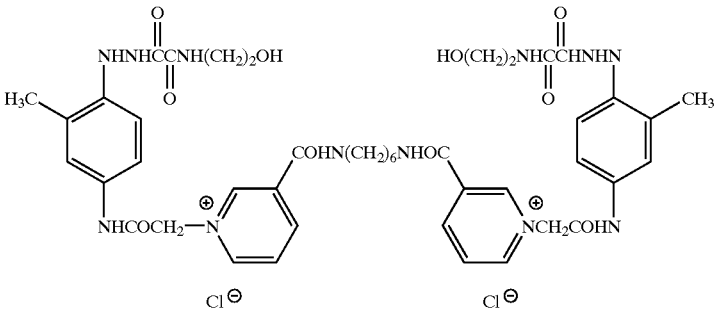

-continued
(H-11)
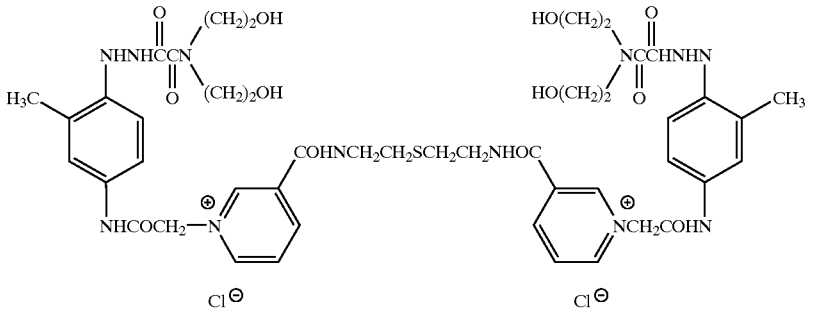
(H-12)
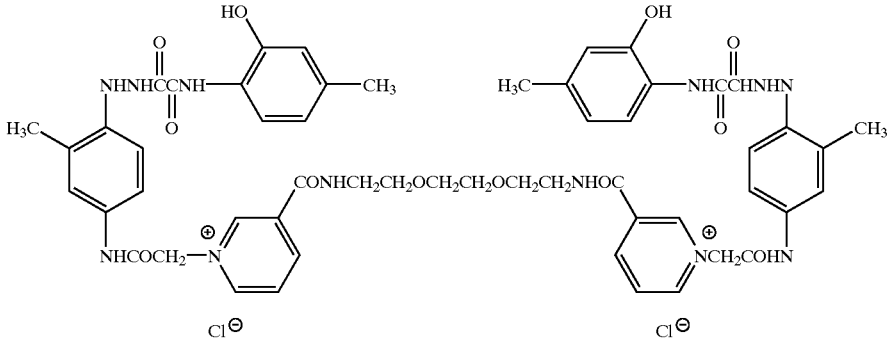
(H-13)
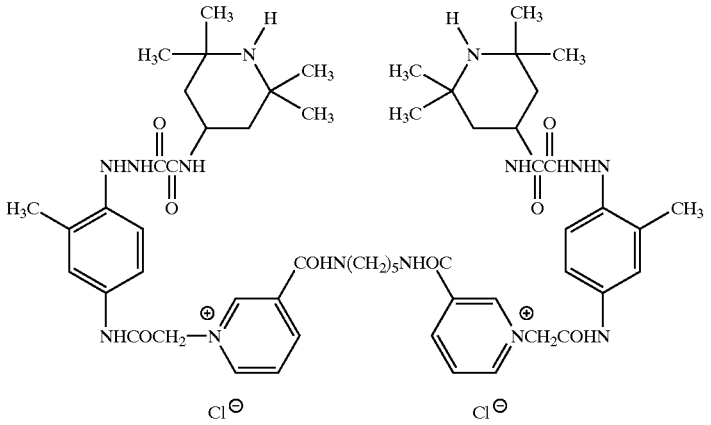
(H-14)
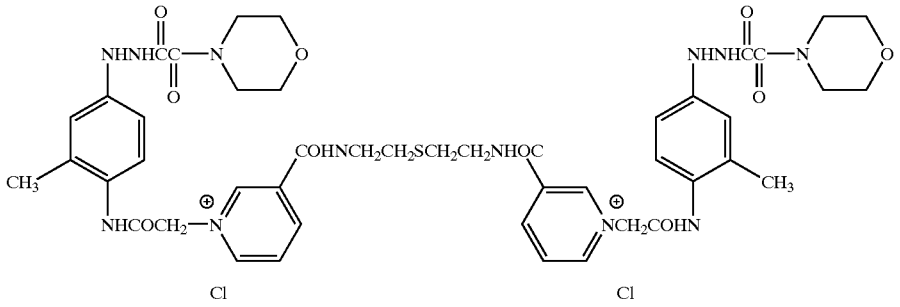

-continued
(H-15)
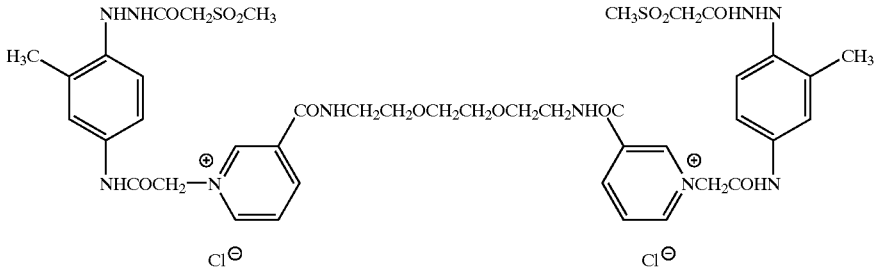
(H-16)
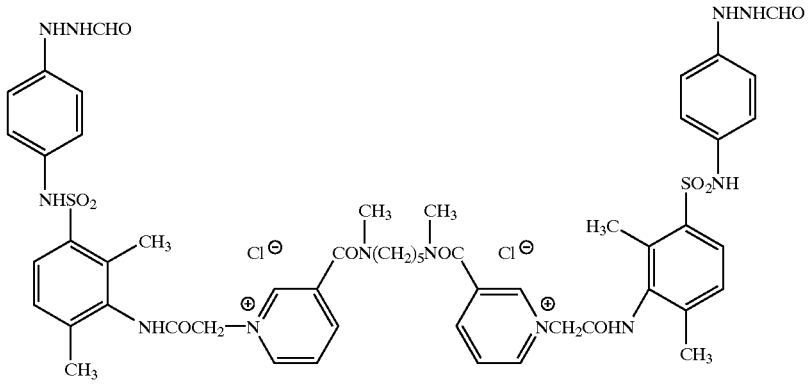
(H-17)
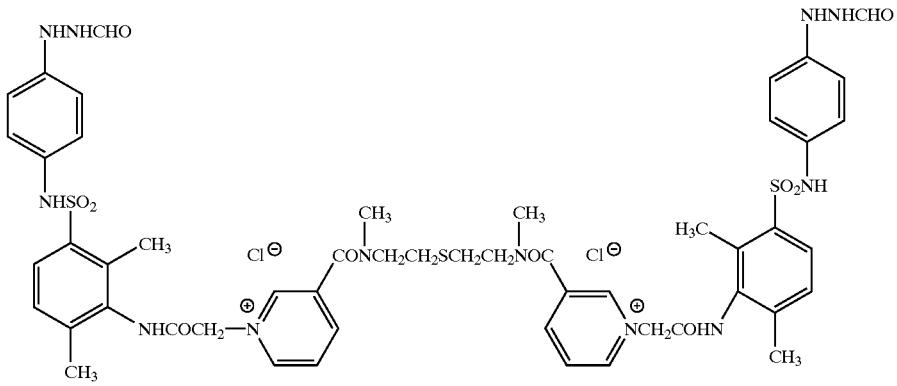
(H-18)
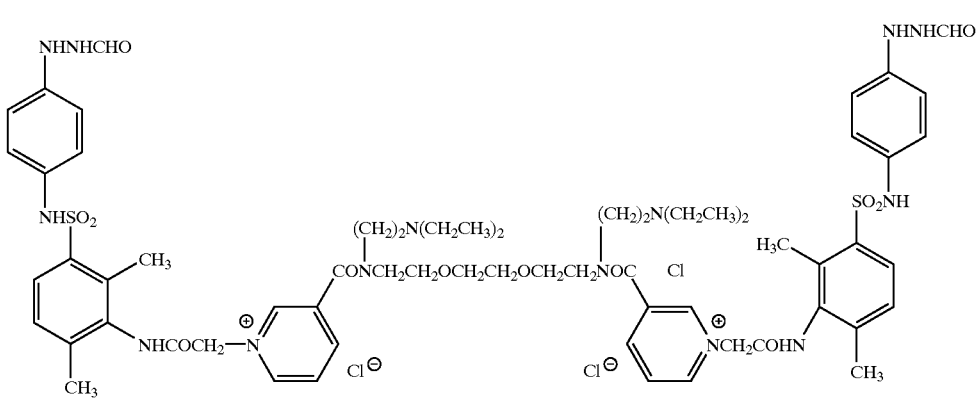

-continued
(H-19)
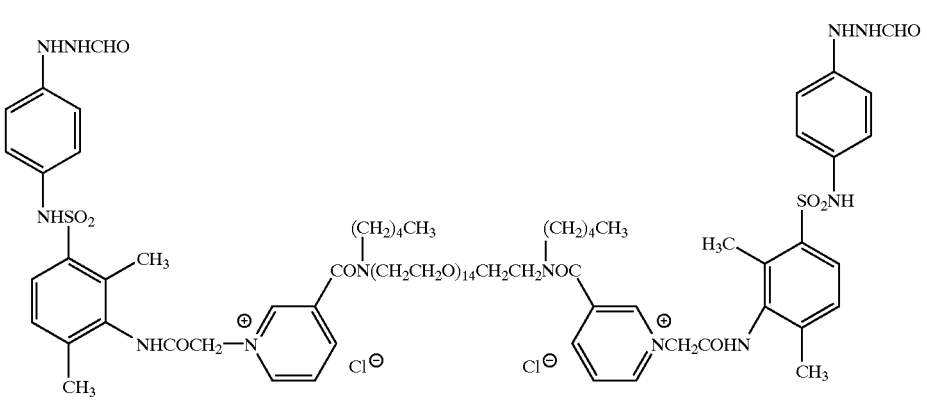
(H-20)
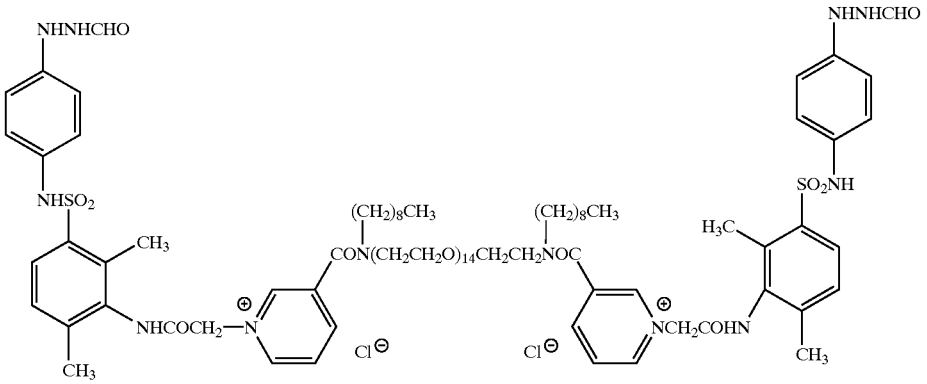
(H-21)
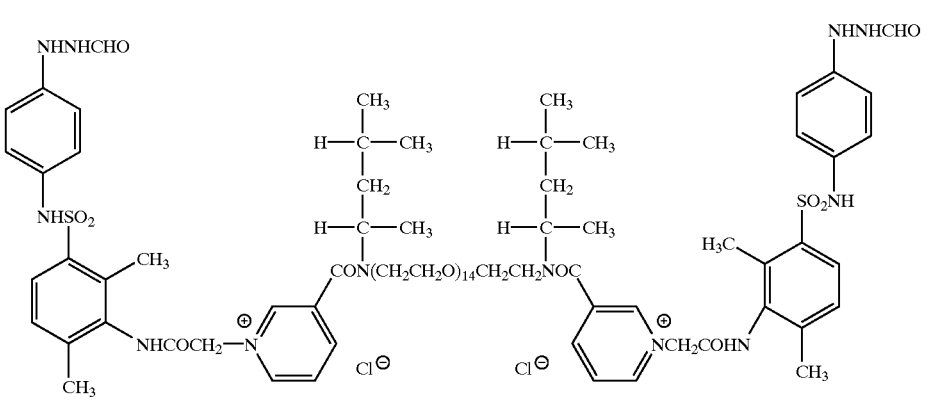
(H-22)
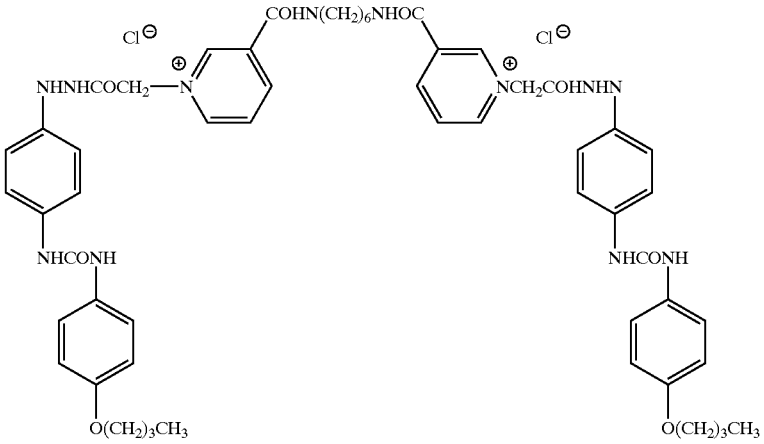

-continued
(H-23)
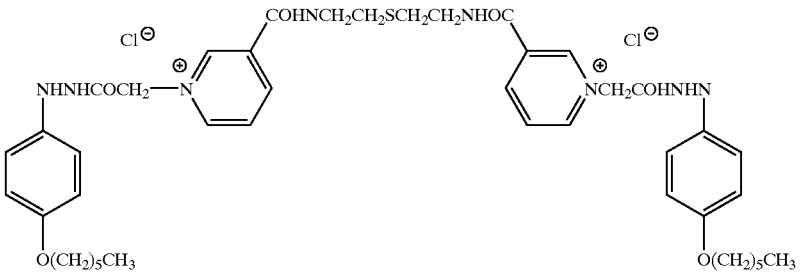
(H-24)
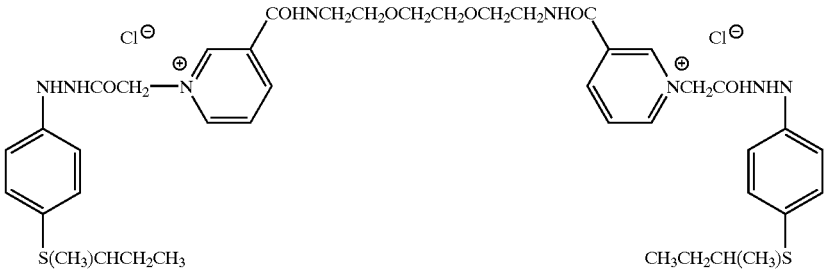
(H-25)
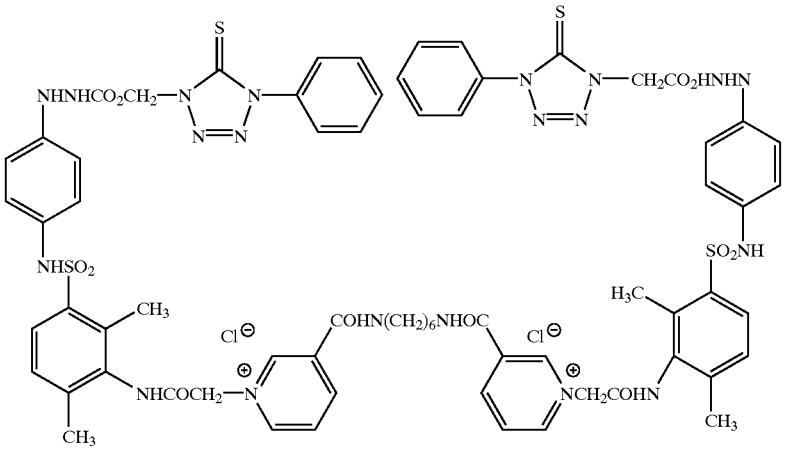
(H-26)
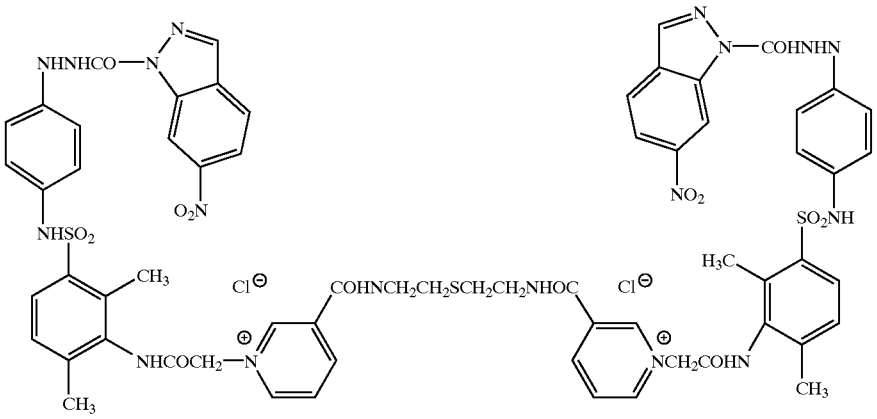

-continued
(H-27)
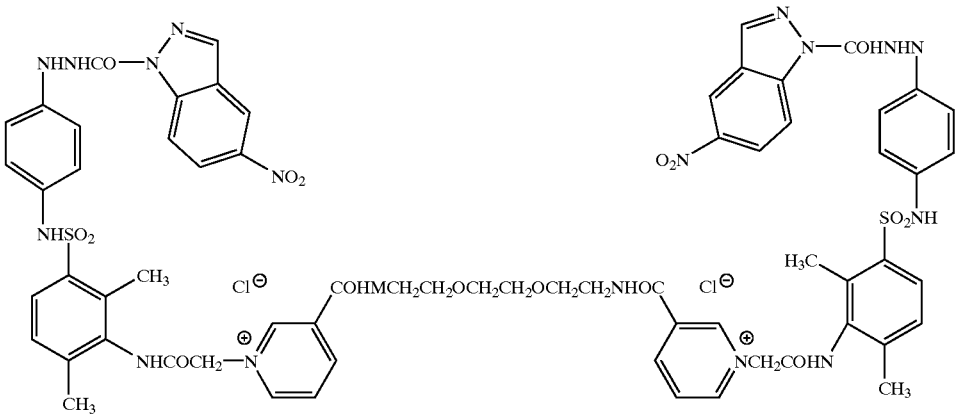
(H-28)
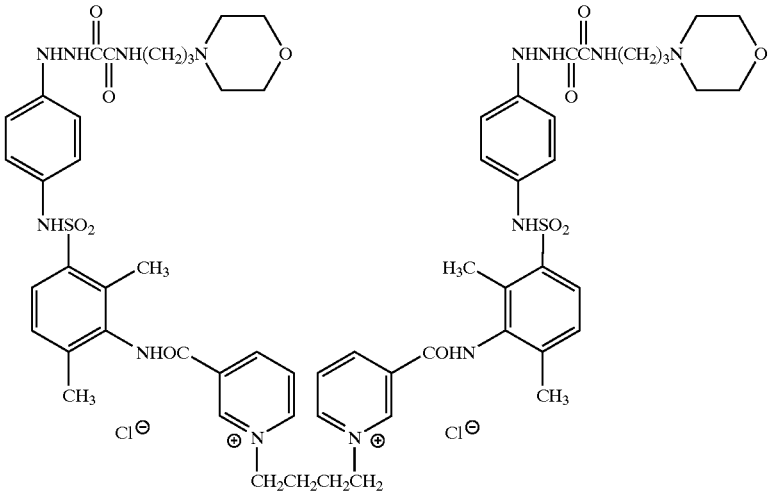
(H-29)
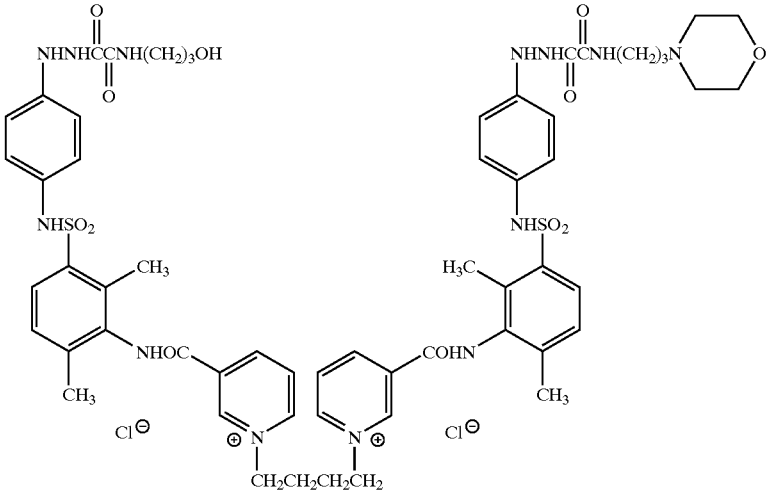

-continued
(H-30)
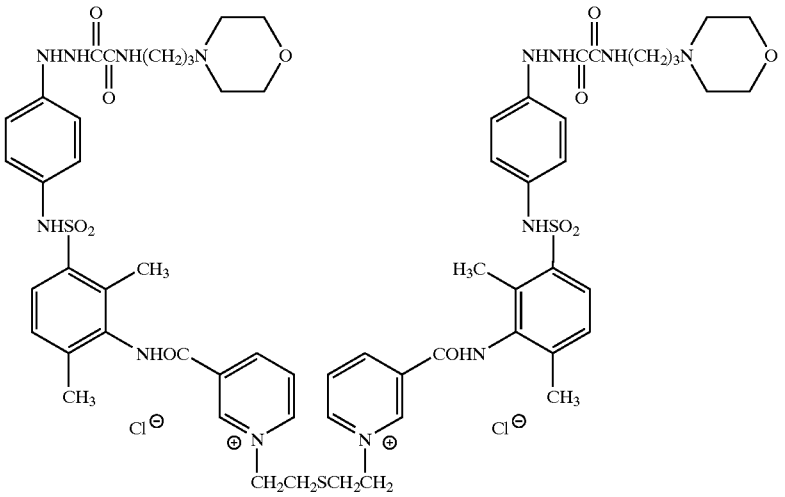
(H-31)
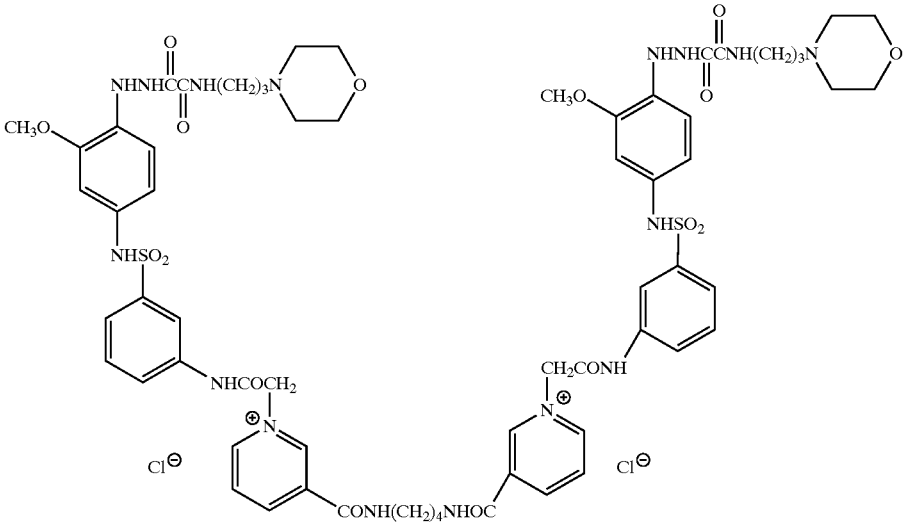
(H-32)
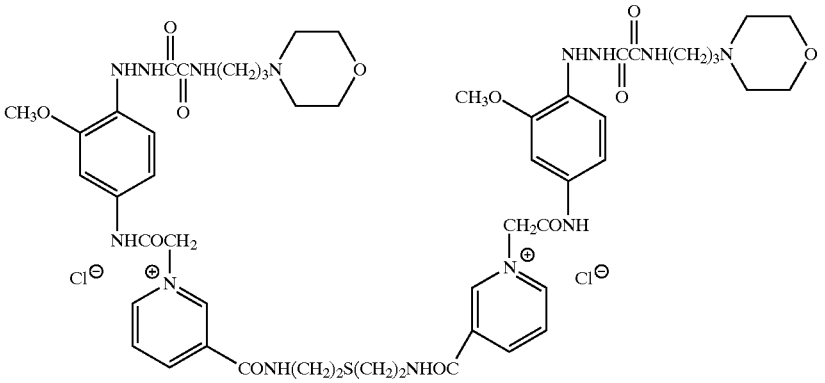

-continued
(H-33)
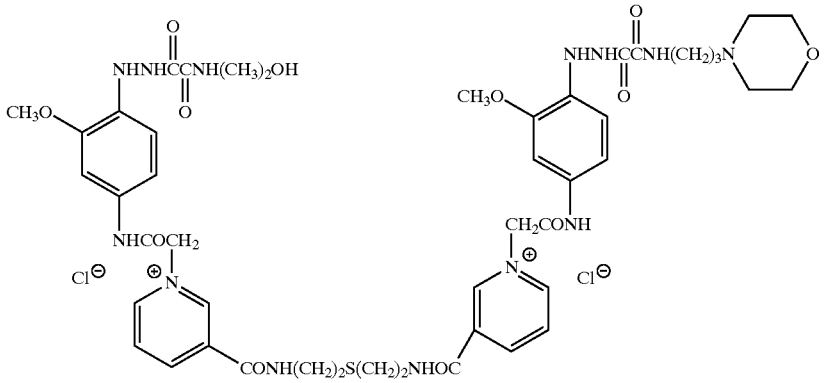
(H-34)
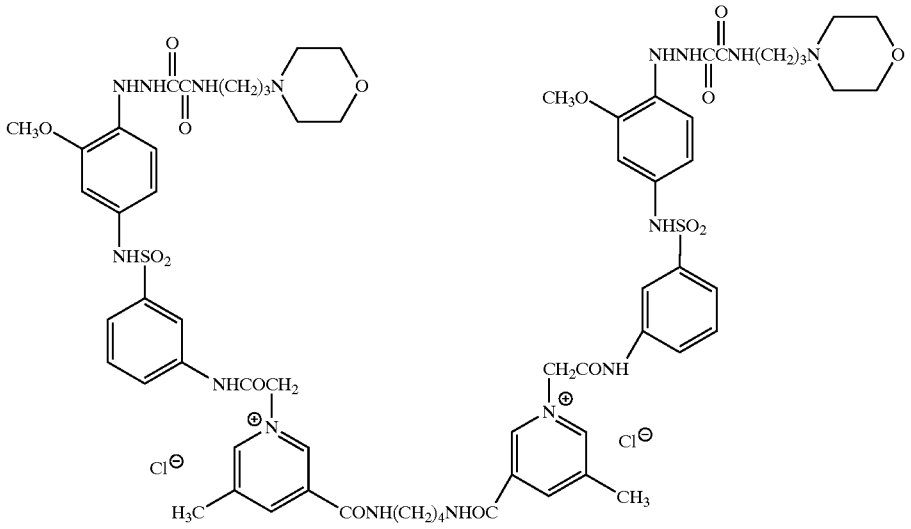
(H-35)
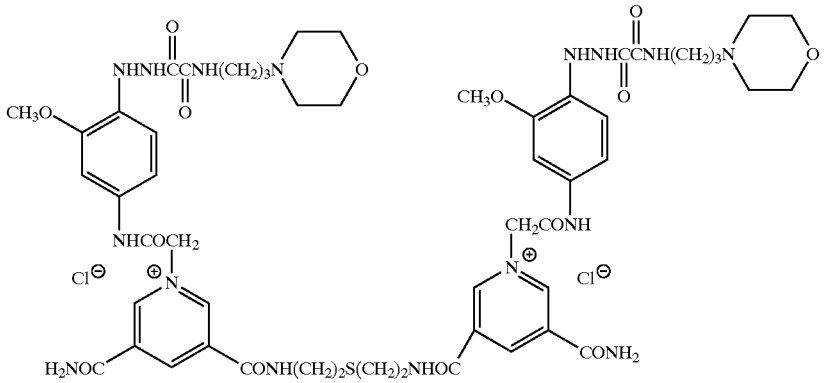

-continued
(H-36)
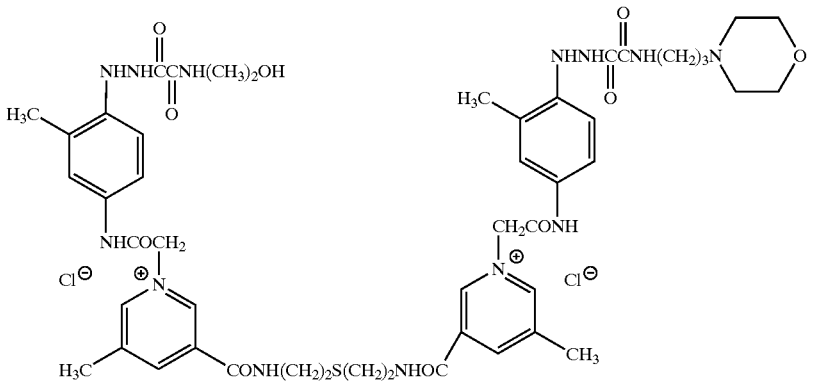
(H-37)
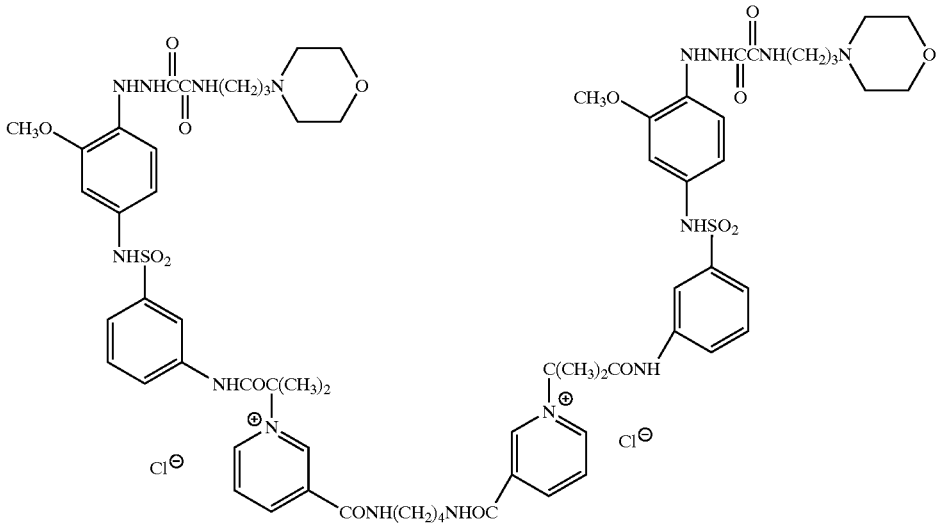
(H-38)
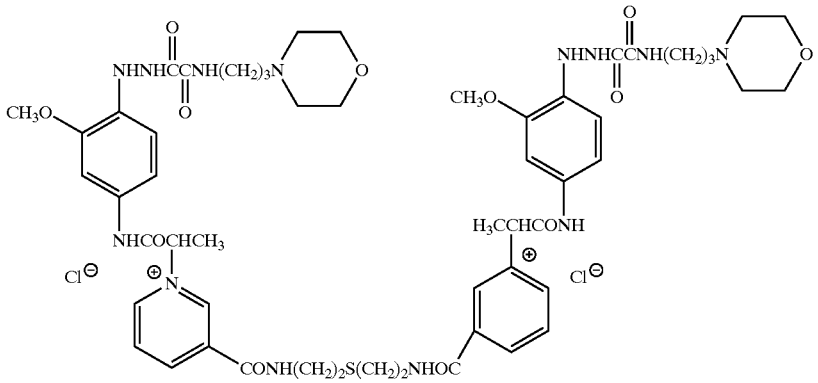

-continued
(H-39)
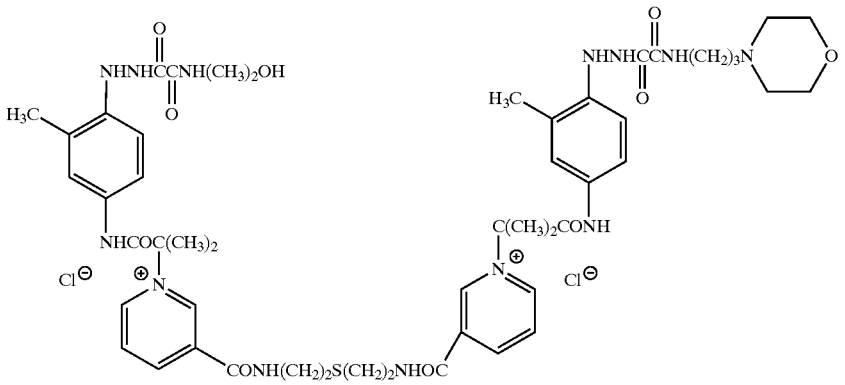
(H-40)
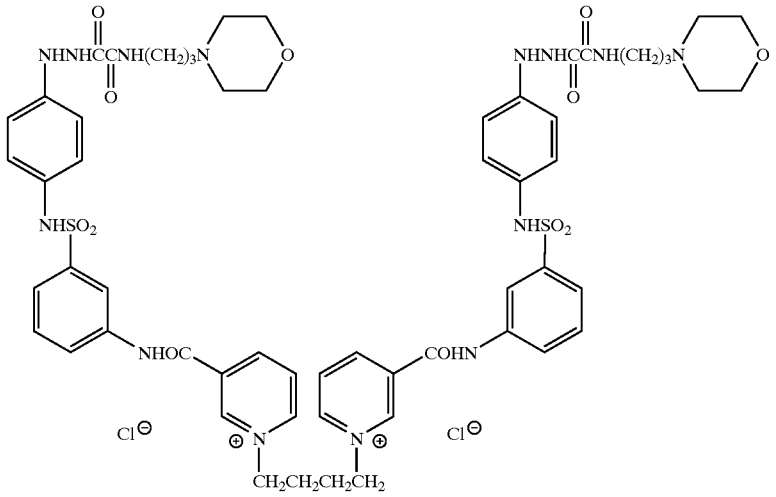
(H-41)
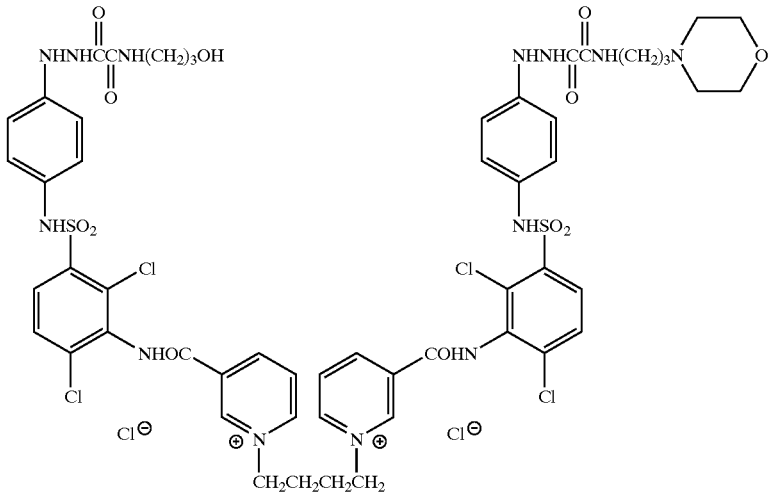

-continued (H-42)

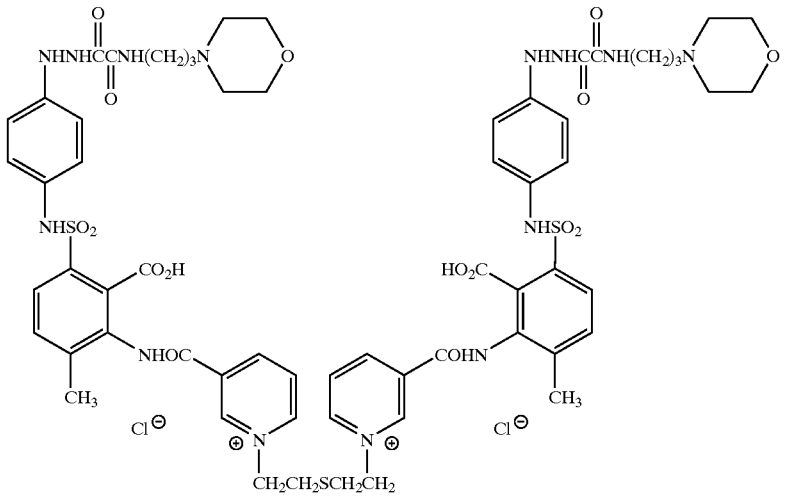

The hydrazine nucleating agents of the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl Cellosolve.

Further, the hydrazine nucleating agents can also be used in the form of an emulsification dispersion mechanically prepared according to well known emulsification dispersion methods by dissolving using oils, such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of hydrazine derivatives are dispersed in water using a ball mill, a colloid mill or ultrasonic wave.

In the present invention, the hydrazine nucleating agents may be added to a silver halide emulsion layer or any other hydrophilic colloid layer provided on the side of the support on which the silver halide emulsion layer is provided, but they are preferably added to the silver halide emulsion layer or a hydrophilic colloid layer adjucent to the silver halide emulsion layer. Two or more hydrazine nucleating agents can be used in combination.

The amount of hydrazine nucleating agents for use in the present invention is preferably from $1\times10^{-5}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of the silver halide.

A nucleation accelerating agent can be contained in a photographic material in the present invention.

Amine derivatives, onium salts, disulfide derivatives and hydroxymethyl derivatives can be used as nucleation accelerating agents in the present invention. The examples of nucleation accelerating agents are listed below, e.g., the compounds disclosed on lines 2 to 37 of page 48, specifically Compounds A-1) to A-73) disclosed on pages 49 to 58 in JP-A-7-77783; the compounds disclosed on pages 6 to 8 in JP-A-7-84331; the compounds represented by formulae (Na) and (Nb), specifically Compounds Na-1 to Na-22 and Nb-1 to Nb-12 disclosed on pages 16 to 20 in JP-A-7-104426; the compounds represented by formulae (1), (2), (3), (4), (5), (6) and (7), specifically Compounds 1-1 to 1-19, 2-1 to 2-22, 3-1 to 3-36, 4-1 to 4-5, 5-1 to 5-41, 6-1 to 6-58, and 7-1 to 7-38 disclosed in JP-A-8-272023; and the nucleation accelerating agents disclosed on line 8, column 108, page 55 to line 44, column 136, page 69 in JP-A-9-297377 are exemplified.

As the nucleation accelerating agent, a quaternary salt compound represented by the following formula (a), (b), (c), (d), (e) or (f) is preferably used in the present invention, and the compound represented by formula (b) is most preferably used:

(a)

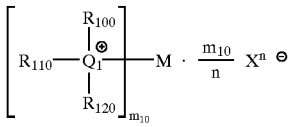

(b)

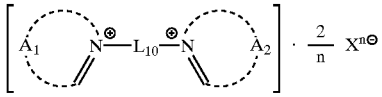

(c)

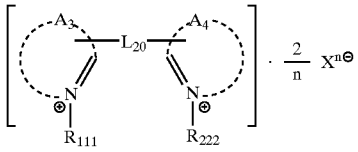

(d)

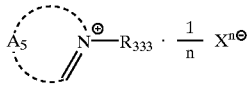

In formula (a), $Q_1$ represents a nitrogen atom or a phosphorus atom; $R_{100}$, $R_{110}$ and $R_{120}$ each represents an aliphatic group, an aromatic group or a heterocyclic group, and they may be linked to each other to form a cyclic structure; M represents an $m_{10}$-valent organic group which is bonded to $Q_1^+$ via a carbon atom contained in M; and $m_{10}$ represents an integer of from 1 to 4.

In formulae (b), (c) and (d), $A_1$, $A_2$, $A_3$, $A_4$ and $A_5$ each represents an organic residue for completing an unsaturated heterocyclic ring containing a quaternized nitrogen atom; $L_{10}$ and $L_{20}$ each represents a divalent linking group; and $R_{111}$, $R_{222}$ and $R_{333}$ each represents a substituent.

The quaternary salt compound represented by formula (a), (b), (c) or (d) has repeating units of an ethyleneoxy group or a propyleneoxy group in the molecule in total of 20 or more, and they may be substituted in two or more places.

(e)

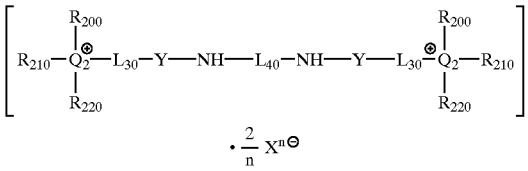

(f)

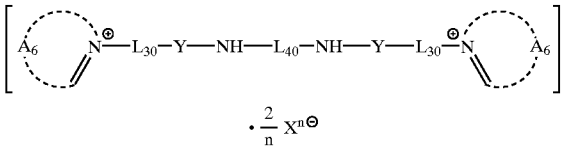

In formula (e), Q 2 represents a nitrogen atom or a phosphorus atom; and $R_{200}$, $R_{210}$ and $R_{220}$ each has the same meaning as $R_{100}$, $R_{110}$ and $R_{120}$ in formula (a)

$A_6$ in formula (f) has the same meaning as $A_1$ or $A_2$ in formula (b), with the proviso that the nitrogen-containing unsaturated heterocyclic ring formed by $A_6$ may have a substituent but does not have a primary hydroxyl group on the substituent; $L_{30}$ in formulae (e) and (f) represents an alkylene group; Y represents —C(═O)— or —$SO_2$—; and $L_{40}$ represents a divalent linking group having at least one hydrophilic group.

In formulae (a) to (f), $X^{n-}$ represents an n-valent anion; n represents an integer of from 1 to 3, provided that $X^{n-}$ is not necessary when another anionic group is present in the molecule and forms an inner salt with $Q_1^+$, $Q_2^+$ or $N^+$.

In formula (a), the examples of the aliphatic groups represented by $R_{100}$, $R_{110}$ and $R_{120}$ include a straight chain or branched alkyl group, e.g., a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group, and an octadecyl group; an aralkyl group, e.g., a substituted or unsubstituted benzyl group; a cycloalkyl group, e.g., a cyclopropyl group, a cyclopentyl group, and a cyclohexyl group; an alkenyl group, e.g., an allyl group, a vinyl group, and a 5-hexenyl group; a cycloalkenyl group, e.g., a cyclopentyl group and a cyclohexenyl group; and an alkynyl group, e.g., a phenylethynyl group. The examples of the aromatic groups include an aryl group, e.g., a phenyl group, a naphthyl group and a phenanthryl group, and the examples of the heterocyclic groups include a pyridyl group, a quinolyl group, a furyl group, an imidazolyl group, a thiazolyl group, a thiadiazolyl group, a benzotriazolyl group, a benzothiazole group, a morpholyl group, a pyrimidyl group and a pyrrolidyl group.

The examples of the substituents substituted on these groups include, besides the groups represented by $R_{100}$, $R_{110}$ and $R_{120}$, a halogen atom, e.g., a fluorine atom, a chlorine atom, a bromine atom and an iodine atom, a nitro group, an alkyl- or arylamino group, an alkoxyl group, an aryloxy group, an alkyl- or arylthio group, a carbonamido group, a carbamoyl group, a ureido group, a thioureido group, a sulfonylureido group, a sulfonamido group, a sulfamoyl group, a hydroxyl group, a sulfonyl group, a carboxyl group (including carboxylato), a sulfo group (including sulfonato), a cyano group, an oxycarbonyl group, an acyl group, and a heterocyclic group (including a nitrogen-containing heterocyclic group containing a quaternized nitrogen atom). These substituents may further be substituted with these substituents.

The groups represented by $R_{100}$, $R_{110}$ and $R_{120}$ in formula (a) may be bonded to each other to form a cyclic structure.

As the examples of the groups represented by M in formula (a), the same groups as defined in $R_{100}$, $R_{110}$ and $R_{120}$ can be exemplified. When $m_{10}$ represents an integer of 2 or more, M represents an $m_{10}$-valent linking group which is bonded to $Q_1^+$ via a carbon atom contained in M, specifically an alkylene group, an arylene group, a heterocyclic group, and an $m_{10}$-valent linking group formed by combining any of these groups with a —CO— group, an —O— group, an —N($R_N$)— group ($R_N$ represents a hydrogen atom or the groups represented by $R_{100}$, $R_{110}$ and $R_{120}$, and when a plurality of $R_N$'s are present in the molecule, they may be the same or different, and they may be bonded to each other), an —S— group, an —SO— group, an —$SO_2$— group or a —P═O— group. M may have arbitrary substituents, and as the substituents, the same substituents as the substituents which $R_{100}$, $R_{110}$ and $R_{120}$ may have can be exemplified.

In formula (a), $R_{100}$, $R_{110}$ and $R_{120}$ each preferably represents a group having 20 or less carbon atoms. When $Q_1$ represents a phosphorus atom, $R_{100}$, $R_{110}$ and $R_{120}$ each preferably represents an aryl group having 15 or less carbon atoms, and when $Q_1$ represents a nitrogen atom, an alkyl, aralkyl or aryl group having 15 or less carbon atoms is particularly preferred. $m_{10}$ preferably represents 1 or 2. When $m_{10}$ represents 1, M preferably represents a group having 20 or less carbon atoms, and an alkyl group, an aralkyl group or an aryl group each having 15 or less total carbon atoms is particularly preferred. When $m_{10}$ represents 2, the divalent organic group represented by M is preferably an alkylene group, an arylene group, or a divalent linking group formed by combining any of these groups with a —CO— group, an —O— group, an —N($R_N$)— group, an —S— group, or an —$SO_2$— group. When $m_{10}$ represents 2, M is preferably a divalent linking group having 20 or less total carbon atoms which is bonded to $Q_1^+$ via a carbon atom contained in M. However, when M or $R_{100}$, $R_{110}$ or $R_{120}$contains a plurality of repeating units of an ethyleneoxy group or a propyleneoxy group, the above-described preferred range of carbon atom number does not apply to this case. Further, when $m_{10}$ represents an integer of 2 or more, a plurality of $R_{100}$, $R_{110}$ and $R_{120}$ are present in the molecule, and they may be the same with or different from each other.

The quaternary salt compound represented by formula (a) has repeating units of an ethyleneoxy group or a propyleneoxy group in the molecule in total of 20 or more, and they may be substituted in one place or two or more places. When $m_{10}$ represents an integer of 2 or more, it is more preferred for the linking group represented by M to have 20 or more ethyleneoxy group or propyleneoxy group repeating units.

In formula (b), (c) or (d), $A_1$, $A_2$, $A_3$, $A_4$ and $A_5$ each represents an organic residue for completing a substituted or unsubstituted unsaturated heterocyclic ring containing a quaternized nitrogen atom, and the heterocyclic ring may contain a carbon atom, an oxygen atom, a nitrogen atom, a sulfur atom and a hydrogen atom, and further a benzene ring may be condensed.

The examples of the unsaturated heterocyclic rings formed by $A_1$, $A_2$, $A_3$, $A_4$ and $A_5$ include a pyridine ring, a quinoline ring, an isoquinoline ring, an imidazole ring, a thiazole ring, a thiadiazole ring, a benzotriazole ring, a benzothiazole ring, a pyrimidine ring, and a pyrazole ring, and particularly preferred rings are a pyridine ring, a quinoline ring, and an isoquinoline ring.

The unsaturated heterocyclic ring formed by $A_1$, $A_2$, $A_3$, $A_4$ and $A_5$ with a quaternized nitrogen atom may have a substituent. As the examples of the substituents, the same substituents as the substituents which the group represented by $R_{100}$, $R_{110}$ and $R_{120}$ in formula (a) may have can be exemplified, preferably a halogen atom (in particular, a chlorine atom), an aryl group having 20 or less carbon atoms (in particular, a phenyl group), an alkyl group, an aralkyl group, a carbamoyl group, an alkyl- or arylamino group, an alkyl- or aryloxycarbonyl group, an alkoxyl group, an aryloxy group, an alkyl- or arylthio group, a hydroxyl group, a mercapto group, a carbonamido group, a sulfonamido group, a sulfo group (including sulfonato), a carboxyl group (including carboxylato), and a cyano group, particularly preferably a phenyl group, an alkylamino group, a carbonamido group, a chlorine atom and an alkylthio group, and most preferably a phenyl group.

The divalent linking group represented by $L_{10}$ and $L_{20}$ is preferably constituted alone or in combination of alkylene, arylene, alkenylene, alkynylene, adivalent heterocyclicgroup, —$SO_2$—, —SO—, —O—, —S—, —N($R_N$')—, —C (=O)— and —PO—, where $R_N$' represents an alkyl group, an aralkyl group, an aryl group, or a hydrogen atom. The divalent linking group represented by $L_{10}$ and $L_{20}$ may have an arbitrary substituent. As the examples of the substituents, the same substituents as the substituents which the group represented by $R_{100}$, $R_{110}$ and $R_{120}$ in formula (a) may have can be exemplified. $L_{10}$ and $L_{20}$ each particularly preferably represents a divalent linking group constituted alone or in combination of alkylene, arylene, —C(=O)—, —O—, —S—, —$SO_2$—, and —N($R_N$')—.

$R_{111}$, $R_{222}$ and $R_{333}$ each preferably represents an alkyl group having from 1 to 20 carbon atoms or an aralkyl group, and each group may be the same or different. $R_{111}$, $R_{222}$ and $R_{333}$ may have a substituent. As the examples of the substituents, the same substituents as the substituents which the group represented by $R_{100}$, $R_{110}$ and $R_{120}$ in formula (a) may have can be exemplified. $R_{111}$, $R_{222}$ and $R_{333}$ each particularly preferably represents an alkyl group having from 1 to 20 carbon atoms or an aralkyl group. The preferred examples of the substituents include a carbamoyl group, an oxycarbonyl group, an acyl group, an aryl group, a sulfo group (including sulfonato), a carboxyl group (including carboxylato), a hydroxyl group, an alkyl- or arylamino group and an alkoxyl group.

However, when $R_{111}$, $R_{222}$ and $R_{333}$ contain a plurality of repeating units of an ethyleneoxy group or a propyleneoxy group, the above-described preferred range of carbon atom number does not always limited to this case.

The quaternary salt compound represented by formula (b) or (c) has repeating units of an ethyleneoxy group or a propyleneoxy group in the molecule in total of 20 or more. They may be substituted in one place or two or more places, they may be substituted any of $A_1$, $A_2$, $A_3$, $A_4$, $R_{111}$, $R_{222}$, $L_{10}$ and $L_{20}$, but preferably the linking group represented by $L_{10}$ or $L_{20}$ has 20 or more repeating units of an ethyleneoxy group or a propyleneoxy group.

The quaternary salt compound represented by formula (d) has repeating units of an ethyleneoxy group or a propyleneoxy group in the molecule in total of 20 or more. They may be substituted in one place or two or more places, they may be substituted any of $A_5$ or $R_{333}$, but preferably the group represented by $R_{333}$ has 20 or more repeating units of an ethyleneoxy group or a propyleneoxy group.

The quaternary salt compounds represented by formulae (a), (b), (c) and (d) may contain an ethyleneoxy group and a propyleneoxy group repeatedly at the same time. When a plurality of repeating units of an ethyleneoxy group or a propyleneoxy group are contained, the number of repeating units may strictly take certain value or may be given as an average value, and in the latter case, the quaternary salt compound is a mixture having a certain degree of molecular weight distribution.

In the present invention, the case where the quaternary salt compound has 20 or more repeating units of an ethyleneoxy group is preferred, and the case of from 20 to 67 is more preferred.

In formula (e), $Q_2$, $R_{200}$, $R_{210}$ and $R_{220}$ each has the same meaning as $Q_1$, $R_{100}$, $R_{110}$ and $R_{120}$ in formula (a), and the preferred range of each group is also the same.

$A_6$ in formula (f) has the same meaning as $A_1$ or $A_2$ in formula (b) and the preferred range is also the same, with the proviso that the nitrogen-containing unsaturated heterocyclic ring formed by $A_6$in formula (f) with a quaternized nitrogen atom may have a substituent but does not have a substituent containing a primary hydroxyl group.

$L_{30}$ in formulae (e) and (f) represents an alkylene group. The alkylene group is a straight chain, branched or cyclic, substituted or unsubstituted alkylene group preferably having from 1 to 20 carbon atoms. The alkylene group is not only saturated alkylene represented by an ethylene group but alkylene containing an unsaturated group represented by —$CH_2C_6H_4CH_2$— and —$CH_2CH$=$CHCH_2$— may also be used. When $L_{30}$ represents a substituent, as the examples of the substituents, the same substituents as the substituents which the group represented by $R_{100}$, $R_{110}$ and $R_{120}$ in formula (a) may have can be exemplified.

$L_{30}$ preferably represents a straight chain or branched saturated group having from 1 to 10 carbon atoms, more preferably a substituted or unsubstituted methylene, ethylene or trimethylene group, particularly preferably a substituted or unsubstituted methylene or ethylene group, and most preferably a substituted or unsubstituted methylene group.

In formulae (e) and (f), $L_{40}$ represents a divalent linking group having at least one hydrophilic group. The examples of hydrophilic groups include —$SO_2$—, —SO—, —O—, —P(=O)=, —C(=O)—, —CONH—, —$SO_2$NH—, —NH$SO_2$NH—, —NHCONH—, an amino group, a guanidino group, an ammonio group, a heterocyclic group containing a quaternized nitrogen atom, and groups comprising combination of these groups. $L_{40}$ consists of any of these hydrophilic groups and an alkylene group, an alkenylene group, an arylene group, or a heterocyclic group in combination.

The group such as an alkylene group, an arylene group, an alkenylene group, or a heterocyclic group which constitutes $L_{40}$ may have a substituent, and as the examples of the substituents, the same substituents as the substituents which the group represented by $R_{100}$, $R_{110}$ and $R_{120}$ in formula (a) may have can be exemplified.

A hydrophilic group may be present in $L_{40}$ in the form of dividing $L_{40}$, or may be a part of the substituent on $L_{40}$. A hydrophilic group is more preferably present in the form of dividing $L_{40}$. For example, the case where each group of —C(=O)—, —$SO_2$—, —SO—, —O—, —P(=O)=, —CONH—, —$SO_2$NH—, —NH$SO_2$NH—, —NHCONH—, a cationic group (a group containing quaternary structure of a nitrogen atom or a phosphorus atom, or a nitrogen-containing heterocyclic group containing a quaternized nitrogen atom), an amino group, a guanidino group, or each of the divalent groups comprising combinations of these groups is present in the form of dividing $L_{40}$ is more preferred.

One preferred example of a hydrophilic group which $L_{40}$ has is a group combining an ether bond and an alkylene group having a plurality of repeating units of an ethyleneoxy group and a propyleneoxy group. The polymerization degree or the average polymerization degree is preferably from 2 to 67.

As the hydrophilic group which $L_{40}$ has, as a result of combining —$SO_2$—, —SO—, —O—, —P(=O)=, —C(=O)—, —CONH—, —$SO_2$NH—, —$NHSO_2$NH—, —NHCONH—, an amino group, a guanidino group, an ammonio group, or a heterocyclic group containing a quaternized nitrogen atom, or as the substituent which $L_{40}$ has, it is also preferred to contain a dissociable group. A dissociable group means a group having a proton of low acidity which is dissociable with an alkaline developing solution, or a partial structure, or the salt of it, specifically, e.g., a carboxyl group/a —COOH group, a sulfo group/an —$SO_3$H group, a phosphonic acid group/a —$PO_3$H group, a phosphoric acid group/a —$OPO_3$H group, a hydroxyl group/an —OH group, a mercapto group/an —SH group, an —$SO_2NH_2$ group, an N-substituted sulfonamido group/an —$SO_2$NH— group, a —CONH$SO_2$— group, an —$SO_2$NH$SO_2$— group, a —CONHCO— group, an active methylene group, an —NH— group contained in a nitrogen-containing heterocyclic group, and the salts of them.

$L_{40}$ preferably represents a linking group having an alkylene group or an arylene group combined with —C(=O)—, —$SO_2$—, —O—, —CONH—, —$SO_2$NH—, —$NHSO_2$NH—, —NHCONH—, or an amino group arbitrarily, more preferably an alkylene group having from 2 to 5 carbon atoms combined with —C(=O)—, —$SO_2$—, —O—, —CONH—, —$SO_2$NH—, —$NHSO_2$NH—, or —NHCONH— arbitrarily.

Y represents —C(=O)— or —$SO_2$—, preferably —C(=O)—.

In formulae (a) to (f), as the examples of the anions represented by $X^{n-}$, a halogen ion, e.g., a chlorine ion, a bromine ion and an iodine ion, a carboxylate ion, e.g., an acetate ion, an oxalate ion, a fumarate ion and a benzoate ion, a sulfonate ion, e.g., a p-toluenesulfonate ion, a methanesulfonate ion, a butanesulfonate ion and a benzenesulfonate ion, a sulfate ion, a perchlorate ion, a carbonate ion and a nitrate ion are exemplified.

As the anions represented by $X^{n-}$, a halogen ion, a carboxylate ion, a sulfonate ion and a sulfate ion are preferred, and n is preferably 1 or 2. A chlorine ion and a bromine ion are particularly preferred as $X^{n-}$, and a chlorine ion is most preferred. However, $X^{n-}$ is not necessary when another anionic group is present in the molecule and forms an inner salt with $Q_1^+$, $Q_2^+$ or $N^+$.

The quaternary salt compounds represented by formula (b), (c) or (f) are more preferred, those represented by formula (b) or (f) are particularly preferred. Further, in formula (b), the case in which the linking group represented by $L_{10}$ has 20 or more repeating units of an ethyleneoxy group is preferred, particularly preferably from 20 to 67. In formula (f), the case in which the unsaturated heterocyclic compound formed by $A_6$ represents 4-phenylpyridine, isoquinoline or quinoline is particularly preferred.

The specific examples of quaternary salt compounds represented by formulae (a) to (f) are shown below (in the formulae, Ph represents a phenyl group), but the present invention is not limited to the following compounds.

$Q^+$—$L_0$—$Q^+$.2$X^-$

| No. | $Q^+$ = | $L_0$ = | $X^-$ = |
|---|---|---|---|
| 1 | 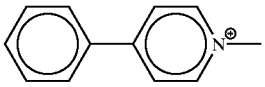 | —$C_2H_4$—$(OC_2H_4)_n$—$OC_2H_4$— n = 20 | $Cl^{\ominus}$ |
| 2 | 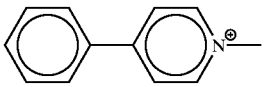 | —$C_2H_4$—$(OC_2H_4)_n$—$OC_2H_4$— n ≈ 32 | $Cl^{\ominus}$ |
| 3 | 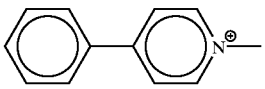 | —$C_2H_4$—$(OC_2H_4)_n$—$OC_2H_4$— n ≈ 43 | $Cl^{\ominus}$ |
| 4 | 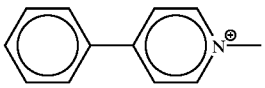 | —$C_2H_4$—$(OC_2H_4)_n$—$OC_2H_4$— n ≈ 62 | $Cl^{\ominus}$ |
| 5 | 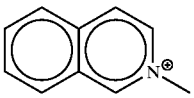 | —$C_2H_4$—$(OC_2H_4)_n$—$OC_2H_4$— n ≈ 21 | $Cl^{\ominus}$ |
| 6 | 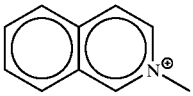 | —$C_2H_4$—$(OC_2H_4)_n$—$OC_2H_4$— n ≈ 43 | $Cl^{\ominus}$ |

-continued

| | | | |
|---|---|---|---|
| 7 | 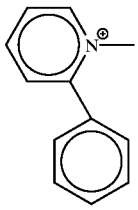 | $—C_2H_4—(OC_2H_4)_n—OC_2H_4—$<br>n = 20 | $Cl^{\ominus}$ |
| 8 | 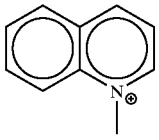 | $—C_2H_4—(OC_2H_4)_n—OC_2H_4—$<br>n ≈ 43 | $Cl^{\ominus}$ |
| 9 | 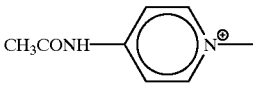 | $—C_2H_4—(OC_2H_4)_n—OC_2H_4—$<br>n ≈ 21 | $Cl^{\ominus}$ |
| 10 | 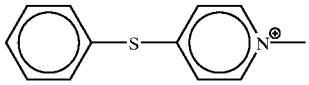 | $—C_2H_4—(OC_2H_4)_n—OC_2H_4—$<br>n ≈ 43 | $Cl^{\ominus}$ |
| 11 | 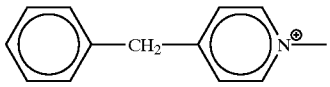 | $—C_2H_4—(OC_2H_4)_n—OC_2H_4—$<br>n ≈ 67 | $Cl^{\ominus}$ |
| 12 | 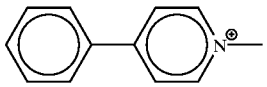 | 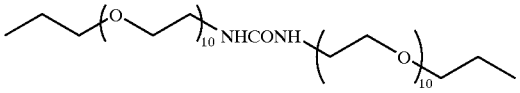 | $Cl^{\ominus}$ |
| 13 | 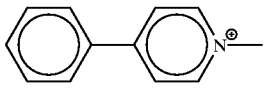 | 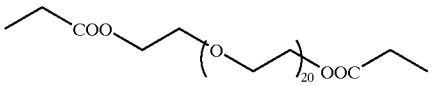 | $Cl^{\ominus}$ |
| 14 | 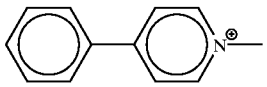 | 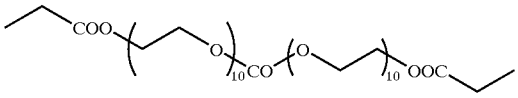 | $Cl^{\ominus}$ |
| 15 | 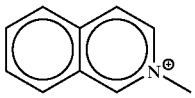 | 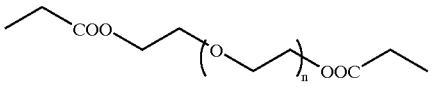 <br>n ≈ 43 | $Cl^{\ominus}$ |
| 16 | 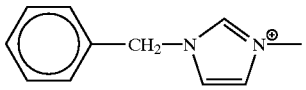 | $—C_2H_4—(OC_2H_4)_n—OC_2H_4—$<br>n ≈ 42 | $Cl^{\ominus}$ |
| 17 | 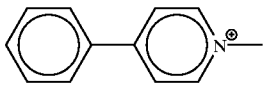 | $—C_2H_4—(OC_2H_4)_n—OC_2H_4—$<br>n ≈ 62 | 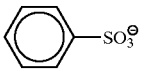 |
| 18 | 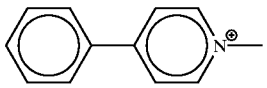 | $—C_2H_4—(OC_2H_4)_n—OC_2H_4—$<br>n ≈ 43 | $Br^{\ominus}$ |
| 19 | 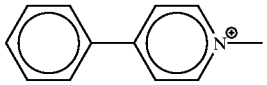 | $—C_2H_4—(OC_2H_4)_n—OC_2H_4—$<br>n = 20 | $(COO)_2^{2\ominus}$ |

-continued
| | | | |
|---|---|---|---|
| 20 | 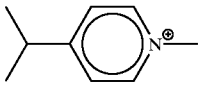 | $—C_2H_4—(OC_2H_4)_n—OC_2H_4—$<br>n ≈ 34 | $Cl^{\ominus}$ |
| 21 | 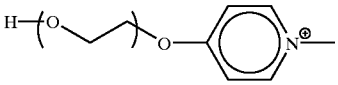 | $—(CH_2)_5—$ | $CH_3SO_3^{\ominus}$ |
| 22 | 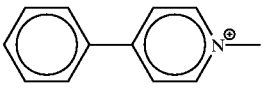 | 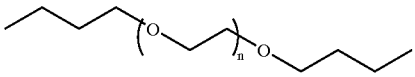 <br>n ≈ 43 | $Cl^{\ominus}$ |
| 23 | 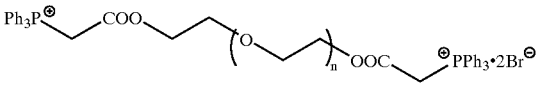 <br>n ≈ 43 | | |
| 24 | 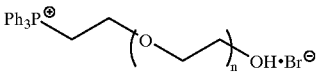 <br>n ≈ 33 | | |
| 25 | 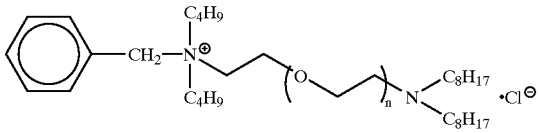 <br>n ≈ 33 | | |
| 26 | 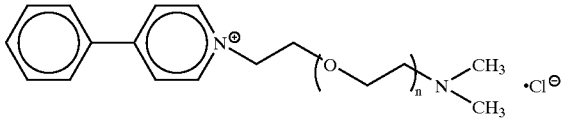 <br>n ≈ 43 | | |
| 27 | 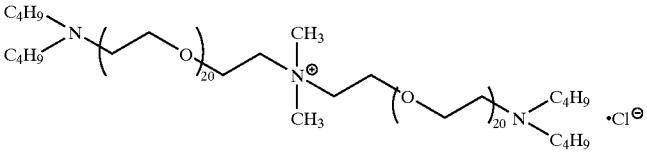 | | |
| 28 | 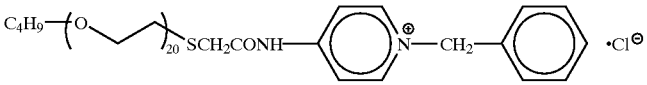 | | |
| 29 | 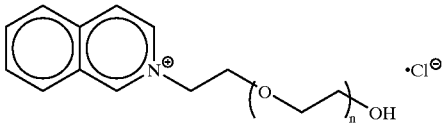 <br>n ≈ 67 | | |
| 30 | 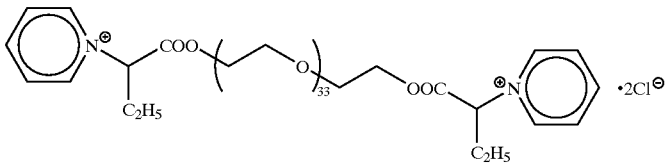 | | |

-continued
31
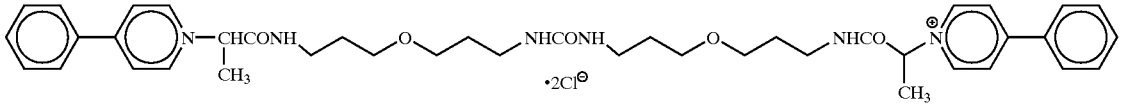
| No. | $Q^+$ = | $L_o$ = | $X^-$ = |
|---|---|---|---|
| 32 | 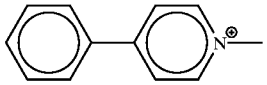 | 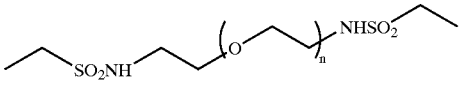 n = 2 | $Cl^{\ominus}$ |
| 33 | 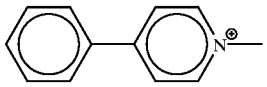 | 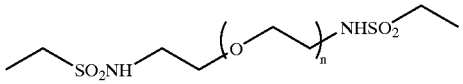 n ≈ 24 | $Br^{\ominus}$ |
| 34 | 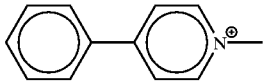 | 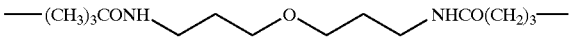 | $Cl^{\ominus}$ |
| 35 | 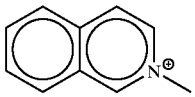 | 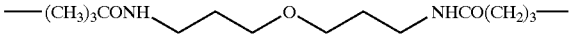 | $Cl^{\ominus}$ |
| 36 | 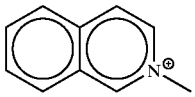 | 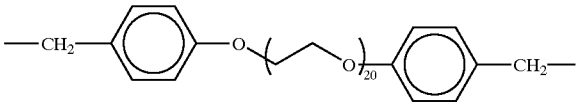 | $Cl^{\ominus}$ |
| 37 | 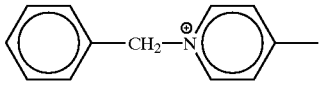 | 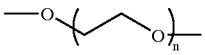 n ≈ 33 | $Cl^{\ominus}$ |
| 38 | 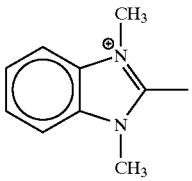 | 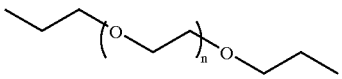 n ≈ 43 | $Cl^{\ominus}$ |
| 39 | $(C_4H_9)_3N^{\oplus}$— | 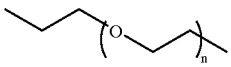 n = 20 | $Cl^{\ominus}$ |
| 40 | 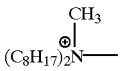 | 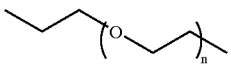 n ≈ 43 | $Cl^{\ominus}$ |

-continued

| | | | |
|---|---|---|---|
| 41 | $Ph_3P^{\oplus}$— | 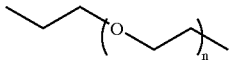 n = 20 | $Cl^{\ominus}$ |
| 42 | $Ph_3P^{\oplus}$— | 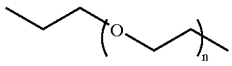 n ≈ 33 | $Br^{\ominus}$ |

$Q^+$—$CH_2CONH$—L—$NHCOCH_2$—$Q^+.2X^-$

| No. | $Q^+$ = | L = | $X^-$ = |
|---|---|---|---|
| 43 | $PhP^{\oplus}$— | —$C_2H_4$—$(OC_2H_4)_n$— n = 3 | $Cl^{\ominus}$ |
| 44 | $PhP^{\oplus}$— | —$C_2H_4$—$(OC_2H_4)_n$— n = 20 | $Br^{\ominus}$ |
| 45 | $PhP^{\oplus}$— | —$C_2H_4$—$(OC_2H_4)_n$— n ≈ 34 | $Cl^{\ominus}$ |
| 46 | $PhP^{\oplus}$— | —$C_2H_4$—$(OC_2H_4)_n$— n ≈ 67 | $Cl^{\ominus}$ |
| 47 | 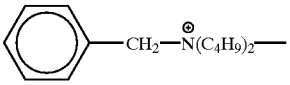 | —$C_2H_4$—$(OC_2H_4)_n$— n = 12 | $Cl^{\ominus}$ |
| 48 | 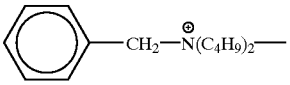 | —$C_2H_4$—$(OC_2H_4)_n$— n = 30 | $Br^{\ominus}$ |
| 49 | 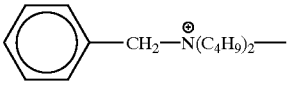 | —$C_2H_4$—$(OC_2H_4)_n$— n ≈ 43 | 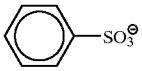 |
| 50 | 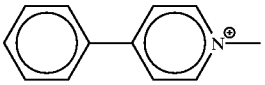 | —$C_2H_4$—$(OC_2H_4)_n$— n = 3 | $Cl^{\ominus}$ |
| 51 | 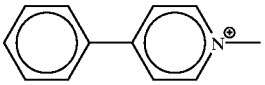 | —$C_2H_4$—$(OC_2H_4)_n$— n = 12 | $Cl^{\ominus}$ |
| 52 | 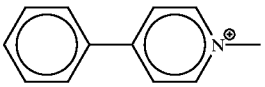 | —$C_2H_4$—$(OC_2H_4)_n$— n = 20 | $Cl^{\ominus}$ |
| 53 | 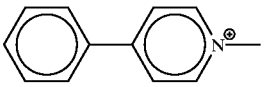 | —$C_2H_4$—$(OC_2H_4)_n$— n ≈ 43 | $Cl^{\ominus}$ |
| 54 | 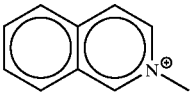 | —$C_2H_4$—$(OC_2H_4)_n$— n = 2 | $Cl^{\ominus}$ |
| 55 | 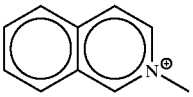 | —$C_2H_4$—$(OC_2H_4)_n$— n = 12 | $Br^{\ominus}$ |
| 56 | 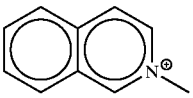 | —$C_2H_4$—$(OC_2H_4)_n$— n = 30 | 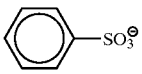 |

-continued

| | | | |
|---|---|---|---|
| 57 | 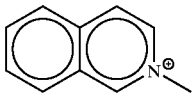 | $—C_2H_4—(OC_2H_4)_n—$<br>n ≈ 67 | $(COO)_2^{2\ominus}$ |
| 58 | 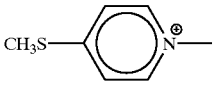 | $—C_2H_4—(OC_2H_4)_n—$<br>n = 12 | $Cl^{\ominus}$ |
| 59 | 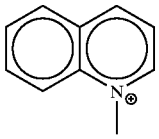 | $—C_2H_4—(OC_2H_4)_n—$<br>n = 20 | $Cl^{\ominus}$ |
| 60 | 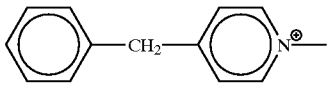 | $—C_2H_4—(OC_2H_4)_n—$<br>n = 30 | $Cl^{\ominus}$ |
| 61 | 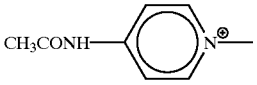 | $—C_2H_4—(OC_2H_4)_n—$<br>n ≈ 67 | $Cl^{\ominus}$ |
| 62 | 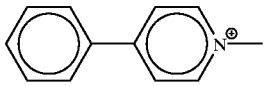 | $—C_3H_6—(OC_2H_4)_n—OC_3H_6—$<br>n = 2 | $Cl^{\ominus}$ |
| 63 | 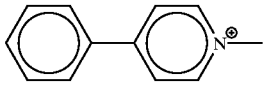 | $—C_3H_6—(OC_2H_4)_n—OC_3H_6—$<br>n = 20 | $Cl^{\ominus}$ |
| 64 | 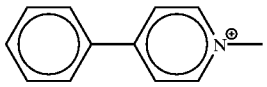 | $—C_3H_6—(OC_2H_4)_n—OC_3H_6—$<br>n ≈ 43 | $Cl^{\ominus}$ |
| 65 | $Ph_3P^{\oplus}—$ | $—C_3H_6—(OC_2H_4)_n—OC_3H_6—$<br>n = 2 | $Cl^{\ominus}$ |
| 66 | $Ph_3P^{\oplus}—$ | $—C_3H_6—(OC_2H_4)_n—OC_3H_6—$<br>n = 12 | $Cl^{\ominus}$ |
| 67 | 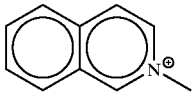 | $—C_3H_6—(OC_2H_4)_n—OC_3H_6—$<br>n = 20 | $Cl^{\ominus}$ |
| 68 | 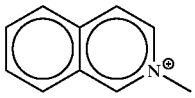 | $—C_3H_6—(OC_2H_4)_n—OC_3H_6—$<br>n ≈ 43 | $Cl^{\ominus}$ |
| 69 | $(C_3H_7)_3N^{\oplus}—$ | $—C_3H_6—(OC_2H_4)_n—OC_3H_6—$<br>n ≈ 67 | $Cl^{\ominus}$ |
| 70 | $(C_3H_7)_3N^{\oplus}—$ | $—\overset{CH_3}{\overset{\vert}{C}}HCH_2—(OC_2H_4)_n—OCH_2\overset{CH_3}{\overset{\vert}{C}}H—$ n = 12 | $Cl^{\ominus}$ |
| 71 | 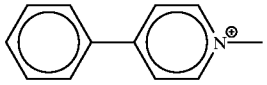 | $—\overset{CH_3}{\overset{\vert}{C}}HCH_2—(OC_2H_4)_n—OCH_2\overset{CH_3}{\overset{\vert}{C}}H—$<br>n ≈ 18 | $Cl^{\ominus}$ |
| 72 | 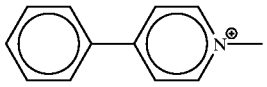 | $—\overset{CH_3}{\overset{\vert}{C}}HCH_2—(OC_2H_4)_n—OCH_2\overset{CH_3}{\overset{\vert}{C}}H—$<br>n = 20 | $Cl^{\ominus}$ |

-continued
| | | | |
|---|---|---|---|
| 73 | 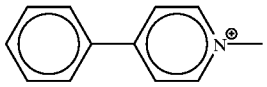 | 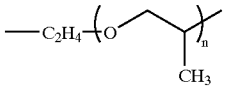 n = 4 | $Cl^{\ominus}$ |
| 74 | 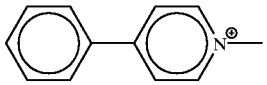 | 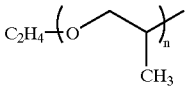 n ≈ 13 | $Cl^{\ominus}$ |
| 75 | 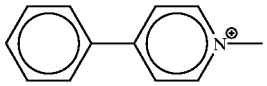 | 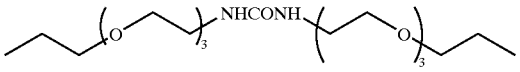 | $Cl^{\ominus}$ |
| 76 | 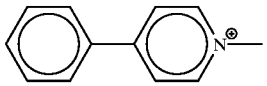 | 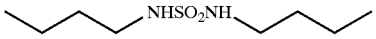 | $Cl^{\ominus}$ |
| 77 | 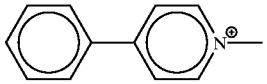 | 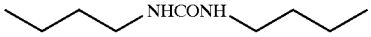 | $Cl^{\ominus}$ |
| 78 | 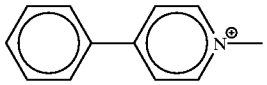 | 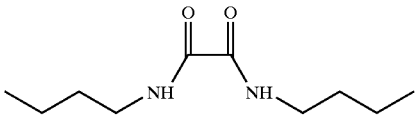 | $Cl^{\ominus}$ |
| 79 | 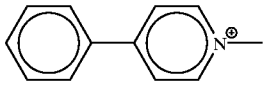 | 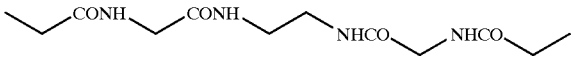 | $Cl^{\ominus}$ |
| 80 | 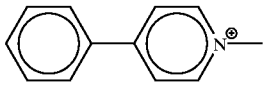 | 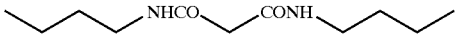 | $Cl^{\ominus}$ |
| 81 | 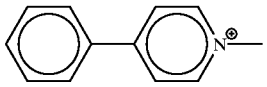 | 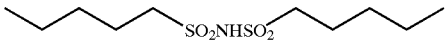 | $Cl^{\ominus}$ |
| 82 | 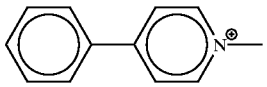 | 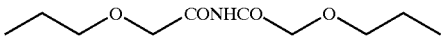 | $Cl^{\ominus}$ |
| 83 | 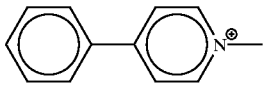 | 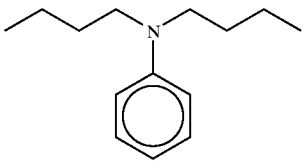 | $Cl^{\ominus}$ |
| 84 | 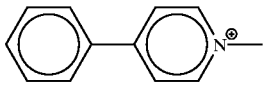 | 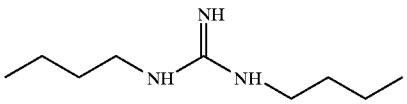 | $Cl^{\ominus}$ |
| 85 | 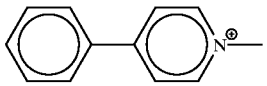 | 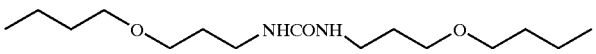 | $Cl^{\ominus}$ |

-continued

86 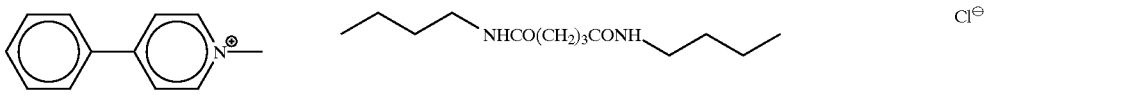

The quaternary salt compounds represented by formulae (a) to (f) according to the present invention can be easily synthesized by well-known methods, and some synthesis examples are shown below.

SYNTHESIS EXAMPLE 1

Synthesis of Exemplified Compound 3

Polyethylene glycol (average molecular weight: 2,000, 800 g), thionyl chloride (584 ml) and DMF (4 ml) were mixed at room temperature, heated at 90° C. and stirred for 5 hours. After an excess amount of thionyl chloride was distilled off, 4-phenylpyridine (372 g) was added thereto, and the reaction mixture was allowed to react for 7 hours at 150° C. The reaction mixture was made an ethyl acetate/2-propanol (10/1) solution. The solution was cooled, and the solid precipitated was filtered. The filtered solid was dried, thereby exemplified Compound 3 was obtained (854 g, yield: 62%).

SYNTHESIS EXAMPLE 2

Synthesis of Exemplified Compound 6

Polyethylene glycol (average molecular weight: 2,000, 10 g), thionyl chloride (7.3 ml) and DMF (0.1 ml) were mixed at room temperature, heated at 90° C. and stirred for 5 hours. After an excess amount of thionyl chloride was distilled off, isoquinoline (4.0 g) was added thereto, and the reaction mixture was allowed to react for 7 hours at 150° C. The reaction mixture was made an ethyl acetate/2-propanol (10/1) solution. The solution was cooled, and the solid precipitated was filtered. The filtered solid was dried, thereby exemplified Compound 6 was obtained (7.1 g, yield: 60%).

SYNTHESIS EXAMPLE 3

Synthesis of Exemplified Compound 4

Exemplified Compound 4 was obtained in the same manner as in Synthesis Example 1, except that polyethylene glycol (average molecular weight 3,000) was used in place of polyethylene glycol (average molecular weight 2,000).

SYNTHESIS EXAMPLE 4

Synthesis of Exemplified Compound 65

1,10-Diamino-4,7-dioxadecane (17.6 g, 0.1 mol), potassium carbonate (27.6 g, 0.2 mol), ethyl acetate (100 ml) and water (50 ml) were vigorously stirred at room temperature, and chloroacetyl chloride (34 g, 0.3 mol) was dropwise added thereto. The reaction solution was separated, and the ethyl acetate layer was dried with sodium sulfate and concentrated, thereby 1,10-bis(chloroacetylamino)-4,7-dioxadecane was obtained (23 g, yield: 70%). 1,10-Bis(chloroacetylamino)-4,7-dioxadecane (3.3 g) was mixed with triphenylphosphine (7.9 g) and heated at 150° C. for 5 hours. After cooling, the reaction mixture was washed with ethyl acetate three times, thereby 5.4 g (yield: 63%) of exemplified Compound 65 was obtained as a brown viscous solution.

SYNTHESIS EXAMPLE 5

Synthesis of Exemplified Compound 62

Exemplified Compound 62 was obtained in the same manner as in Synthesis Example 4, except for using 4-phenylpyridine in place of triphenylphosphine.

SYNTHESIS EXAMPLE 6

Synthesis of Exemplified Compound 71

Exemplified Compound 71 was obtained in the same manner as in Synthesis Example 4, except for using 0,0'-bis(2-aminopropyl)polyethylene glycol 800 in place of 1,10-diamino-4,7-dioxadecane, and 4-phenylpyridine in place of triphenylphosphine.

The nucleation accelerating agents of the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl Cellosolve.

Further, the nucleation accelerating agents for use in the present invention can be used in the form of an emulsification dispersion mechanically prepared according to well-known emulsification dispersion methods by dissolving using oils, such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of nucleation accelerating agents are dispersed in water using a ball mill, a colloid mill or ultrasonic wave.

The nucleation accelerating agents which can be used in the present invention are preferably added to a light-insensitive layer comprising a hydrophilic colloid layer not containing a silver halide emulsion provided on the side of the support on which a silver halide emulsion layer is provided, particularly preferably added to a light-insensitive layer comprising a hydrophilic colloid layer between the silver halide emulsion layer and the support.

The addition amount of the nucleation accelerating agents according to the present invention is preferably from $1\times10^{-6}$ to $2\times10^{-2}$ mol, more preferably from $1\times10^{-5}$ to $2\times10^{-2}$ mol, and most preferably from $2\times10^{-5}$ to $1\times10^{-2}$ mol, per mol of the silver halide. Two or more nucleation accelerating agents can be used in combination.

The silver halide in the silver halide emulsion for use in the silver halide photographic material according to the present invention is not particularly limited and any of silver chloride, silver chlorobromide, silver bromide, silver iodochlorobromide or silver iodobromide can be used but the silver halide is preferably silver chlorobromide or silver iodochlorobromide having a silver chloride content of 50 mol % or more. The form of the silver halide grain may be any of a cubic, tetradecahedral, octahedral, amorphous or plate-like form, but a cubic form is preferred. The average grain size of silver halide grains is preferably from 0.1 μm to 0.7 μm, and more preferably from 0.1 μm to 0.5 μm. With respect to the grain size distribution, grains having a narrow grain size distribution such that the variation coefficient represented by the equation [(standard deviation of the grain sizes)/(average grain size)]×100 is preferably 15% or less, more preferably 10% or less, are preferred.

The interior and the surface layer of the silver halide grains may comprise a uniform phase or different phases. The silver halide grains may have a localized layer having different halogen composition on the inside or on the surface of the grain.

The photographic emulsions which are used in the present invention can be prepared according to the methods described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964) and so on.

That is, either an acid process or a neutral process can be used. Any of a single jet method, a double jet method and a combination of these methods can be used for the reaction of a soluble silver salt with a soluble halogen salt. A method in which grains are formed in the presence of excess silver ion (a so-called reverse mixing method) can also be used.

A method in which the pAg in the liquid phase in which the silver halide is formed is maintained constant, that is, the controlled double jet method, can also be used as one type of the double jet method. In addition, the grain formation is preferably carried out using silver halide solvents such as ammonia, thioether, or tetra-substituted thiourea. More preferred compounds are tetra-substituted thiourea compounds and they are disclosed in JP-A-53-82408 and JP-A-55-77737. Preferred thiourea compounds are tetramethylthiourea and 1,3-dimethyl-2-imidazolidinethione. The addition amount of silver halide solvent varies according to the kind of the compound to be used, the objective grain size and the halogen composition, but is preferably from $10^{-5}$ to $10^{-2}$ mol per mol of the silver halide.

Silver halide emulsions with a regular crystal form and a narrow grain size distribution can easily be obtained by the controlled double jet method and the grain formation method using silver halide solvents, which is effective to prepare the silver halide emulsion for use in the present invention.

Further, the method in which the rates of addition of the silver nitrate and the alkali halide are varied according to the grain growth rate as disclosed in British Patent 1,535,016, JP-B-48-36890 and JP-B-52-16364, and the method in which the concentrations of the aqueous solutions are varied as disclosed in British Patent 4,242,445 and JP-A-55-158124 are preferably and effectively used to rapidly grow grains within the range not exceeding the critical degree of saturation in order to provide uniform grain size.

The silver halide emulsion for use in the present invention may contain metals belonging to group VIII of the Periodic Table. In particular, it is preferred to contain a rhodium compound, an iridium compound and a ruthenium compound for attaining high contrast and low fog. Further, doping with hexacyanide metal complex, e.g., $K_4[Fe(CN)_6]$, $K_4[Ru(CN)_6]$ and $K_3[Cr(CN)_6]$ is advantageous for higher sensitization.

Water-soluble rhodium compounds can be used as a rhodium compound for use in the present invention, e.g., rhodium(III) halide compounds, or rhodium complex salts having halogen, amines, oxalato or aquo as a ligand, such as hexachlororhodium(III) complex salts, pentachloroaquorhodium complex salts, tetrachlorodiaquorhodium complex salts, hexabromorhodium(III) complex salts, hexaaminerhodium(III) complex salts, trioxalatorhodium (III) complex salts. These rhodium compounds are dissolved in water or an appropriate solvent for use. Well-known methods, e.g., a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of rhodium compound can be used. It is also possible to add and dissolve other silver halide grains which have been doped in advance with rhodium during the preparation of silver halide instead of using water-soluble rhodium.

Rhenium, ruthenium and osmium for use in the present invention are added in the form of water-soluble complex salts as disclosed in JP-A-63-2042, JP-A-1-285941, JP-A-2-20852 and JP-A-2-20855. Particularly preferred compounds are six coordinated complexes represented by the following formula:

$$[ML_6]^{n-}$$

wherein M represents Ru, Re or Os, L represents a ligand, and n represents 0, 1, 2, 3 or 4. In this case, counter ions are not important and ammonium or alkali metal ions are used. The examples of preferred ligands include a halide ligand, a cyanide ligand, a cyanogen oxide ligand, a nitrosyl ligand, and a thionitrosyl ligand. The specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | |
| $[Re(O)_2(CN)_4]^{3-}$ | | |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |
| $[Ru(CO)Cl_5]^{2-}$ | $[Ru(CO)Br_5]^{2-}$ | |
| $[OsCl_6]^{3-}$ | $[OsCl_5(NO)]^{2-}$ | |
| $[Os(NO)(CN)_5]^{2-}$ | | |
| $[Os(NS)Br_5]^{2-}$ | $[Os(CN)_6]^{4-}$ | |
| $[Os(O)_2(CN)_4]^{4-}$ | | |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

Hexachloroiridium, hexabromoiridium, hexaammineiridium and pentachloronitrosyliridium can be used as an iridium compound in the present invention. As an iron compound for use in the present invention, potassium hexacyanoferrate(II) and ferrous thiocyanate can be exemplified.

The silver halide emulsions for use in the present invention are preferably chemically sensitized. Well-known chemical sensitization methods such as sulfur sensitization, selenium sensitization, tellurium sensitization and noble metal sensitization can be used alone or in combination. When sensitization is used in combination, a combination of sulfur sensitization and gold sensitization, a combination of sulfur sensitization, selenium sensitization and gold sensitization, and a combination of sulfur sensitization, tellurium sensitization and gold sensitization are preferred.

The sulfur sensitization for use in the present invention is usually performed by adding a sulfur sensitizer and stirring the emulsion at high temperature of 40° C. or more for a certain period of time. Various known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The specific tetra-substituted thiourea compounds disclosed in U.S. Pat. No. 4,810,626 are particularly preferred. The addition amount of a sulfur sensitizer is varied in accordance with various conditions such as the pH and temperature during chemical ripening and the grain size of silver halide grains, but is preferably from $10^{-7}$ to $10^{-2}$ mol and more preferably from $10^{-5}$ to $10^{-3}$ mol, per mol of the silver halide.

Various well-known selenium compounds can be used as a selenium sensitizer in the present invention. The selenium sensitization is usually performed by adding labile and/or non-labile selenium compounds and stirring the emulsion at high temperature, preferably 40° C. or more, for a certain period of time. The compounds disclosed in JP-B-44-15748, JP-B-43-13489, JP-A-4-109240 and JP-A-4-324855 can be used as labile selenium compounds. The compounds represented by formulae (VIII) and (IX) disclosed in JP-A-4-324855 are particularly preferably used.

The tellurium sensitizer for use in the present invention is a compound which forms silver telluride in the surfaces or interiors of silver halide grains which silver telluride is presumed to become sensitization speck. The formation rate of the silver telluride in the silver halide emulsion can be examined according to the method disclosed in JP-A-5-313284.

The specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.*, 635 (1980), *ibid.*, 1102 (1979), *ibid.*, 645 (1979), *J. Chem. Soc. Perkin. Trans.*, 1, 2191 (1980), S. Patai compiled, *The Chemistry of Organic Selenium and Tellurium Compounds*, Vol. 1 (1986), and *ibid.*, Vol. 2 (1987). The compounds represented by formulae (II), (III) and (IV) disclosed in JP-A-4-324855 are particularly preferred.

The amount of the selenium and tellurium sensitizers for use in the present invention varies in accordance with the silver halide grains used and the conditions of chemical ripening, but is generally about $10^{-8}$ to $10^{-2}$ mol, preferably about $10^{-7}$ to $10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, palladium and iridium, and gold sensitization is particularly preferred. The specific examples of the gold sensitizers for use in the present invention include chloroauric acid, potassium chloroaurate, potassium aurithiocyanate and gold sulfide, and the amount of about $10^{-7}$ to $10^{-2}$ mol per mol of the silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in European Patent 293917.

The silver halide emulsion in the photographic material of the present invention may be one kind, or two or more kinds of silver halide emulsions (for example, those differing in average grain sizes, differing in halogen compositions, differing in crystal habits, differing in chemical sensitization conditions, or differing in sensitivities) may be used in combination. For obtaining high contrast, as disclosed in JP-A-6-324426, it is preferred to coat the higher sensitivity emulsion nearer the support as far as possible.

The light-sensitive silver halide emulsion of the present invention may be spectrally sensitized using a sensitizing dye to a relatively long wavelength blue light, green light, red light and infrared light. The compound represented by formula (I) disclosed in JP-A-55-45015 and the compound represented by formula (I) disclosed in JP-A-9-160185 are preferred, in particular, the compound represented by formula (I) disclosed in JP-A-9-160185 is preferred. Specifically, Compound (1) to (19) disclosed in JP-A-55-45015, Compounds I-1 to I-40 and I-56 to I-85 disclosed in JP-A-9-160185 can be exemplified.

Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used.

Other useful sensitizing dyes for use in the present invention are described in *Research Disclosure*, No. 17643, Item IV-A, p. 23 (December, 1978), *ibid.*, No. 18341, Item X, p. 437 (August, 1979) or the literature cited therein.

In particular, sensitizing dyes having spectral sensitivity suitable for spectral characteristics of light sources of various scanners, image setters and plate-making cameras can be advantageously selected.

The following sensitizing dyes can be advantageously selected, for example, A) for an argon laser light source, Compounds (I)-1 to (I)-8 disclosed in JP-A-60-162247, Compounds I-1 to I-28 in JP-A-2-48653, Compounds I-1 to I-13 in JP-A-4-330434, the compounds disclosed in Example 1 to Example 14 in U.S. Pat. No. 2,161,331, and Compounds 1 to 7 in West German Patent 936,071, B) for a helium-neon laser light source, Compounds I-1 to 1-38 disclosed in JP-A-54-18726, Compounds I-1 to I-35 in JP-A-6-75322, and Compounds I-1 to 1-34 in JP-A-7-287338, C) for an LED light source, Dyes 1 to 20 disclosed in JP-B-55-39818, Compounds I-1 to I-37 in JP-A-62-284343, and Compounds I-1 to I-34 in JP-A-7-287338, D) for a semiconductor laser light source, Compounds I-1 to I-12 disclosed in JP-A-59-191032, Compounds I-1 to I-22 in JP-A-60-80841, Compounds I-1 to I-29 in JP-A-4-335342, and Compounds I-1 to I-18 in JP-A-59-192242, and E) for tungsten and xenon light sources for a plate-making camera, besides the above compounds, Compounds I-41 to I-55 and Compounds 1-86 to I-97 disclosed in JP-A-9-160185, and Compounds 4-A to 4-S, Compounds 5-A to 5-Q, and Compounds 6-A to 6-T in JP-A-6-242547.

These sensitizing dyes may be used either alone or in combination of them. A combination of sensitizing dyes is often used, in particular, for the purpose of supersensitization. There may be contained in an emulsion together with sensitizing dyes, a dye having no spectral sensitizing function by itself or a material which does not substantially absorb visible light but shows supersensitization.

A combination of useful sensitizing dyes and dyes showing supersensitization and materials showing supersensitization are disclosed in *Research Disclosure* Vol. 176, No.

17643, Item IV-J, page 23, (December, 1978), the above-described JP-B-49-25500, JP-B-43-4933, JP-A-59-19032 and JP-A-59-192242.

The sensitizing dyes for use in the present invention may be used in combination of two or more. For the addition of the sensitizing dyes in a silver halide emulsion, they may be directly dispersed in the emulsion, or they may be dissolved in water, a single or mixed solvent of methanol, ethanol, propanol, acetone, methyl Cellosolve, 2,2,3,3-tetrafluoropropanol, 2,2,2-trifluoroethanol, 3-methoxy-1-propanol, 3-methoxy-1-butanol, 1-methoxy-2-propanol, and N,N-dimethylformamide, then added to the emulsion.

In addition, various methods can be used for adding sensitizing dyes to an emulsion, for example, a method of dissolving sensitizing dyes in a volatile organic solvent, dispersing the solution in water or hydrophilic colloid and adding the dispersion to an emulsion as disclosed in U.S. Pat. No. 3,469,987, a method of dissolving sensitizing dyes in an acid and adding the solution to an emulsion, or adding sensitizing dyes to an emulsion as an aqueous solution coexisting with an acid or abase as disclosed in JP-B-44-23389, JP-B-44-27555 and JP-B-57-22091, a method of adding dyes to an emulsion as an aqueous solution or a colloidal dispersion coexisting with a surfactant as disclosed in U.S. Pat. Nos. 3,822,135 and 4,006,025, a method of directly dispersing dyes in a hydrophilic colloid and adding the dispersion to an emulsion as disclosed in JP-A-53-102733 and JP-A-58-105141, and a method of dissolving dyes using a compound capable of red-shifting and adding the solution to an emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion recognized as useful hitherto. For example, they may be added at any stage if it is before coating of the emulsion, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, alternatively one part is added prior to chemical ripening or during ripening stage and the remaining after completion of chemical ripening. The kinds of compounds added separately and combinations of compounds may be varied.

The addition amount of the sensitizing dyes for use in the present invention is varied in accordance with the shape, size and halide composition of the silver halide grain, the method and degree of chemical sensitization, and the kind of antifoggant, but they can be used in an amount of from $4\times10^{-6}$ to $8\times10^{-3}$ mol per mol of the silver halide. For example, when the grain size of the silver halide grains is from 0.2 to 1.3 $\mu$m, the addition amount is preferably from $2\times10^{-7}$ to $3.5\times10^{-6}$ mol and more preferably from $6.5\times10^{-7}$ to $2\times10^{-6}$ mol per $m^2$ of the surface area of the silver halide grains.

There is no particular limitation on various additives for use in the present invention and, for example, those described in the following places can preferably be used.

Polyhydroxybenzene Compound:

Line 11, right lower column, page 10 to line 5, left lower column, page 12 of JP-A-3-39948, specifically Compounds (III)-1 to (III)-25 disclosed in the same patent.

Compound Which Substantially does not have Absorption Maximum in Visible Region:

The compound represented by formula (I) disclosed in JP-A-1-118832, specifically Compounds I-1 to I-26 in the same patent.

Antifoggant:

Line 19, right lower column, page 17 to line 4, right upper column, page 18 of JP-A-2-103536.

Polymer Latex:

Line 12, left lower column, page 18 to line 20, left lower column of the same page of JP-A-2-103536, the polymer latex having an active methylene group represented by formula (I) disclosed in JP-A-9-179228, specifically Compounds I-1 to I-16of the same patent, the polymer latex having a core/shell structure disclosed in JP-A-9-179228, specifically Compounds P-1 to P-55 of the same patent, and the acidic polymer latex disclosed in line 1, left column, page 14 to line 30, right column of the same page of JP-A-7-104413, specifically Compounds II-1) to II-9) on page 15 of the same patent.

Matting Agent, Sliding Agent and Plasticizer:

Line 15, left upper column, page 19 to line 15, right upper column of the same page of JP-A-2-103536.

Hardening Agent:

Line 5, right upper column, page 18 to line 17, right upper column of the same page of JP-A-2-103536.

Compound Having Acidic Group:

Line 6, right lower column, page 18 to the first line, left upper column, page 19 of JP-A-2-103536.

Electrically Conductive Material:

Line 13, left lower column, page 2 to line 7, right upper column, page 3 of JP-A-2-18542, specifically metallic oxides in line 2, right lower column, page 2 to line 10, right lower column of the same page, and electrically conductive high polymer Compounds P-1 to P-7 disclosed in the same patent.

Water-soluble Dye:

First line, right lower column, page 17 to line 18, right upper column of the same page of JP-A-2-103536.

Solid Dispersion Dye:

Compounds represented by formulae (FA), (FA1), (FA 2) and (FA 3) disclosed in JP-A-9-179243, specifically Compounds F1 to F-34 in the same patent; Compounds (II-2) to (II-24) disclosed in JP-A-7-152112; Compounds (III-5) to (III-18) disclosed in JP-A-7-152112; Compounds (IV-2) to (IV-7) disclosed in JP-A-7-152112; and the compounds disclosed in JP-A-2-294638 and JP-A-5-11382.

Redox Compound:

The redox compound capable of releasing a development inhibitor by oxidation disclosed in JP-A-5-274816, preferably the redox compound represented by any of formulae (R-1), (R-2) and (R-3), specifically Compounds R-1 to R-68 in the same patent.

Binder:

From the first line to line 20, right lower column, page 3 of JP-A-2-18542.

The swelling rate of the hydrophilic colloid layers including emulsion layers and protective layers of the silver halide photographic material according to the present invention is preferably from 80 to 150%, more preferably from 90 to 140%. The swelling rate of the hydrophilic colloid layers is obtained according to the following equation by measuring the thickness of the hydrophilic colloid layers ($d_0$) including emulsion layers and protective layers of the silver halide photographic material, immersing the silver halide photographic material in distilled water of 25° C. for 1 minute and determining the swollen thickness (Δd).

$$\text{Swelling factor } (\%)=(\Delta d+d_0)\times 100$$

The film surface pH of the side of the silver halide photographic material on which a silver halide emulsion layer is provided is from 4.5 to 7.5, preferably from 4.8 to 6.0.

As the support which can be used in the present invention, for example, baryta paper, polyethylene-laminated paper, polypropylene synthetic paper, glass sheet, cellulose acetate, cellulose nitrate, and polyester films, e.g., polyethylene terephthalate can be exemplified. These supports are arbitrarily selected in accordance with the use purpose of the silver halide photographic material.

A support comprising a styrene-based polymer having a syndiotactic structure as disclosed in JP-A-7-234478 and U.S. Pat. No. 5,558,979 is also preferably used in the present invention.

Processing agents such as a developing solution and a fixing solution and processing methods according to the present invention are described below but the present invention should not be construed as being limited to the following description and specific examples.

Any well-known methods and well-known development processing solutions can be used in the development process of the present invention.

A developing agent for use in a developing solution (a developing starter (i.e., a development starting solution) and a developing replenisher are hereinafter referred to as a developing solution collectively) according to the present invention is not particularly limited, but it is preferred for the developing solution to contain dihydroxybenzenes, ascorbic acid derivatives and hydroquinonemonosulfonate, alone or in combination. In particular, it is preferred to contain a dihydroxybenzene developing agent and an auxiliary developing agent exhibiting superadditivity, and the combination of dihydroxybenzenes or ascorbic acid derivatives with 1-phenyl-3-pyrazolidones, and the combination of dihydroxybenzenes or ascorbic acid derivatives with p-aminophenols can be exemplified.

Dihydroxybenzene developing agents for use in the present invention include hydroquinone, chlorohydroquinone, isopropylhydroquinone, and methylhydroquinone. Hydroquinone is particularly preferred. Further, ascorbic acid derivative developing agents include ascorbic acid, isoascorbic acid, and salts of them, and sodium erythorbate is particularly preferred from the economical point of the material.

1-Phenyl-3-pyrazolidones or derivatives thereof as a developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol based developing agents for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino) phenol, and among these, N-methyl-p-aminophenol and the aminophenols disclosed in JP-A-9-297377 and JP-A-9-297378 are preferred.

A dihydroxybenzene developing agent is generally preferably used in an amount of from 0.05 to 0.8 mol/liter. When dihydroxybenzenes are used in combination with 1-phenyl-3-pyrazolidones or p-aminophenols, the amount used of the former is from 0.05 to 0.6 mol/liter, preferably from 0.10 to 0.5 mol/liter, and the latter is 0.06 mol/liter or less, preferably from 0.03 to 0.003 mol/liter.

Ascorbic acid derivative developing agents are generally preferably used in an amount of from 0.01 to 0.5 mol/liter, more preferably from 0.05 to 0.3 mol/liter. Further, when ascorbic acid derivatives are used in combination with 1-phenyl-3-pyrazolidones or p-aminophenols, the amount used of ascorbic acid derivatives is preferably from 0.01 to 0.5 mol/liter, and that of 1-phenyl-3-pyrazolidones or p-aminophenols is preferably from 0.005 to 0.2 mol/liter.

A developing solution for processing a photographic material in the present invention can contain additives generally used (e.g., a developing agent, an alkali agent, a pH buffer, a preservative, a chelating agent, etc.). The specific examples of these additives are shown below but the present invention is not limited thereto.

A buffer which is used in a developing solution for development processing a photographic material in the present invention includes carbonate, boric acids disclosed in JP-A-62-186259, saccharides (e.g., saccharose) disclosed in JP-A-60-93433, oximes (e.g., acetoxime), phenols (e.g., 5-sulfosalicylic acid) and tertiary phosphate (e.g., sodium salt and potassium salt), and carbonate and boric acid are preferably used. The use amount of a buffer, in particular the amount of carbonate, is preferably 0.1 mol/liter or more, particularly preferably from 0.2 to 1.5 mol/liter.

The examples of the preservatives for use in the present invention include sodium sulfite, potassium sulfite, lithium sulfite, ammonium sulfite, sodium bisulfite, potassium metabisulfite, and sodium formaldehyde bisulfite. The preferred addition amount of the sulfite preservative is 0.2 mol/liter or more, particularly preferably 0.3 mol/liter or more, but as too much an amount causes silver contamination of the developing solution, the upper limit is preferably 1.2 mol/liter, particularly preferably from 0.35 to 0.7 mol/liter.

A small amount of ascorbic acid derivatives may be used in combination with sulfite as a preservative for dihydroxybenzene developing agents. The use of sodium erythorbate is economically preferred. The addition amount of ascorbic acid derivatives is preferably from 0.03 to 0.12, particularly preferably from 0.05 to 0.10, in molar ratio to dihydroxybenzene developing agent. When ascorbic acid derivatives are used as a preservative, it is preferred not to contain boron compounds in the developing solution.

Additives which can be used in the present invention include, besides the above compounds, a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives of them; and a physical development unevenness inhibitor such as a heterocyclic mercapto compound (e.g., sodium 3-(5-mercaptotetrazol-1-yl)benzenesulfonate, 1-phenyl-5-mercaptotetrazole) and the compounds disclosed in JP,-A-62-212651.

Further, mercapto compounds, indazole compounds, benz 6triazole compounds and benzimidazole compounds can be used as an antifoggant or a black pepper inhibitor. The specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butane-sulfonate, 5-amino-1,3,4-thiadiazole-2-thiol, methylbenzotriazole, 5-methylbenzotriazole, and 2-mercaptobenzotriazole. The addition amount of these compounds is, in general, from 0.01 to 10 mmol, more preferably from 0.1 to 2 mmol, per liter of the developing solution.

Further, various kinds of organic and inorganic chelating agents can be used alone or in combination in the developing solution of the present invention.

The examples of inorganic chelating agents include sodium tetrapolyphosphate and sodium hexametaphosphate.

On the other hand, as organic chelating agents, organic carboxylic acid, aminopolycarboxylic acid, organic phosphonic acid, aminophosphonic acid, and organic phosphonocarboxylic acid can be primarily used.

The examples of organic carboxylic acids include acrylic acid, oxalic acid, malonic acid, succinic acid, glutaric acid, gluconic acid, adipic acid, pimelic acid, aci-elaidic acid, sebacic acid, nonanedicarboxylic acid, decanedicarboxylic acid, undecanedicarboxylic acid, maleic acid, itaconic acid, malic acid, citric acid, and tartaric acid.

The examples of aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

The examples of organic phosphonic acids include the hydroxyalkylidene-diphosphonic acids disclosed in U.S. Pat. Nos. 3,214,454, 3,794,591 and West German Patent (OLS) 2,227,639, and the compounds disclosed in *Research Disclosure*, Vol. 181, Item 18170 (May, 1979).

The examples of aminophosphonic acids include aminotris (methylenephosphonic acid), ethylenediaminetetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

The examples of organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, JP-A-55-65956 and *Research Disclosure*, No. 18170.

These organic and/or inorganic chelating agents are not limited to the above-described compounds and they may be used in the form of alkali metal salts or ammonium salts. The addition amount of these chelating agents is preferably from $1\times10^{-4}$ to $1\times10^{--1}$ mol, more preferably from $1\times10^{-3}$ to $1\times10^{-2}$ mol, per liter of the developing solution.

Further, as a silver contamination preventing agent, the developing solution can contain the compounds disclosed in JP-A-56-24347, JP-B-56-46585, JP-B-62-2849, JP-A-4-362942 and JP-A-8-6215, triazine having one or more mercapto groups (e.g., the compounds disclosed in JP-B-6-23830, JP-A-3-282457, JP-A-7-175178), pyrimidine having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds disclosed in JP-A-9-274289), pyridine having one or more mercapto groups (e.g., 2-mercaptopyridine, 2,6-dimercaptopyridine, 3,5-dimercaptopyridine, 2,4,6-trimercaptopyridine, the compounds disclosed in JP-A-7-248587), pyrazine having one or more mercapto groups (e.g., 2-mercaptopyrazine, 2,6-dimercaptopyrazine, 2,3-dimercaptopyrazine, 2,3,5-trimercaptopyrazine), pyridazine having one or more mercapto groups (e.g., 3-mercaptopyridazine, 3,4-dimercaptopyridazine, 3,5-dimercaptopyridazine, 3,4,6-trimercaptopyridazine), the compounds disclosed in JP-A-7-175177, andpolyoxyalkylphosphonate disclosed in U.S. Pat. No. 5,457,011. These silver contamination preventing agents can be used alone or in combination of two or more, and they are used in an amount of preferably from 0.05 to 10 mmol, more preferably from 0.1 to 5 mmol, per liter of the developing solution.

Further, the compounds disclosed in JP-A-61-267759 can be used as a dissolution aid.

Further, if necessary, the developing solution may contain a toning agent, a surfactant, a defoaming agent and a hardening agent.

The pH of the developing solution is preferably from 9.0 to 10.8, particularly preferably from 9.0 to 11.0, and still more preferably from 9.5 to 11.0. As an alkali agent which is used for adjusting pH, water-soluble inorganic alkali metal salts generally used (e.g., sodium hydroxide, potassium hydroxide, sodium carbonate, potassium carbonate) can be used.

As the cation in a developing solution, a potassium ion does not inhibit development so much as a sodium ion does, and provides less fringes around the blackened part compared with a sodium ion. Further, when a developing solution is preserved as a concentrated solution, a potassium salt has, in general, higher solubility and preferred. However, since a potassium ion in a fixing solution inhibits fixation in the same degree as a silver ion does, if the potassium ion concentration in a developing solution is high, the potassium ion concentration in a fixing solution becomes high by the developing solution carried over with a photographic material, which is not preferred. Accordingly, the molar ratio of a potassium ion to a sodium ion in a developing solution is preferably between 20/80 and 80/20. The ratio of a potassium ion to a sodium ion in a developing solution can be arbitrarily adjusted within the above range by the counter cation of a pH buffer, a pH adjustor, a preservative, a chelating agent, etc.

The replenishing rate of a developing solution is generally 390 ml or less, preferably from 30 to 325 ml, and most preferably from 120 to 250 ml, per $m^2$ of the photographic material. The composition and/or the concentration of a developing replenisher may be the same as or different from those of a developing starter.

Ammonium thiosulfate, sodium thiosulfate and sodium ammonium thiosulfate can be used as the fixing agent of fixing processing chemicals in the present invention. The use amount of the fixing agent can be varied arbitrarily and is generally from about 0.7 to about 3.0 mol/liter.

The fixing solution according to the present invention may contain a water-soluble aluminum salt and a water-soluble chromium salt having a function as a hardening agent. Preferred compounds are a water-soluble aluminum salt, e.g., aluminum chloride, aluminum sulfate, potassium alum, ammonium aluminum sulfate, aluminum nitrate, and aluminum lactate. They are preferably contained in an amount of from 0.01 to 0.15 mol/liter in terms of an aluminum ion concentration in the working solution.

When the fixing solution is preserved as a concentrated solution or a solid agent, it may comprise a plurality of parts with a hardening agent being a separate part or it may comprise one part type including all the components.

The fixing processing chemicals (i.e., the fixing processing agents) can contain, if desired, a preservative (e.g., sulfite, bisulfite or metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid, and adipic acid, in an amount of from 0.1 mol/liter to 1 mol/liter, preferably from 0.2 mol/liter to 0.7 mol/liter), and a compound having stabilizing ability of aluminum and hard water softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts of these compounds, saccharides and boricacid in an amount of from 0.001 mol/liter to 0.5 mol/liter, preferably from 0.005 mol/liter to 0.3 mol/liter).

The fixing processing chemicals can contain, if desired, the compounds disclosed in JP-A-62-78551, a pH adjustor (e.g., sodium hydroxide, ammonia, sulfuric acid), a surfactant, a wetting agent, and a fixing accelerator. The specific examples of surfactants include an anionic surfactant (e.g., a sulfated product, a sulfonated product) a polyethylene surfactant, and amphoteric surfactants disclosed in JP-A-57-6840, and well-known defoaming agents can also be used. The specific examples of the wetting agents include alkanolamine and alkylene glycol. The specific examples of the fixing accelerators include alkyl- and aryl-substituted thiosulfonic acid and salts of them, thiourea derivatives disclosed in JP-B-45-35754, JP-B-58-122535 and JP-B-58-122536, an alcohol having a triple bond in the molecule, thioether compounds disclosed in U.S. Pat. No. 4,126,459, mercapto compounds disclosed in JP-A-1-4739, JP-A-1-159645 and JP-A-3-101728, mesoionic compounds disclosed in JP-A-4-170539, and thiocyanate.

The pH of the fixing solution for use in the present invention is preferably 4.0 or more and more preferably from 4.5 to 6.0. The pH of the fixing solution rises according to processing by the mixture of a developing solution. In such a case the pH of a hardening fixing solution is 6.0 or less, preferably 5.7 or less, and that of a non-hardening fixing solution is 7.0 or less, preferably 6.7 or less.

The replenishing rate of the fixing solution is preferably 500 ml/m$^2$ or less, more preferably 390 ml/m$^2$ or less, and still more preferably from 80 to 320 ml/m$^2$, of the photographic material processed. The compositions and/or the concentration of the fixing replenisher may be the same as or different from those of the fixing starter (i.e., the fixation starting solution).

Silver recovery from a fixing solution can be carried out according to well-known fixing solution reclaiming methods, such as electrolytic silver recovery, and the regenerated solution after the silver recovery can be used in the present invention. As such a reclaiming device, Reclaim R-60 produced by Fuji Hunt Co., Ltd. can be used.

Further, the removal of dyes using an adsorptive filter such as an activated carbon is also preferred.

When the developing and fixing processing chemicals of the present invention are solutions, they are preferably preserved in packaging materials of low oxygen permeation as disclosed in JP-A-61-73147. Further, when these solutions are concentrated solutions, they are diluted with water to a predetermined concentration in the ratio of from 0.2 to 3 parts of water to one part of the concentrated solutions.

If the developing processing chemicals and fixing processing chemicals of the present invention are solids, the same effects as solutions can be obtained. Solid (processing) chemicals (i.e., Solid agents) are described below.

Solid chemicals (i.e., Solid agent) for use in the present invention may be made into well-known shapes such as powders, granular powders, granules, lumps, tablets, compactors, briquettes, sheets, bars or paste. These solid chemicals may be covered with water-soluble coating agents or films to separate components which react with each other on contact, or they may comprise a multilayer structure to separate components which react with each other, or both types may be used in combination.

Well-known coating agents and auxiliary granulating agents can be used, but polyvinyl pyrrolidone, polyethylene glycol, polystyrene sulfonic acid and vinyl compounds are preferred. Line 48, column 2 to line 13, column 3 of JP-A-5-45805 can be referred to.

When a multilayer structure is used, components which do not react with each other on contact may be sandwiched with components which react with each other and made into tablets and briquettes, or components of well-known shapes may be made to similar layer structure and packaged. These methods are disclosed in JP-A-61-259921, JP-A-4-16841, JP-A-4-78848 and JP-A-5-93991.

The bulk density of the solid processing chemicals is preferably from 0.5 to 6.0 g/cm$^3$, in particular, the bulk density of tablets is preferably from 1.0 to 5.0 g/cm$^3$ and that of granules is preferably from 0.5 to 1.5 g/cm$^3$.

Solid processing chemicals can be produced using any known method, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605 and JP-A-8-286329 can be referred to.

Specifically, a rolling granulating method, an extrusion granulating method, a compression granulating method, a cracking granulating method, a stirring granulating method, a spray drying method, a dissolution coagulation method, a briquetting method, and a roller compacting method can be used.

The solubility of the solid chemicals can be adjusted by changing the state of the surface (smooth, porous, etc.) and the thickness partially, or making the shape to a hollow doughnut type. Further, it is possible to provide different solubilities to a plurality of granulated products, or it is also possible for materials having different solubilities to take various shapes to coincide with solubilities of them. Multilayer granulated products having different compositions between the inside and the surface can also be used.

Packaging materials of solid chemicals preferably have low oxygen and water permeabilities and bag-like, cylindrical and box-like shapes can be used. Packaging materials of foldable shapes are preferred for saving storage space of waste materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, a pull-top or an aluminum seal, or packaging materials may be heat-sealed, or other known types may be used, and there are no particular limitations. Waste packaging materials are preferred to be recycled for reclaiming or reused from the environmental protection.

Methods of dissolution and replenishment of the solid processing chemicals are not particularly limited and known methods can be used. The examples of these known methods include a method in which a certain amount of processing chemicals are dissolved and replenished by a dissolving device having a stirring function, a method in which processing chemicals are dissolved by a dissolving device having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank equipped in an automatic processor in proportion to the progress of the processing of photographic materials as disclosed in JP-A-5-119454, JP-A-6-19102 and JP-A-7-261357. In addition to the above methods, any of well-known methods can be used. Feeding of processing chemicals may be conducted manually, or automatic opening and automatic feeding may be performed by a dissolving device or an automatic processor provided with opening mechanism as disclosed in JP-A-9-138495. The latter is preferred from the work environment. Specifically, there are methods of pushing through, unsealing, cutting off, and bursting the takeout port of a package, and methods disclosed in JP-A-6-19102 and JP-A-6-95331.

A photographic material is subjected to washing or stabilizing processing after being development processed and fixing processed (hereinafter washing includes stabilization processing and the solution used therefor is called water or washing water unless otherwise indicated) The water which is used for washing may be any of city water, ion exchange water, distilled water, and stabilizing solution. The replenishing rate thereof is, in general, from about 8 liters to about 17 liters per $m^2$ of the photographic material, but washing can be carried out with the less replenishing rate. In particular, with a replenishing rate of 3 liters or less (including zero, i.e., washing in a reservoir), not only water saving processing can be carried out but also piping for installation of an automatic processor is not required. When washing is carried out with a reduced amount of water, it is preferred to use a washing tank equipped with a squeegee roller or a crossover roller disclosed in JP-A-63-18350 and JP-A-62-287252. The addition of various kinds of oxidizing agents (e.g., ozone, hydrogen peroxide, sodium hypochlorite, activated halogen, chlorine dioxide, sodium carbonate peroxyhydrate) may be combined with filtration by filters to reduce load in environmental pollution which becomes a problem when washing is performed with a small amount of water and to prevent generation of scale.

As a means of reducing the replenishing rate of the washing water, a multistage countercurrent system (e.g., two stages or three stages) has been known. The replenishing rate of the washing water in this system is preferably from 50 to 200 ml per $m^2$ of the photographic material. This is also effective in an independent multistage system (a method which is not a countercurrent system and fresh solution is replenished separately to multistage washing tanks).

Further, a means of preventing generation of scale may be provided in a washing process. A means of preventing generation of scale is not particularly limited and well-known methods can be used, e.g., a method of adding antimold agents (a scale preventive), a method by electroconduction, a method of irradiating ultraviolet rays or infrared rays and far infrared rays, a method of making the magnetic field, a method by ultrasonic wave processing, a method by heating, and a method of emptying tanks when they are not used. These scale preventing means may be conducted in proportion to the progress of the processing of photographic materials, may be conducted at regular intervals irrespective of usage conditions, or may be conducted only during the time when processing is not conducted, for example, during night. In addition, washing water previously provided with such a means may be replenished. It is also preferred to perform different scale preventing means for every given period of time for inhibiting the proliferation of resisting fungi.

An antimold agent is not particularly restricted and known antimold agents can be used. The examples include, e.g., a chelating agent such as glutaraldehyde and aminopolycarboxylic acid, cationic surfactants, and mercaptopyridine oxide (e.g., 2-mercaptopyridine-N-oxide), in addition to the above-described oxidants, and they can be used alone or in combination of two or more.

Methods by electroconduction disclosed in JP-A-3-224685, JP-A-3-224687, JP-A-4-16280 and JP-A-4-18980 can be used in the present invention.

Moreover, well-known water-soluble surfactants and defoaming agents may be contained in washing water for preventing generation of irregulars due to foaming and transfer of stains. In addition, dye-adsorbents disclosed in JP-A-63-163456 may be used in a washing tank to inhibit contamination by dyes eluted out from photographic materials.

All or a part of the overflow from the washing process can be utilized by mixture in the processing solution having fixing ability as disclosed in JP-A-60-235133. It is also preferred from the environmental protection for a washing solution to be processed by various processes before draining, e.g., biochemical oxygen demand (BOD), chemical oxygen demand (COD) and iodine consumption are reduced by a microorganism process (e.g., processes using sulfur oxide fungus and activated sludge, a process using a filter of a porous carrier, such as activated carbon or ceramic carrying microorganisms) and an oxidation process by electroconduction and oxidants, or silver is precipitated by adding a compound which forms a hardly soluble silver complex such as trimercaptotriazine and filtrated using a filter of a polymer having affinity with silver to reduce the silver concentration in water drained.

When a photographic material is subjected to stabilizing processing after washing processing, a bath containing the compounds disclosed in JP-A-2-201357, JP-A-2-132435, JP-A-1-102553 and JP-A-46-44446 may also be used as a final bath. This stabilizing bath may also contain, if desired, ammonium compounds, metal compounds such as Bi and Al, brightening agents, various kinds of chelating agents, film pH adjustors, hardening agents, sterilizers, antimold agents, alkanolamines, and surfactants.

Additives such as antimold agents and stabilizing agents which are added to a washing bath and a stabilizing bath can also be solid agents the same as the above-described developing and fixing processing chemicals.

Waste solutions of the developing solution, fixing solution, washing water and stabilizing solution for use in the present invention are preferably subjected to incineration disposal. It is also possible to discard these waste solutions as concentrated solutions concentrated by concentrators as disclosed in JP-B-7-83867 and U.S. Pat. No. 5,439,560, or as solids.

In the case when the replenishing rate is reduced, it is preferred to prevent evaporation and air oxidation of the solution by minimizing the open area of the processing tank. Roller transporting type automatic processors are disclosed in U.S. Pat. Nos. 3,025,779 and 3,545,971 and they are referred to as merely roller transporting type processors in the specification of the present invention. These roller transporting type processors comprise four steps of development, fixation, washing and drying and, although the method of the present invention does not exclude other steps (e.g., stopping step), it is most preferred to follow this four step system. Further, a rinsing bath may be provided between development and fixation and/or between fixation and washing.

Development processing according to the present invention is preferably performed by development processing of dry to dry of from 25 to 160 seconds, with development and fixing time being 40 seconds or less, preferably from 6 to 35 seconds, the temperature of each processing solution being from 25 to 50° C., preferably from 30 to 40° C. The temperature and time of washing is preferably from 0 to 50° C. and 40seconds or less, respectively. According to the method of the present invention, photographic materials having been developed, fixed and washed may be dried after the water content is squeezed out of the materials, that is, through squeegee rollers. The drying step is performed at a temperature of from about 40 to about 100° C. and the time can be varied properly depending upon the surroundings. Drying methods are not particularly restricted and any known methods can be used, such as a warm air drying method, the heated roller drying method and the far infrared ray drying method as disclosed in JP-A-4-15534, JP-A-5-2256 and JP-A-5-289294 and a plurality of methods can be used in combination.

The present invention is described in detail below with reference to the specific examples, but the present invention should not be construed as being limited thereto.

EXAMPLE 1

Preparation of Emulsion A

Solution 1

| | |
|---|---|
| Water | 750 ml |
| Gelatin | 20 g |
| Sodium Chloride | 3 g |
| 1,3-Dimethylimidazolidine-2-thione | 20 mg |
| Sodium Benzenethiosulfonate | 10 mg |
| Citric Acid | 0.7 g |

Solution 2

| | |
|---|---|
| Water | 300 ml |
| Silver Nitrate | 150 g |

Solution 3

| | |
|---|---|
| Water | 300 ml |
| Sodium Chloride | 38 g |
| Potassium Bromide | 32 g |
| $K_3IrCl_6$ (0.005% KCl 20% aq. soln.) | the amount shown in Table 1 |
| $(NH_4)_3[RhCl_5(H_2O)]$ (0.001% NaCl 20% aq. soln.) | the amount shown in Table 1 |

$K_3IrCl_6$ (0.005%) and $(NH_4)_3[RhCl_5(H_2O)]$ (0.001%) for use in Solution 3 were prepared by dissolving the powders in a 20% aqueous solution of KCl and a 20% aqueous solution of NaCl respectively and heated at 40° C. for 120 minutes.

Solution 2 and Solution 3 in the amounts corresponding to 90% of each were simultaneously added to Solution 1 maintained at 38° C. and pH 4.5 over a period of 20 minutes with stirring, and nucleus grains having a diameter of 0.16 μm were formed.

Subsequently, Solution 4 and Solution 5 shown below were added over a period of 8 minutes. Further, the remaining amounts of 10% of Solution 2 and Solution 3 were added over a period of 2 minutes, and the diameter of grains was grown to 0.21 μm. Further, 0.15 g of potassium iodide was added and after 5 minutes of ripening the grain formation was completed.

Solution 4

| | |
|---|---|
| Water | 100 ml |
| Silver Nitrate | 50 g |

Solution 5

| | |
|---|---|
| Water | 100 ml |
| Sodium Chloride | 13 g |
| Potassium Bromide | 11 g |
| $K_4[Fe(CN)_6].3H_2O$ (yellow prussiate of potash) | the amount shown in Table 1 |

The resulting emulsion was then washed according to an ordinary flocculation method. Specifically, the temperature was lowered to 35° C., 3 g of the anionic Precipitant-1 shown below was added to the emulsion, and the pH was reduced with a sulfuric acid until the silver halide precipitated (the range of pH was 3.2+0.2), and then 3 liters of the supernatant was removed (first washing). Further, 3 liters of distilled water was added thereto, and a sulfuric acid was added until the silver halide precipitated. Three liters of the supernatant was removed again (second washing). The same procedure as the second washing was repeated one more time (third washing), thereby washing. desalting process was completed.

To the emulsion washed and desalted was added 45 g of gelatin, and the pH and pAg were adjusted to 5.6 and 7.5, respectively, and 10 mg of sodium benzenethiosulfonate, 3 mg of sodiumbenzenethiosulfinate, 15 mg of sodium thiosulfate, 2 mg of triphenylphosphine selenide, and 10 mg of chloroauric acid were added and chemical sensitization was performed at 55° C. to obtain optimal sensitivity. As a stabilizer, 100 mg of 4-hydroxy-6-methyl-1,3,3a,7-tetraazaindene and 100 mg of Proxel (manufactured by ICI Co., Ltd.) as a preservative were added.

The finally obtained emulsion was a silver iodochlorobromide cubic grain emulsion having a silver chloride content of 70 mol %, a silver iodide content of 0.1 mol %, an average grain size of 0.22 μm, and a variation coefficient of 9%. (Finally, the emulsion showed pH of 5.7, pAg of 7.5, electrical conductance of 40 μS/m, density of $1.2\times10^3$ kg/m$^3$, and viscosity of 50 mPa·s.)

Preparation of Emulsion B

Solution 1

| | |
|---|---|
| Water | 750 ml |
| Gelatin | 20 g |
| Sodium Chloride | 1 g |
| 1,3-Dimethylimidazolidine-2-thione | 20 mg |
| Sodium Benzenethiosulfonate | 10 mg |
| Citric Acid | 0.7 g |

Solution 2

| | |
|---|---|
| Water | 300 ml |
| Silver Nitrate | 150 g |

Solution 3

| | |
|---|---|
| Water | 300 ml |
| Sodium Chloride | 38 g |
| Potassium Bromide | 32 g |
| $K_3IrCl_6$ (0.005% KCl 20% aq. soln.) | the amount shown in Table 1 |
| $(NH_4)_3[RhCl_5(H_2O)]$ (0.001% NaCl 20% aq. soln.) | the amount shown in Table 1 |

$K_3IrCl_6$ (0.005%) and $(NH_4)_3[RhCl_5(H_2O)]$ (0.001%) for use in Solution 3 were prepared by dissolving the powders in a 20% aqueous solution of KCl and a 20% aqueous solution of NaCl respectively and heated at 40° C. for 120 minutes.

Solution 2 and Solution 3 in the amounts corresponding to 90% of each were simultaneously added to Solution 1 maintained at 38° C. and pH 4.5 over a period of 20 minutes with stirring, and nucleus grains having a diameter of 0.16 μm were formed. Subsequently, 500 mg of 4-hydroxy-6-methyl-1,3,3a, 7-tetraazaindene was added, and then Solution 4 and Solution 5 shown below were added over a period of 8 minutes. Further, the remaining amounts of 10% of Solution 2 and Solution 3 were added over a period of 2 minutes, and the diameter of grains was grown to 0.18 μm. Further, 0.15 g of potassium iodide was added and after 5 minutes of ripening the grain formation was completed.

Solution 4

| | |
|---|---|
| Water | 100 ml |
| Silver Nitrate | 50 g |

Solution 5

| | |
|---|---|
| Water | 100 ml |
| Sodium Chloride | 13 g |
| Potassium Bromide | 11 g |
| $K_4[Fe(CN)_6].3H_2O$ (yellow prussiate of potash) | the amount shown in Table 1 |

The resulting emulsion was then washed according to an ordinary flocculation method. Specifically, the temperature was lowered to 35° C., 3 g of the anionic Precipitant-1 shown below was added to the emulsion, and the pH was reduced with a sulfuric acid until the silver halide precipitated (the range of pH was 3.2±0.2), and then 3 liters of the supernatant was removed (first washing). Further, 3 liters of distilled water was added thereto, and a sulfuric acid was added until the silver halide precipitated. Three liters of the supernatant was removed again (second washing). The same procedure as the second washing was repeated one more time (third washing), thereby washing. desalting process was completed.

To the emulsion washed and desalted was added 45 g of gelatin, and the pH and pAg were adjusted to 5.6 and 7.5, respectively, and 10 mg of sodium benzenethiosulfonate, 3 mg of sodium benzenethiosulfinate, 15 mg of sodium thiosulfate, 2 mg of triphenylphosphine selenide, and 1 mg of chloroauric acid were added and chemical sensitization was performed at 55° C. to obtain optimal sensitivity. As a stabilizer, 100 mg of 4-hydroxy-6-methyl-1,3,3a, 7-tetraazaindene and 100 mg of Proxel as a preservative were added.

The finally obtained emulsion was a silver iodochlorobromide cubic grain emulsion having a silver chloride content of 70 mol %, a silver iodide content of 0.1 mol %, an average grain size of 0.18 μm, and a variation coefficient of 10%. (Finally, the emulsion showed pH of 5.7, pAg of 7.5, electrical conductance of 40 4 μS/m, density of $1.2\times10^3$ kg/m$^3$, and viscosity of 50 mPa·s.)

Preparation of Emulsions C to L

Emulsions C to L were prepared in the same manner as in the preparation of Emulsion B except for changing the final average grain size and the kind and the addition amount of a heavy metal to be doped as shown in Table 1. The grain size was adjusted by changing the addition amount of sodium chloride in Solution 1 and the preparation temperature.

Preparation of Light-insensitive Silver Halide Grains (1) Solution 1

| | |
|---|---|
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |

Solution 2

| | |
|---|---|
| Water | 400 ml |
| Silver Nitrate | 100 g |

Solution 3

| | |
|---|---|
| Water | 400 ml |
| Sodium Chloride | 13.5 g |
| Potassium Bromide | 45.0 g |
| $(NH_4)_3[RhCl_5(H_2O)]$ (0.001% aq. soln.) | $4\times10^5$ mol/mol of Ag |

Solution 2 and Solution 3 were simultaneously added with stirring to Solution 1 maintained at 70° C. and pH 4.5 over a period of 15 minutes, and nucleus grains were formed. Subsequently, Solution 4 and Solution 5 shown below were added thereto over a period of 15 minutes. Further, 0.15 g of potassium iodide was added and grain formation was completed.

Solution 4

| | |
|---|---|
| Water | 400 ml |
| Silver Nitrate | 100 g |

Solution 5

| | |
|---|---|
| Water | 400 ml |
| Sodium Chloride | 13.5 g |
| Potassium Bromide | 45.0 g |

The resulting emulsion was then washed according to an ordinary flocculation method. Specifically, the temperature was lowered to 35° C., 3 g of the anionic Precipitant-1 shown below was added to the emulsion, and the pH was reduced with a sulfuric acid until the silver halide precipitated (the range of pH was 3.2±0.2), and then 3 liters of the supernatant was removed (first washing). Further, 3 liters of distilled water was added thereto, and a sulfuric acid was added until the silver halide precipitated. Three liters of the supernatant was removed again (second washing). The same procedure as the second washing was repeated one more time (third washing), thereby washing/desalting process was completed.

To the emulsion washed and desalted was added 45 g of gelatin, and the pH and pAg were adjusted to 5.7 and 7.5, respectively, and phenoxyethanol was added as a preservative. Finally, Dispersion (1) of primitive silver iodochlorobromide cubic emulsion grains having a silver chloride content of 30 mol % on average, a silver iodide content of 0.08 mol %, an average grain size of 0.45 μm, and a variation coefficient of 10%. was obtained. (Finally, the emulsion showed pH of 5.7, pAg of 7.5, electrical conductance of 40 μS/m, density of $1.3\times10^3$ kg/m$^3$, and viscosity of 50 mPa·s.)

Anionic Surfactant-1

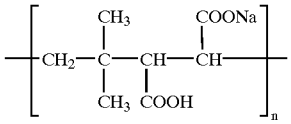

average molecular weight: 120,000

Preparation of Coated Sample

On a polyethylene terephthalate film support having a moisture preventing undercoat layer containing vinylidene chloride on both surfaces as shown below, a UL layer, an emulsion layer, a lower protective layer and an upper protective layer were coated to prepare a sample.

The preparation method and the coating amount of each layer are shown below.

UL Layer

| | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| Preservative (Proxel) | 1.5 mg/m$^2$ |

Emulsion Layer

| | |
|---|---|
| Emulsion | shown in Table 2 |
| Sensitizing Dye (SD-1) | $5.7\times10^{-4}$ mol/mol Ag |
| KBr | $3.4\times10^{-4}$ mol/mol Ag |
| Compound (Cpd-1) | $2.0\times10^{-4}$ mol/mol Ag |
| Compound (Cpd-2) | $2.0\times10^{-4}$ mol/mol Ag |
| Compound (Cpd-3) | $8.0\times10^{-4}$ mol/mol Ag |
| 4-Hydroxy-6-methyl-1,3,3a,7-tetraazaindene | $1.2\times10^{-4}$ mol/mol Ag |
| Hydroquinone | $1.2\times10^{-4}$ mol/mol Ag |
| Citric acid | $3.0\times10^{-4}$ mol/mol Ag |
| Hydrazine compound | shown in Table 2 |
| Nucleating accelerator | shown in Table 2 |
| Compound represented by formula (I) of the present invention | shown in Table 2 |
| 2,4-Dichloro-6-hydroxy-1,3,5-triazine sodium salt | 90 mg/m$^2$ |
| Aqueous latex (aqL-6) | 100 mg/m$^2$ |
| Polyethyl acrylate latex | 150 mg/m$^2$ |
| Colloidal silica (particle size 10 μm) | 15 weight % to gelatin |
| Compound (Cpd-7) | 4 weight % to gelatin |
| Latex copolymer of methyl acrylate/sodium 2-acrylamide-2-methylpropane-sulfonate/2-acetoxyethyl methacrylate (88/5/7 by weight) | 150 mg/m$^2$ |
| Core/shell type latex (core: styrene/butadiene copolymer in the weight ratio of 37/63, shell: styrene/2-acetoxyethyl acrylate copolymer in the weight ratio of 84/16, core/shell ratio: 50/50) | 150 mg/m$^2$ |
| pH was adjusted to 5.5 with a citric acid | |

The thus-prepared emulsion layer coating solution was coated on the following support in a silver coating weight of 3.4 g/m$^2$ and a gelatin coating weight of 1.5 g/m$^2$.

Lower Protective Layer

| | |
|---|---|
| Gelatin | 0.5 g/m$^2$ |
| Light-insensitive silver halide grains (1) | 0.1 g/m$^2$ (as silver amount) |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-22) | 5 mg/m$^2$ |
| Preservative (Proxel) | 1.5 mg/m$^2$ |

Upper Protective Layer

| | |
|---|---|
| Gelatin | 0.3 g/m$^2$ |
| Silica matting agent (amorphous silica having an average particle size: 3.5 μm) | 25 mg/m$^2$ |
| Compound (cpd-8) (gelatin dispersion) | 20 mg/m$^2$ |
| Colloidal silica, Snowtex C, (manufactured by Nissan Chemical Industries, Ltd., particle size: 10 to 20 μm) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Preservative (Proxel, manufactured by ICI Co., Ltd.) | 1 mg/m$^2$ |

The viscosity of the coating solution of each layer was adjusted with thickener (Z) represented by formula (Z) shown below.

The support of the sample used in the present invention had the backing layer and the electrical conductive layer having the following compositions.

Backing Layer

| | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate fine particless (average particle size: 6.5 μm) | 30 mg/m$^2$ |
| Liquid paraffin | 78 mg/m$^2$ |
| Compound (Cpd-7) | 120 mg/m$^2$ |
| Compound (Cpd-22) | 5 mg/m$^2$ |
| Colloidal silica (particle size: 10 μm) | 15 weight % to gelatin |
| Calcium nitrate | 20 mg/m$^2$ |
| Preservative (Proxel) | 12 mg/m$^2$ |

Electrical Conductive Layer

| | |
|---|---|
| Gelatin | 0.1 g/m$^2$ |
| Sodium dodecylbenzenesulfonate | 20 mg/m$^2$ |
| $SnO_2$/Sb (9/1 by weight ratio, average particle size: 0.25 μm) | 200 mg/m$^2$ |
| Preservative (Proxel) | 0.3 mg/m$^2$ |

SD-1
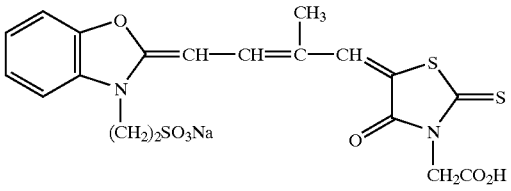
Cpd-1
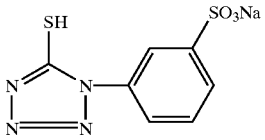
Cpd-2
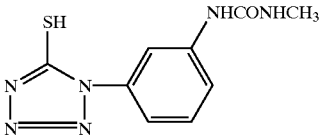
Cpd-3
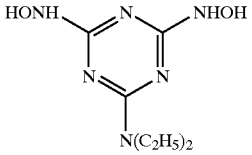
Cpd-4
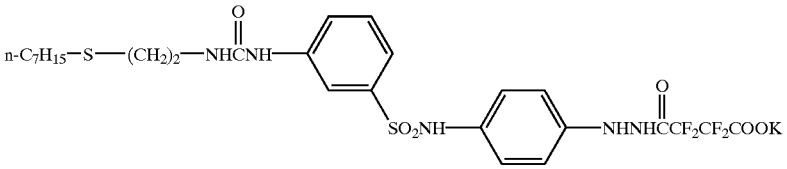
Cpd-5
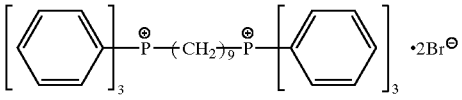
Cpd-6
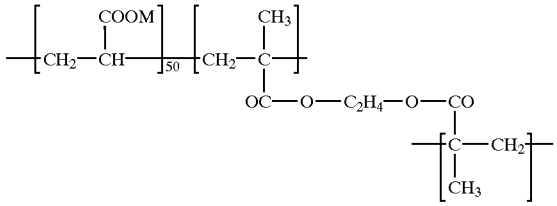
Cpd-7
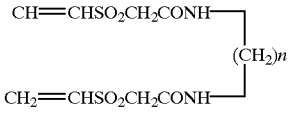
(n = 2):(n = 3) = 3:1
Nucleating Accelerator A:
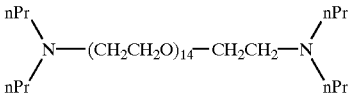
Cpd-8
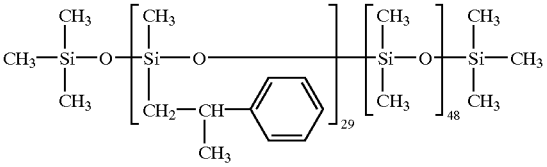
Cpd-9
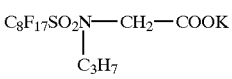
Cpd-10
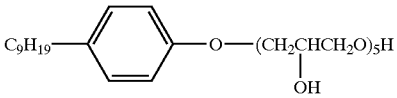
-continued
Cpd-11
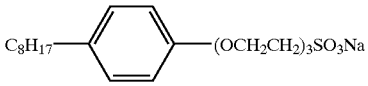
Cpd-12
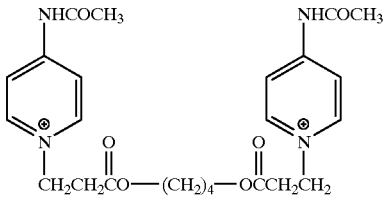
Cpd-13
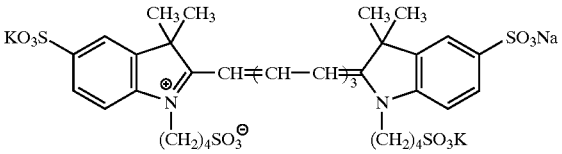

Thickener (Z)

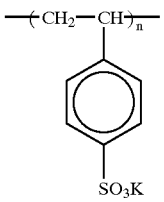

Cpd-14

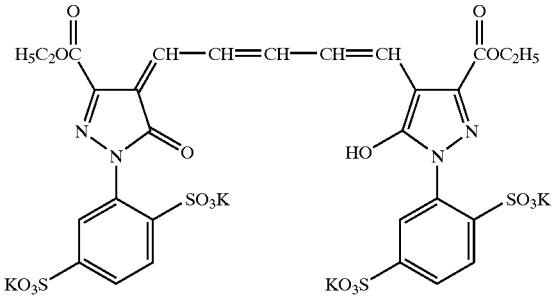

Cpd-15

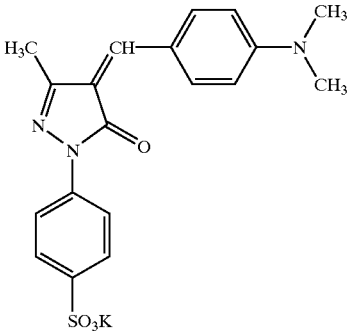

Cpd-16

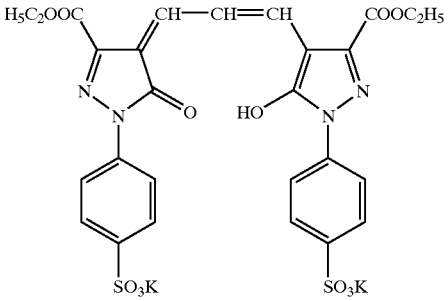

Cpd-17

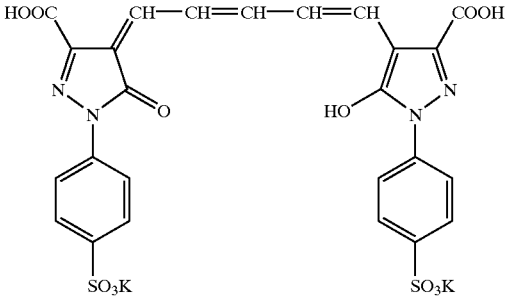

Cpd-18

$CH_3(CH_2)_{11}CH{=}CHSO_3Na$

Cpd-19

$CH_3(CH_2)_{11}CH_2{-}CHSO_3Na$

-continued

Cpd-22

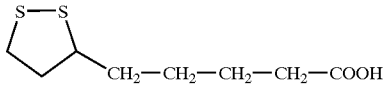

Support

On both sides of a biaxially stretched polyethylene terephthalate support having a thickness of 100 $\mu$m, the first and second undercoat layers having the following compositions were coated.

First Undercoat Layer

| | |
|---|---|
| Core/shell type vinylidene chloride copolymer (1) | 15 g |
| 2,4-Dichloro-6-hydroxy-s-triazine | 0.25 g |
| Polystyrene fine particles (average particle size: 3 $\mu$m) | 0.05 g |
| Compound (Cpd-20) | 0.20 g |
| Colloidal silica (Snowtex ZL) (particle size: 70 to 100 $\mu$m, manufactured by Nissan Chemical Industries, Ltd.) | 0.12 g |
| Water to make | 100 g |

The coating solution whose pH was adjusted to 6 with 10 weight % of KOH was coated on the support at a drying temperature of 180° C. for 2 minutes so as to obtain the dried film thickness of 0.9 $\mu$m.

Second Undercoat Layer

| | |
|---|---|
| Gelatin | 1 g |
| Methyl cellulose | 0.05 g |
| Compound (Cpd-21) | 0.02 g |
| $C_{12}H_{25}O(CH_2CH_2O)_{10}H$ | 0.03 g |
| Proxel | $3.5 \times 10^{-3}$ g |
| Acetic acid | 0.2 g |
| Water to make | 100 g |

The coating solution was coated on the support at a drying temperature of 170° C. for 2 minutes so as to obtain dry film thickness reached 0.1 $\mu$m.

Core/Shell Type Vinylidene Chloride Copolymer (1)

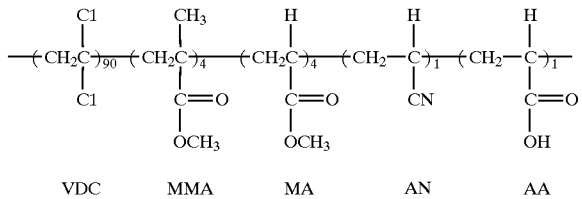

VDC MMA MA AN AA

Core: VDC/MMA/MA (80 weight %)

Shell: VDC/AN/AA (20 weight %)

Average particle size: 70 nm

Compound (Cpd-20)

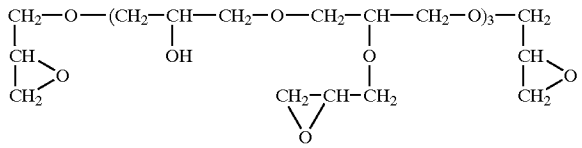

Compound (Cpd-21)

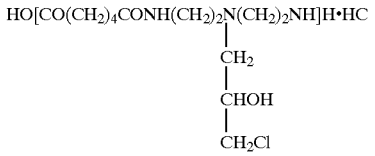

Coating Method

Four layers of the UL layer, the emulsion layer, the lower protective layer and the upper protective layer were multilayer coated simultaneously on the above prepared support having the undercoat layer in this order from the support as the emulsion layer side. Coating was performed by adding a hardening solution by a slide bead coater system while maintaining the temperature at 35° C. After passing a cold air setting zone (5° C.), the electrical conductive layer and the backing layer were multilayer coated simultaneously on the opposite side of the emulsion layer side in this order from the support side also by adding a hardening solution by a curtain coater system, then passed the cold air setting zone (5° C.). At the point when the material passed each setting zone, each coating solution showed sufficient setting property. Subsequently, both sides of the material were dried simultaneously in a drying zone according to the following conditions. After coating of the back face until winding up, the material was transported so as not to touch anything, e.g., rollers and others. The coating velocity at this time was 200 m/min.

Drying Condition

After passing the cold air setting zone, the material was dried with a dry air of 30° C. until the weight ratio of water/gelatin became 800%, then dried with a 35° C. 30% RH dry air until 800% of the weight ratio became 200%, the material was continued to be exposed to the air, and 30 seconds after the time when the surface of the material reached 34° C. (took it for the finish of drying), the material was further dried with a 48° C., 2% RH air for 1 minute. It took 50 seconds for the water/gelatin weight ratio to reach 800% from the beginning of drying, 35 seconds from 800% to 200%, and 5 seconds from 200% to the finish of drying.

This material was wound up at 25° C. 55% RH, then cut in the same atmosphere, and after having been humidity conditioned at 25° C. 50% RH for 8 hours in a barrier bag which had been humidity conditioned for 6 hours, the material was sealed with a cardboard which had been humidity conditioned at 25° C., 50% RH for 2 hours, and samples shown in Table 1 were prepared.

The humidity in the barrier bag was 45%. The film pH of the emulsion layer side of the thus-obtained sample was from 5.5 to 5.8, and the film pH of the backing layer side of the sample was from 6.0 to 6.5. The absorption spectra of the emulsion layer side and the backing layer side coincided with those shown in FIG. 1.

Evaluation was performed as follows.

Sensitometry

Each of the samples obtained was exposed with xenon flash light of emission time of $10^{-6}$ sec. through an interference filter having a peak at 667 nm and a step wedge.

The sample was subjected to development at 35° C. for 30 seconds with the following developing solution (A) and fixing solution (B) using automatic processor FG-680AG (manufactured by Fuji Photo Film Co., Ltd.).

The composition per liter of the concentrated solution is shown below.

Developing Solution (A)

| | |
|---|---|
| Potassium hydroxide | 60.0 g |
| Diethylenetriaminepentaacetic acid | 3.0 g |
| Potassium carbonate | 90.0 g |
| Sodium metabisulfite | 105.0 g |
| Potassium bromide | 10.5 g |
| Hydroquinone | 60.0 g |
| 5-Methylbenzenetriazole | 0.53 g |
| 4-Hydroxymethyl-4-methyl-1-phenyl-3-pyrazolidone | 2.3 g |
| Sodium 3-(5-mercaptotetrazol-1-yl)-benzenesulfonate | 0.15 g |
| Sodium 2-mercaptobenzimidazole-5-sulfonate | 0.45 g |
| Sodium erythorbate | 9.0 g |
| Diethylene glycol | 7.5 g |
| pH | 10.79 |

A mother solution (i.e., A tank solution) was prepared by dilution in the proportion of 1 part of water to 2 parts of the above concentrated solution. The pH value of the mother solution was 10.65. A replenisher was prepared by dilution in the proportion of 3 parts of water to 4 parts of the above concentrated solution. The pH value of the replenisher was 10.62.

The composition per liter of the concentrated solution is shown below.

Fixing Solution (B)

| | |
|---|---|
| Ammonium thiosulfate | 360 g |
| Disodium ethylenediaminetetraacetate dihydrate | 0.09 g |
| Sodium thiosulfate pentahydrate | 33.0 g |
| Sodium metasulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |
| pH | 4.85 |

One part of the above concentrated solution is diluted with 2 parts of water for use. The pH of the working solution is 4.8.

Evaluation of Photographic Properties

Sensitivity:

The reciprocal of the exposure required to give a density of fog+1.5 is taken as the sensitivity and this is shown as a relative sensitivity with the value of Sample No. 1 shown in Table 2 as 100. The larger the value, the higher is the sensitivity.

Gradient:

The gamma (γ) value at optical density of 0.3 to 3.0 is shown by the value expressed by (3.0−0.3)/[log(exposure amount giving a density of 3.0)−log(exposure amount giving a density of 0.3)].

Dot Quality:

Development was performed on the above processing conditions by outputting a test step with varying the amount of light at 175 line/inch using an image setter FT-R 5055 (manufactured by Dai Nippon Screen Mfg. Co., Ltd.). Exposure was performed using LV value which gave intermediate dot area of 50%, and the dot of the intermediate dot area was observed with a 100-fold magnifier and evaluated in five grades. Grade 5 shows the best dot quality and grade 1 is the worst. Grade 3 or higher shows a practicable level. Doe area percentage was measured using Macbeth TD904.

The results obtained are shown in Table 2.

It can be seen from the results in Table 2 that the samples according to the present invention exhibiting the gamma value of 5.0 or more at density of 0.3 to 3.0 and containing the compound represented by formula (I) show high sensitivity and excellent dot quality. The samples containing a hydrazine compound are particularly excellent both in sensitivity and dot quality. Further, the samples using a hydrazine compound in which a dimmer comprises monomers containing both an acylhydrazide moiety and a nicotinamide moiety linked by a linking group are extremely excellent in sensitivity.

TABLE 1

| | | | Heavy Metal | | | | | |
|---|---|---|---|---|---|---|---|---|
| Emulsion | Halogen Composition | Grain Size (μm) | Kind | Addition Amount (mol/mol Ag) | Kind | Addition Amount (mol/mol Ag) | Kind | Addition Amount (mol/mol Ag) |
| A | $AgBr_{30}Cl_{69.9}I_{0.1}$ | 0.22 | $(NH_4)_3[RhCl_5(H_2O)]$ | $2 \times 10^{-7}$ | $K_3IrCl_6$ | $6 \times 10^{-7}$ | $K_4[Fe(CN)_6].3H_2O$ | $2 \times 10^{-5}$ |
| B | " | 0.18 | " | $5 \times 10^{-7}$ | " | " | " | $3 \times 10^{-5}$ |
| C | " | 0.15 | " | $2 \times 10^{-7}$ | " | " | " | $2 \times 10^{-5}$ |
| D | " | 0.10 | " | $0.8 \times 10^{-7}$ | " | " | " | " |
| E | $AgBr_{55}Cl_{44.9}I_{0.1}$ | 0.15 | " | $4 \times 10^{-7}$ | " | " | " | " |
| F | $AgBr_{99.9}I_{0.1}$ | " | " | $6 \times 10^{-7}$ | " | " | " | " |
| G | $AgBr_{30}Cl_{69.9}I_{0.1}$ | " | $K[IrCl_5(NO)]$ | $4 \times 10^{-7}$ | " | " | " | " |
| H | $AgBr_{55}Cl_{44.9}I_{0.1}$ | " | " | " | " | " | " | " |
| I | $AgBr_{30}Cl_{69.9}I_{0.1}$ | " | $K_2[RuCl_5(NO)]$ | " | " | " | " | " |
| J | $AgBr_{55}Cl_{44.9}I_{0.1}$ | " | " | " | " | " | " | " |
| K | $AgBr_{30}Cl_{69.9}I_{0.1}$ | " | $K_2[RuCl_5(H_2O)]$ | " | " | " | " | " |
| L | $AgBr_{55}Cl_{44.9}I_{0.1}$ | " | " | " | " | " | " | " |

TABLE 2

| | | Hydrazine Compound | Neucleating Accelerator | Compound of Formula (I) of the Present Invention | | Photographic Properties | | | |
|---|---|---|---|---|---|---|---|---|---|
| Sample No. | Emulsion | Addition Amount (mol/mol-Ag) | Addition Amount (mol/mol-Ag) | Kind | Addition amount (mol/mol-Ag) | γ | Sensitivity | Dot Quality | Remarks |
| 1 | B | — | — | — | — | 9.3 | 100 | 1.5 | Comparison |
| 2 | " | — | — | I-13 | $1 \times 10^{-6}$ | 9.8 | 105 | 3 | Invention |
| 3 | " | — | — | " | $1 \times 10^{-5}$ | 10.1 | 150 | 3.5 | " |
| 4 | " | — | — | I-37 | " | 9.7 | 142 | 3.5 | " |
| 5 | C | — | — | — | — | 8.9 | 102 | 1.5 | Comparison |
| 6 | " | — | — | I-13 | $1 \times 10^{-5}$ | 9.5 | 148 | 3 | Invention |
| 7 | D | — | — | — | — | 8.3 | 101 | 1.5 | Comparison |
| 8 | " | — | — | I-13 | $1 \times 10^{-5}$ | 9.6 | 139 | 3 | Invention |
| 9 | E | — | — | — | — | 8.7 | 100 | 1.5 | Comparison |
| 10 | " | — | — | I-13 | $1 \times 10^{-5}$ | 9.2 | 152 | 3 | Invention |
| 11 | A/B = 1/2 (Ag mol ratio) | — | — | — | — | 7.1 | 105 | 1.5 | Comparison |
| 12 | A/B = 1/2 (Ag mol ratio) | — | — | I-13 | $1 \times 10^{-5}$ | 7.3 | 110 | 3 | Invention |
| 13 | A/B = 1/4 (Ag mol ratio) | — | — | — | — | 4.2 | 98 | 1.5 | Comparison |
| 14 | A/B = 1/4 (Ag mol ratio) | — | — | I-13 | $1 \times 10^{-5}$ | 4.5 | 96 | 2 | " |
| 15 | A/B = 1/2 (Ag mol ratio) | Cpd-4 ($1 \times 10^{-4}$) | Cpd-5 ($5 \times 10^{-4}$) | — | — | 25.1 | 180 | 3 | " |
| 16 | A/B = 1/2 (Ag mol ratio) | Cpd-4 ($1 \times 10^{-4}$) | Cpd-5 ($5 \times 10^{-4}$) | I-13 | $1 \times 10^{-6}$ | 24.9 | 204 | 4 | Invention |
| 17 | A/B = 1/2 (Ag mol ratio) | Cpd-4 ($1 \times 10^{-4}$) | Cpd-5 ($5 \times 10^{-4}$) | " | $1 \times 10^{-5}$ | 24.6 | 360 | 5 | " |
| 18 | A/B = 1/2 (Ag mol ratio) | H-1 ($1 \times 10^{-4}$) | Cpd-5 ($5 \times 10^{-4}$) | " | " | 26.1 | 420 | 5 | " |
| 19 | | H-1 ($1 \times 10^{-4}$) | A ($5 \times 10^{-4}$) | " | " | 28.2 | 450 | 5 | " |
| 20 | A/B = 1/2 (Ag mol ratio) | H-2 ($1 \times 10^{-4}$) | A ($5 \times 10^{-4}$) | " | " | 25.9 | 410 | 5 | " |
| 21 | B | Cpd-4 ($1 \times 10^{-4}$) | Cpd-5 ($5 \times 10^{-4}$) | — | — | 24.9 | 173 | 3 | Comparison |
| 22 | " | Cpd-4 ($1 \times 10^{-4}$) | Cpd-5 ($5 \times 10^{-4}$) | I-13 | $1 \times 10^{-5}$ | 25.2 | 365 | 4 | Invention |
| 23 | " | H-1 ($1 \times 10^{-4}$) | Cpd-5 ($5 \times 10^{-4}$) | " | " | 26.3 | 415 | 5 | " |
| 24 | " | H-1 ($1 \times 10^{-4}$) | A ($5 \times 10^{-4}$) | " | " | 27.1 | 420 | 5 | " |

TABLE 2-continued

| Sample No. | Emulsion | Hydrazine Compound Addition Amount (mol/mol-Ag) | Neucleating Accelerator Addition Amount (mol/mol-Ag) | Compound of Formula (I) of the Present Invention Kind | Compound of Formula (I) of the Present Invention Addition amount (mol/mol-Ag) | Photographic Properties γ | Photographic Properties Sensitivity | Photographic Properties Dot Quality | Remarks |
|---|---|---|---|---|---|---|---|---|---|
| 25 | " | H-3 ($1 \times 10^{-4}$) | A ($5 \times 10^{-4}$) | " | " | 26.9 | 430 | 5 | " |
| 26 | C | Cpd-4 ($1 \times 10^{-4}$) | A ($5 \times 10^{-4}$) | — | — | 24.9 | 182 | 3 | Comparison |
| 27 | " | Cpd-4 ($1 \times 10^{-4}$) | A ($5 \times 10^{-4}$) | I-13 | $1 \times 10^{-5}$ | 24.1 | 372 | 4.5 | Invention |
| 28 | " | H-1 ($1 \times 10^{-4}$) | A ($5 \times 10^{-4}$) | " | " | 25.9 | 415 | 5 | " |
| 29 | D | Cpd-4 ($1 \times 10^{-4}$) | A ($5 \times 10^{-4}$) | — | — | 24.1 | 175 | 3 | Comparison |
| 30 | " | Cpd-4 ($1 \times 10^{-4}$) | A ($5 \times 10^{-4}$) | I-13 | $1 \times 10^{-5}$ | 23.3 | 355 | 4 | Invention |
| 31 | " | H-1 ($1 \times 10^{-4}$) | A ($5 \times 10^{-4}$) | I-13 | $1 \times 10^{-5}$ | 26.2 | 400 | 5 | Invention |
| 32 | E | Cpd-4 ($1 \times 10^{-4}$) | A ($5 \times 10^{-4}$) | — | — | 25.2 | 168 | 3 | Comparison |
| 33 | E | Cpd-4 ($1 \times 10^{-4}$) | A ($5 \times 10^{-4}$) | I-13 | $1 \times 10^{-5}$ | 24.3 | 400 | 5 | Invention |
| 34 | F | Cpd-4 ($1 \times 10^{-4}$) | A ($5 \times 10^{-4}$) | " | " | 24.6 | 388 | 5 | " |
| 35 | G | Cpd-4 ($1 \times 10^{-4}$) | A ($5 \times 10^{-4}$) | " | " | 24.1 | 369 | 5 | " |
| 36 | H | Cpd-4 ($1 \times 10^{-4}$) | A ($5 \times 10^{-4}$) | " | " | 23.9 | 355 | 5 | " |
| 37 | I | Cpd-4 ($1 \times 10^{-4}$) | A ($5 \times 10^{-4}$) | " | " | 22.8 | 358 | 5 | " |
| 38 | J | Cpd-4 ($1 \times 10^{-4}$) | A ($5 \times 10^{-4}$) | " | " | 23.9 | 395 | 5 | " |
| 39 | K | Cpd-4 ($1 \times 10^{-4}$) | A ($5 \times 10^{-4}$) | " | " | 24.8 | 387 | 4.5 | " |
| 40 | L | Cpd-4 ($1 \times 10^{-4}$) | A ($5 \times 10^{-4}$) | " | " | 25.6 | 388 | 4.5 | " |

EXAMPLE 2

Samples were prepared in the same manner as in Example 1 except for adding, in place of sodium thiosulfate used as the chemical sensitizer of Emulsions A to L in Example 1, a carboxymethyltrimethylthiourea compound which is a tetra-substituted thiourea compound, or a dicarboxymethyldimethylthiourea compound, in an equimolar amount to the sodium thiosulfate. The samples having the constitution of the present invention showed excellent properties similarly to the samples prepared in Example 1.

EXAMPLE 3

The same experiments were performed using the following solid developing solution (C) and solid fixing agent (D). The samples having the constitution of the present invention showed excellent properties similarly to the samples prepared in Example 1.

Prescription of Solid Developing Agent (C)

| | |
|---|---|
| Sodium hydroxide (beads, 99.5%) | 11.5 g |
| Potassium sulfite (stock powder) | 63.0 g |
| Sodium sulfite (stock powder) | 46.0 g |
| Potassium carbonate | 62.0 g |
| Hydroquinone (briquette) | 40.0 g |

The following are briquetted together.

| | |
|---|---|
| Diethylenetriaminepentaacetic acid | 2.0 g |
| 5-Methylbenzenetriazole | 0.35 g |
| 4-Hydroxymethyl-4-methyl-1-phenyl-3-pyrazolidone | 1.5 g |
| 4-(N-Carboxymethyl-N-methylamino)-2,6-dimercaptopyrimidine | 0.2 g |
| Sodium 3-(5-mercaptotetrazol-1-yl)-benzenesulfonate | 0.1 g |
| Sodium erythorbate | 6.0 g |
| Potassium bromide | 6.6 g |
| These components were dissolved in water to make | 1 liter |
| pH | 10.65 |

Stock powders which were general industrial products were used as they were and beads of alkali metal salts were those commercially available.

Raw materials which were in the form of a briquette were compressed by the application of pressure using a briquetting machine and formed to a sheet, and they were crushed and used. With respect to small amount components, every components were blended and then made to a briquette.

Ten liter portion of the above processing chemicals was filled in a foldable container made of high density polyethylene and the takeout port was sealed with an aluminum seal. The dissolving and replenishing device having an automatic opening mechanism as disclosed in JP-A-9-80718 and JP-A-9-138495 was used for the dissolution and replenishment.

Prescription of Solid Fixing Agent (D)

Agent A (Solid)

| | |
|---|---|
| Ammonium thiosulfate (compact) | 125.0 g |
| Sodium thiosulfate anhydride (stock powder) | 19.0 g |
| Sodium metabisulfite (stock powder) | 18.0 g |
| Sodium acetate anhydride (stock powder) | 42.0 g |

Agent B (Solution)

| | |
|---|---|
| Disodium ethylenediaminetetraacetate dihydrate | 0.03 g |
| Tartaric acid | 2.9 g |
| Sodium gluconate | 1.7 g |
| Aluminum sulfate | 8.4 g |
| Sulfuric acid | 2.1 g |
| These components were dissolved in water to make | 50 ml |
| Agents A and B were dissolved in water to make (Fixing Agent (D)) | 1 liter |
| pH | 4.85 |

Flakes of ammonium thiosulfate (compact) produced by a spray drying method were compressed by the application of pressure using a roller compactor and crushed to an amorphous chips having a length of about 4 to 6 mm, then blended with sodium thiosulfate anhydride. As for other stock powders, general industrial products were used.

Ten liter portion of each of Agent A and Agent B was filled in a foldable container made of high density polyethylene and the takeout port of Agent A was sealed with an aluminum seal. The mouth of the container of Agent B was sealed with a screw cap. The dissolving and replenishing device having an automatic opening mechanism as disclosed in JP-A-9-80718 and JP-A-9-138495 was used for the dissolution and replenishment.

EXAMPLE 4

The same experiments were performed using the following solid developing solution (E) in place of Developing Solution (A) in Example 1. The samples having the constitution of the present invention showed excellent properties similarly to the samples prepared in Example 1.

The composition per liter of the concentrated solution of Developing Solution (E) is shown below.

Developing Solution (E)

| | |
|---|---|
| Potassium hydroxide | 105.0 g |
| Diethylenetriaminepentaacetic acid | 6.0 g |
| Potassium carbonate | 120.0 g |
| Sodium metabisulfite | 120.0 g |
| Potassium bromide | 9.0 g |
| Hydroquinone | 75.0 g |
| 5-Methylbenzenetriazole | 0.25 g |
| 4-Hydroxymethyl-4-methyl-1-phenyl-3-pyrazolidone | 1.35 g |
| 4-(N-Carboxymethyl-N-methylamino)-2,6-dimercaptopyrimidine | 0.3 g |
| Sodium 2-mercaptobenzimidazole-5-sulfonate | 0.45 g |
| Sodium erythorbate | 9.0 g |
| Diethylene glycol | 60.0 g |
| pH | 10.7 |

One part of the above concentrated solution is diluted with 2 parts of water for use. The pH of the working solution is 10.5.

EXAMPLE 5

Running processing of a scanner film HL (manufactured by Fuji Photo Film Co., Ltd.) of blackening ratio of 20% was performed using Developing Solution (A) in Example 1 in such a manner that 20 sheets of the film was processed per a day with replenishing 50 ml of a replenisher per a large size (50.8 cm×61 cm) of the scanner film and running processing was performed six days a week, and this running processing was continued for 15 weeks, thus a developing solution where the sulfite concentration was reduced to one third of the starting time due to development of a small quantity of films was obtained.

Running processing of a scanner film HL (manufactured by Fuji Photo Film Co., Ltd.) of blackening ratio of 80% was performed using Developing Solution (A) in Example 1 in such a manner that 300 sheets of the film was processed per a day with replenishing 50 ml of a replenisher per a large size (50.8 cm×61 cm) of the scanner film and running processing was performed for four days continuously, thus a developing solution where pH was lowered to 10.2 and the bromine ion concentration was increased due to development of a large quantity of films was obtained.

The same experiment as in Example 1 was performed using the thus-obtained exhausted developing solution and the developing solution in the middle stage of exhaustion. The samples having the constitution of the present invention showed excellent properties similarly to the samples as in Example 1.

EXAMPLE 6

Processing was performed in the same manner as in Examples 1 to 5 except for setting the development temperature at 38° C., fixing temperature at 37° C. and by development time for 20 seconds. The results obtained are same as those in Examples 1 to 5, thus the effect of the present invention was not lost.

EXAMPLE 7

The same results were obtained when the same processing as in Examples 1 to 5 was performed using an automatic processor FG-680AS (manufactured by Fuji Photo Film Co., Ltd.) and by transporting speed of the material of 1,500 mm/min (linear speed).

EXAMPLE 8

The same evaluation was performed using any one of Select Set 5000, Abantra 25 or Accuset 1000 (manufactured by Agfa-Gevaert Co., Ltd.), Dolev 450 or Dolev 800 (manufactured by Saitex Co., Ltd.), Linotronic 630, Quasar, Herkules Elite or Shigana Setter (Heidel Co. , Ltd.), Lux Setter RC-5600V or Luxel F-900 (manufactured by Fuji Photo Film Co., Ltd.), or Panther Pro 62 (manufactured by Prepus Co., Ltd.) in place of an image setter FT-R 5055 (manufactured by Dai Nippon Screen Co., Ltd.). The similar results were obtained with the samples of the present invention.

The entitle disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least a silver halide emulsion layer, which contains at least one compound represented by the following formula (I), and has a characteristic curve of gamma value being 5.0 or more in optical density of from 0.3 to 3.0 on the characteristic curve shown on the orthogonal axis of coordinates having equal unit length expressed by logarithmic exposure amount (x axis) and optical density (y axis):

$$(X)_l—(L)_m—(A—B)_n \quad (I)$$

wherein X represents a silver halide-adsorptive group having at least one of N, S, P, Se and Te atom, or a light absorptive group; L represents a divalent linking group having at least one of C, N, S and O atom; A represents an electron donative group; B represents a releasing group or a hydrogen atom, which forms radical A. by releasing or deproton after oxidation; l and m each represents an integer of from 0 to 3; and n represents 1 or 2.

2. The silver halide photographic material as claimed in claim 1 which contains a hydrazine compound.

3. The silver halide photographic material as claimed in claim 1, wherein said silver halide photographic material has a pH of 6.0 or less on the film surface of the emulsion layer side.

4. The silver halide photographic material as claimed in claim 2, wherein the hydrazine compound is a dimer comprising monomers containing both an acylhydrazide moiety and a nicotinamide moiety linked by a linking group.

5. The silver halide photographic material as claimed in claim 4, wherein the dimer comprising monomers containing both an acylhydrazide moiety and a nicotinamide moiety linked by a linking group is represented by the following formula (1) or (2):

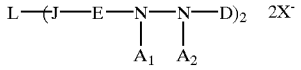

(1)

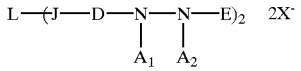

(2)

wherein each monomer linked by linking group L is the same or different; J represents a nicotinamide residue; E represents a substituted aryl or a heterocyclic ring; one of $A_1$ and $A_2$ represents a hydrogen atom and the other represents a hydrogen atom, an acyl group or an alkyl- or aryl-sulfonyl group, any of which may be substituted; D represents a blocking group; L represents a divalent linking group; and $X^-$ represents an anionic counter ion.

* * * * *